US007165811B2

(12) United States Patent
Bodnar et al.

(10) Patent No.: US 7,165,811 B2
(45) Date of Patent: Jan. 23, 2007

(54) CONTROL MECHANISM FOR SEATING UNIT

(75) Inventors: David A. Bodnar, Ada, MI (US); Adam C. Bedford, Rockford, MI (US); Kurt R. Heidmann, Grand Rapids, MI (US); Gary L. Karsten, Wayland, MI (US)

(73) Assignee: Steelcase Development Corporation, Caledonia, MI (US)

( * ) Notice: Subject to any disclaimer, the term of this patent is extended or adjusted under 35 U.S.C. 154(b) by 593 days.

(21) Appl. No.: 10/455,503

(22) Filed: Jun. 5, 2003

(65) Prior Publication Data

US 2004/0051358 A1 Mar. 18, 2004

Related U.S. Application Data

(63) Continuation-in-part of application No. 10/241,955, filed on Sep. 12, 2002, now Pat. No. 6,869,142.

(51) Int. Cl.
*A47C 1/024* (2006.01)

(52) U.S. Cl. ..... 297/300.2; 297/300.1; 297/325; 297/302.1; 297/300.4

(58) Field of Classification Search ..... 297/300.2, 297/300.1, 325, 302.1, 300.4
See application file for complete search history.

(56) References Cited

U.S. PATENT DOCUMENTS

| | | | |
|---|---|---|---|
| 144,349 | A | 11/1873 | Morrison et al. |
| 198,892 | A | 1/1878 | Magers |
| 223,385 | A | 1/1880 | Price |
| 312,775 | A | 2/1885 | Walker |
| 389,292 | A | 9/1888 | Flohr |
| 609,389 | A | 8/1898 | Garland |
| 1,009,417 | A | 11/1911 | John |
| 1,182,854 | A | 5/1916 | Poler |
| 1,513,726 | A | 10/1924 | Lamplugh |
| 2,156,664 | A | 5/1939 | Litle, Jr. |
| D133,847 | S | 9/1942 | Brodovitch |
| 2,316,628 | A | 4/1943 | Schaffner |
| D168,501 | S | 12/1952 | Guillon |
| 2,711,211 | A | 6/1955 | Tidcombe |

(Continued)

FOREIGN PATENT DOCUMENTS

| | | | |
|---|---|---|---|
| BE | 572539 | A | 7/1962 |

(Continued)

*Primary Examiner*—Laurie K. Cranmer
(74) *Attorney, Agent, or Firm*—Price, Heneveld, Cooper, DeWitt & Litton LLP

(57) ABSTRACT

A seating unit includes a base, a reclineable back, a seat, and a control operably supporting the back and the seat on the base for movement between upright and recline positions. The control includes a pair of flexible support members and a link that combine to operably support the seat and back for synchronous movement on the base upon recline. The flexible support member is stiff in a vertical direction for carrying a combined weight of the one component and of the seated user, but flexible in a horizontal direction to permit a swinging movement of its ends upon recline. The link is rigid and pivoted to the base for movement about a horizontal axis and also pivoted to the one component. By this arrangement, the flexible member and the link move the one component along a defined path during recline of the back.

36 Claims, 37 Drawing Sheets

U.S. PATENT DOCUMENTS 2,731,076 A 1/1956 Rowland
2,803,293 A 8/1957 Rowland
2,818,911 A 1/1958 Syak
RE24,964 E 4/1961 Eames
2,995,182 A 8/1961 Hendrickson
3,021,176 A 2/1962 Eads et al.
3,035,828 A 5/1962 Stubnitz
3,044,831 A 7/1962 Neely
3,046,005 A 7/1962 Raduns
3,156,461 A 11/1964 Caughey
3,189,314 A 6/1965 Pickles
3,241,879 A 3/1966 Castello et al.
3,271,076 A 9/1966 Smith
3,332,719 A 7/1967 Flint
3,369,840 A 2/1968 Dufton
3,709,559 A 1/1973 Rowland
3,720,568 A 3/1973 Rowland
3,744,846 A 7/1973 Platt et al.
3,888,473 A 6/1975 Mandusky et al.
3,934,932 A 1/1976 Ekornes
4,062,590 A 12/1977 Polsky et al.
4,099,775 A 7/1978 Mizelle
4,162,807 A 7/1979 Yoshimura
4,200,332 A 4/1980 Brauning
4,247,089 A 1/1981 Crosby et al.
4,309,058 A 1/1982 Barley
4,318,556 A 3/1982 Rowland
4,364,605 A 12/1982 Meiller
4,390,206 A 6/1983 Faiks et al.
4,415,147 A 11/1983 Biscoe et al.
4,478,454 A 10/1984 Faiks
4,545,614 A 10/1985 Abu-Isa et al.
4,586,700 A 5/1986 Crosby
4,588,172 A 5/1986 Fourrey et al.
4,595,237 A 6/1986 Nelsen
4,603,905 A 8/1986 Stucki
4,621,864 A 11/1986 Hill
4,638,679 A 1/1987 Tannenlaufer
4,668,014 A 5/1987 Boisset
4,685,737 A 8/1987 Deley et al.
4,709,962 A 12/1987 Steinmann
4,709,963 A 12/1987 Eucker et al.
4,715,587 A 12/1987 Grosby
4,718,716 A 1/1988 Stumpf et al.
4,733,845 A 3/1988 Maiwald
4,736,932 A 4/1988 Haslim
4,763,950 A 8/1988 Tobler
4,768,244 A 9/1988 Riedl
4,769,864 A 9/1988 Park
4,776,633 A 10/1988 Knoblock et al.
4,787,673 A 11/1988 Locher
4,815,717 A 3/1989 Crosby
4,818,021 A 4/1989 Roysher
4,840,426 A 6/1989 Vogtherr et al.
4,858,992 A 8/1989 LaSota
4,889,384 A 12/1989 Sulzer
4,906,045 A 3/1990 Hofman
4,911,501 A 3/1990 Decker et al.
4,915,449 A 4/1990 Piretti
4,935,977 A 6/1990 Yamada
4,966,411 A 10/1990 Katagiri et al.
4,981,326 A 1/1991 Heidmann
4,984,846 A 1/1991 Ekornes
4,991,243 A 2/1991 Rottermann
5,018,787 A 5/1991 Estkowski et al.
5,022,709 A 6/1991 Marchino
5,024,484 A 6/1991 Buchacz
5,029,940 A 7/1991 Golynsky et al.
5,046,780 A 9/1991 Decker et al.
5,056,862 A 10/1991 May et al.
5,058,952 A 10/1991 LaSota
5,080,318 A 1/1992 Takamatsu et al.
5,106,157 A 4/1992 Nagelkirk et al.
5,107,720 A 4/1992 Hatfield
5,121,934 A 6/1992 Decker et al.
5,172,882 A 12/1992 Nini
5,192,114 A 3/1993 Hollington et al.
5,251,958 A 10/1993 Roericht et al.
5,267,777 A 12/1993 Valtri
5,269,497 A 12/1993 Barth
5,282,285 A 2/1994 de Gelis et al.
5,282,670 A 2/1994 Karsten et al.
5,316,371 A 5/1994 Bishai
5,328,242 A 7/1994 Steffens et al.
5,338,094 A 8/1994 Perry
5,348,372 A 9/1994 Takamatsu et al.
5,356,199 A 10/1994 Elzenbeck et al.
5,366,274 A 11/1994 Roericht et al.
5,379,472 A 1/1995 Aittomaki
5,385,388 A 1/1995 Faiks et al.
5,385,389 A 1/1995 Bishai
5,425,522 A 6/1995 Retzlaff
5,486,035 A 1/1996 Koepke et al.
5,499,861 A 3/1996 Locher
5,549,358 A 8/1996 Muller
5,556,163 A 9/1996 Rogers, III et al.
5,577,807 A 11/1996 Hodge et al.
5,624,161 A 4/1997 Sorimachi et al.
5,641,205 A 6/1997 Schmidt
5,658,049 A 8/1997 Adams et al.
5,683,139 A 11/1997 Golynsky et al.
5,772,282 A 6/1998 Stumpf et al.
5,782,536 A 7/1998 Heidmann et al.
5,871,256 A 2/1999 Kogai
5,873,632 A 2/1999 Chieh-Tsung
5,884,977 A 3/1999 Swamy et al.
5,915,788 A 6/1999 Schneider
5,931,531 A 8/1999 Assmann
5,934,758 A 8/1999 Ritch et al.
5,975,634 A 11/1999 Knoblock et al.
6,003,943 A 12/1999 Schneider
6,056,367 A 5/2000 Hsiao
6,059,368 A 5/2000 Stumpf et al.
6,068,336 A 5/2000 Schonauer
6,074,013 A 6/2000 Hsiao
6,086,153 A 7/2000 Heidmann et al.
6,102,477 A 8/2000 Kurtz
6,116,694 A 9/2000 Bullard
6,116,695 A 9/2000 Heidmann et al.
6,134,729 A 10/2000 Quintile et al.
6,149,236 A 11/2000 Brauning
6,152,531 A 11/2000 Deceuninck
6,170,915 B1 1/2001 Weisz
6,174,031 B1 1/2001 Lindgren et al.
6,250,715 B1 6/2001 Caruso et al.
6,264,179 B1 7/2001 Bullard
6,357,830 B1 3/2002 Ratza et al.
6,367,876 B2 4/2002 Caruso et al.
6,382,724 B1 5/2002 Piretti
6,386,634 B1 5/2002 Stumpf et al.
6,394,548 B1 5/2002 Battey et al.
6,439,661 B1 8/2002 Brauning
6,450,577 B1 9/2002 Roslund, Jr.
6,499,803 B2 12/2002 Nakane et al.
6,523,898 B1 2/2003 Ball et al.
6,536,841 B1 3/2003 Pearce et al.
6,550,859 B1 4/2003 Andersson et al.
6,585,320 B2 7/2003 Holbrook et al.
6,598,251 B2 7/2003 Habboub et al.
6,609,755 B2 8/2003 Koepke et al.
2002/0043867 A1 4/2002 Lessmann
2003/0001420 A1 1/2003 Koepke et al.

2003/0001424 A1 1/2003 Mundell et al.

FOREIGN PATENT DOCUMENTS

| | | | |
|---|---|---|---|
| BE | 856830 | A | 10/1977 |
| DE | 142693 | | 10/1930 |
| DE | 834587 | | 3/1952 |
| DE | 19542132 | | 11/1997 |
| DE | 29805913 | U | 7/1998 |
| EP | 0043242 | | 1/1982 |
| FR | 467099 | A | 7/1937 |
| FR | 487420 | | 6/1938 |
| FR | 883637 | | 7/1943 |
| FR | 54852 | E | 12/1950 |
| FR | 1338211 | A | 9/1963 |
| FR | 2301204 | | 9/1976 |
| GB | 149246 | A | 4/1921 |
| GB | 342613 | A | 2/1931 |
| GB | 483047 | A | 4/1938 |
| GB | 640883 | A | 8/1950 |
| GB | 761805 | | 11/1956 |
| JP | S5419866 | | 7/1977 |
| JP | 53111867 | | 9/1978 |
| JP | S5419864 | | 2/1979 |
| WO | WO 82/01760 | | 5/1982 |
| WO | WO8700738 | | 2/1987 |
| WO | WO9313695 | | 7/1993 |
| WO | WO9325121 | | 12/1993 |
| WO | WO9816140 | | 4/1998 |
| WO | WO0176420 | | 10/2001 |

CONTROL MECHANISM FOR SEATING UNIT

CROSS REFERENCE TO RELATED APPLICATIONS

This application is a continuation-in-part of application Ser. No. 10/241,955, filed Sep. 12, 2002 now U.S. Pat. No. 6,869,142, entitled SEATING UNIT HAVING MOTION CONTROL, THE ENTIRE CONTENTS OF WHICH IS INCORPORATED HEREIN BY REFERENCE. This application is further related to application Ser. No. 10/455,487, filed on even date herewith, entitled SEATING WITH COMFORT SURFACE, and application Ser. No. 10/455,076, filed on even date herewith, entitled COMBINED TENSION AND BACK STOP FUNCTION FOR SEATING UNIT, the entire contents of which are incorporated herein by reference.

BACKGROUND

The present invention relates to a seating unit having a back and a seat operably supported for coordinated movement by a control that also provides a weight-activated function where additional support is provided to a heavy seated user upon recline.

Comfort and style continue to be highly-demanded features in seating. However, industry competitiveness continues to put substantial cost pressures on new designs. Many chair designs use gas or pneumatic springs, however these devices are expensive and can result in warranty problems. Mechanical coil springs are low cost, but are tough to package in a chair design having a sleek profile, and further adjustment of the coil springs can be difficult. It is desirable to provide a chair control design that is highly flexible and adaptable for different functional arrangements, yet that is modernistic in its appearance and mechanism of action. It is also desirable to provide a control that, while novel and non-obvious in its function and appearance, uses known technologies and materials for implementing its structure.

In addition to the above, it is also desirable to provide an underseat control mechanism that is simple to manufacture and assemble, is low cost, and that has a modern, thin, sleek appearance. In many chairs, the underseat control mechanism must have a thin profile, so that it can be integrated into a chair having a sleek, slender, elegant appearance. It is desirable that the underseat control mechanism include the ability to provide weight-activated support upon recline, so that heavier users feel added support upon recline even without adjustment. However, it is also desired to provide an adjustment feature and/or a supplemental adjustable biasing device so that additional back support can be selectively provided upon recline, so as to satisfy preferences of particular users who like more support during recline than most users.

In addition to the above, it is desirable to provide a chair that is optimally designed to use recyclable parts, and that uses components that can be easily separated for recycling and/or repair. Expanded thermoset foam products are not recyclable, and are generally considered to be less favorable to the environment than steel, remeltable thermoplastic, and recyclable or more-natural covering materials. Eliminating thermoset foam would be a significant step toward making a chair 100% recyclable. However, the comfort and cost advantage must be maintained for competitive reasons.

Accordingly, an apparatus solving the aforementioned problems and having the aforementioned advantages is desired.

SUMMARY OF THE PRESENT INVENTION

In one aspect of the present invention, a seating unit includes a base, a reclineable back component, a seat component, and a control operably supporting the back component and the seat component on the base for synchronous movement between upright and reclined positions. The control includes at least one flexible support member supported on the base, and also includes a link pivoted to the base for movement about a generally horizontal axis at a location spaced from the flexible support member. The flexible support member has arms with end sections operably attached to at least one of the seat and back components and is stiff in a generally vertical direction for carrying a combined weight of the one component and of the seated user, but is flexible in a generally horizontal direction to permit synchronous movement upon recline. The link is rigid and is pivoted to the base, and also is pivotally coupled to the one component, whereby the flexible member and the link move the one component along a defined path during recline of the back component.

In another aspect of the present invention, a seating unit includes a base, a seat component, and a reclineable back component. The seating unit also includes an underseat control for operably supporting the seat component and the back component for coordinated synchronous movement upon recline of the back component. The control includes arms that are moveable in a generally horizontal direction for supporting at least one of the seat component and the back component. The one component includes a comfort surface structure, the comfort surface structure including horizontally-extending support wires adapted to individually flex in response to contours of a seated user so that, upon recline, the seated user does not tend to slide relative to the one component.

In another aspect of the present invention, a seating unit includes a base, a back component, a seat component, and an underseat control operably coupled to and supporting the back component and the seat component on the base for synchronous movement between upright and reclined positions. The control includes compliant arms that are moveable in a generally horizontal direction for supporting at least one of the seat component and the back component, and also includes a link pivoted to the base and pivoted to the seat component for movement about a generally horizontal axis on the base at a location spaced from the arms.

In another aspect of the present invention, a seating unit includes a base, a back component, a seat component, and an underseat control operably coupled to and supporting the back component and the seat component on the base for synchronous movement between upright and reclined positions. The control includes compliant arms that are moveable in a generally horizontal direction for supporting at least one of the seat component and the back component, and also including a booster mechanism selectively engageable to bias the one component toward the upright position.

In yet another aspect of the present invention, a seating unit includes a base, a back component, a seat component, and an underseat control operably coupled to and supporting the back component and the seat component on the base for synchronous movement between upright and reclined positions. The control includes compliant arms that are moveable in a generally horizontal direction for supporting at least one of the seat component and the back component, and also includes a back stop mechanism selectively engageable to limit movement of the one component toward the reclined position.

In still another aspect of the present invention, a seating unit includes a base, a back component, a seat component, and an underseat control operably coupled to and supporting the back component and the seat component on the base for synchronous movement between upright and reclined positions. At least one of the seat component and the back component include a frame defining a center opening and a plurality of independently-flexible wires extending across the opening for supporting a seated user, and a sheet covering the wires.

In another aspect of the present invention, a seating unit includes a seat. A control mechanism has a plurality of compliant support arms, said support arms being relatively stiff in a generally vertical direction for supporting weight and relatively flexible in a generally horizontal direction for allowing movement of the weight. A back is attached to at least one of said plurality of compliant support arms such that said back is allowed to move as said compliant support arms flex, thus providing a compliant back support system for said seating unit.

In another aspect of the present invention, a seating unit includes a seat. A control mechanism has at least one compliant support arm, a movable link, and a stop device for selectively preventing said link from moving. A back is attached to said at least one compliant support arm and said movable link, said at least one compliant support arm allowing said back to move as said at least one compliant support arm flexes to provide a compliant back support system for said seating unit even when said link is prevented from moving.

These and other aspects, objects, and features of the present invention will be understood and appreciated by those skilled in the art upon studying the following specification, claims, and appended drawings.

BRIEF DESCRIPTION OF DRAWINGS

FIGS. 67 and 68 showing assembly of upright members together, FIG. 69 showing the full assembly.

DETAILED DESCRIPTION OF PREFERRED EMBODIMENTS

Figure 1:
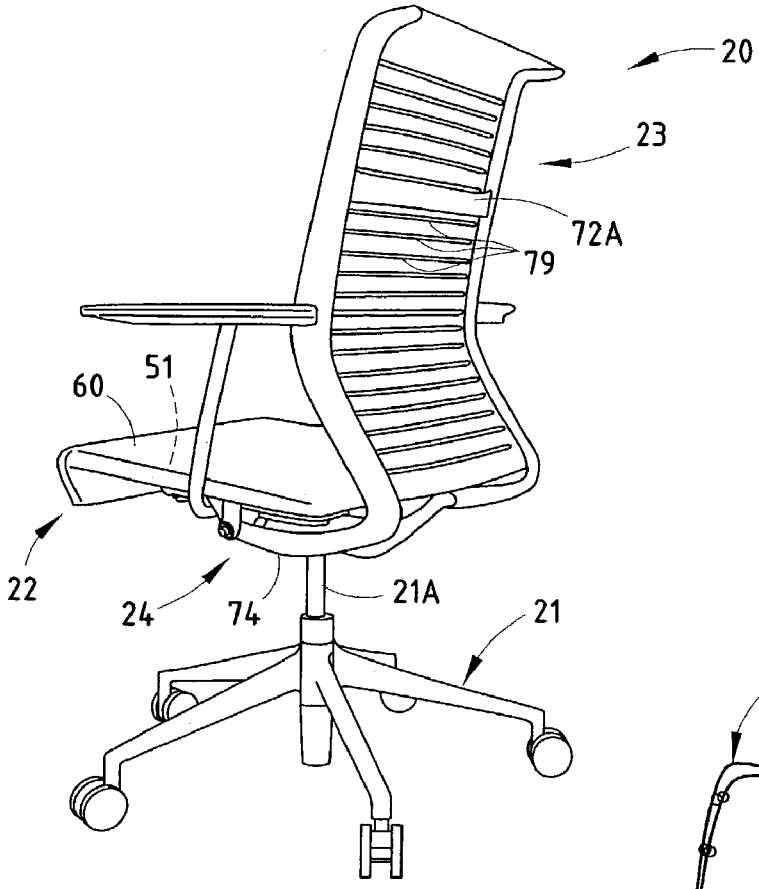
FIG. 1 is a perspective view of a seating unit embodying the present invention, the seating unit including transverse wires in a back and seat forming a comfortable support surface.

A chair 20 (FIG. 1) embodying the present invention includes a base 21, a seat 22, and a back 23, with the seat 22 and back 23 being operably supported on the base 21 by an underseat control mechanism 24 for synchronous movement upon recline of the back 23. Upon recline, the control mechanism 24 moves and lifts the seat 22 upwardly and forwardly, such that the back 23 (and the seated user) is automatically provided with a weight-activated back-supporting force upon recline. Advantageously, heavier-weight seated users receive greater back-supporting force, thus eliminating (or at least reducing) the need for them to adjust a tension device for back support when reclining in the chair. The seat 22 (and also the back 23) includes a highly comfortable support surface formed by a locally-compliant support structure (hereafter called "a comfort surface") that adjusts to the changing shape and ergonomic support needs of the seated user, both when in an upright position and a reclined position. Specifically, the comfort surface changes shape in a manner that retains the seated user comfortably in the chair during recline, yet that provides an optimal localized ergonomic support to the changing shape of the seated user as the user's pelvis rotate during recline. In addition, the chair 20 avoids placing an uncomfortable lifting force under the seated user's knees and thighs, by well-distributing such forces at the knees and/or by flexing partially out of the way in the knee area. Further, comfort surfaces of the seat 22 and back 23 create a changing bucket shape (FIGS. 2A and 2B) that "grips" a seated user and also actively distributes stress around localized areas, such that the seated user feels comfortably retained in the seat 22, and does not feel as if they will slide down the angled/reclined back and forward off the seat during recline, as described below.

The illustrated control mechanism 24 also has several advantages and inventive aspects. The control mechanism 24 includes a "booster" mechanism 25 (FIG. 19) that can be engaged (with low effort) to provide an even greater back support upon recline, if the seated user desires the additional support upon recline. Advantageously, the control mechanism 24 has a thin profile and is very cost-effective to manufacture and assemble, such that it can be well integrated into chair designs having a thin, side profile. The combination of the comfort surface on the back 22 and seat 23 (FIG. 1) with the control mechanism 24 provides a surprising and unexpected result in the form of a very comfortable and supportive "ride" in all positions of the chair, including upright and recline positions. The comfortable "ride" is at least partially due to the fact that, while the seat that lifts upon recline to provide a weight-activated back support force, with the seat 22 and back 23 surfaces dynamically changing shape to relieve pressure behind the seated user's knees. Also, the comfort surfaces of the seat 22 and back 23 also create a changing bucket (see FIGS. 2A and 2B) to support the pelvis as it "rolls" and changes shape during recline, which counteracts the gravitational forces causing the seated user's body to want to slide down the reclined/angled surface of the back 23 and slide forward off the seat 22. Also, the booster mechanism 25 on the control mechanism 24 is very easy to engage or disengage, (almost like a switch that flips on or off) making it more likely to be used. Also, this allows the booster mechanism 25 to be operated by automatic panel and/or remote devices, including electronic, mechanical, and other ways. Advantageously, all major components of the chair 20, including the control mechanism 24, are separable and recyclable, thus facilitating repair, and promoting components and processes that are friendly to the environment, while maintaining low cost, efficient assembly, relatively few complex parts, and other competitive advantages.

The seat 22 (FIGS. 3–4) includes a molded perimeter frame 30 made of nylon or the like. The illustrated frame 30 is semi-rigid, but is able to flex and twist a limited amount so that the frame 30 gives and moves with a seated user who is reaching and stretching for items while doing work tasks. The frame 30 includes a U-shaped rear with horizontal side sections 31 connected by a transverse rear section 32, and further includes a U-shaped front 33 that connects a front of the side sections 31. It is contemplated that the perimeter frame 30 can be a single-piece molding, or a multi-piece assembly. The illustrated frame 30 defines a continuous loop, but it is contemplated that the frame could also be U-shaped with an open front, for example. The U-shaped front 33 includes side sections 34 that connect to an end of the side sections 31 and extend downward and rearward, and further includes a transverse section 35 that connects the side sections 34. The U-shaped front 33 forms a "U" when viewed from a front, and angles downward and rearward, such that it leaves an upwardly open area in a front of the perimeter frame 30 at a location corresponding to the underside of a seated user's knees. This allows the perimeter frame 30 to avoid putting pressure on the bottom of a seated user's knees upon recline, even though the seat 22 is raised, as described below.

The side sections 31 include a series of notches 36 (six such notches are illustrated) at about 3 to 7 inches rearward of a front end of the side sections 31, or more preferably 4 to 6 inches. The notches 36 create a flex point, which causes a front section 37 of the side sections 31 to flex downwardly when pressure is placed on the front end of the side sections 31. For example, front section 37 will flex when the front of the seat 22 is lifted against the knees of a seated user and the user is lifted, which occurs during recline of back 23.

A pair of tracks 38 are attached to the bottoms of the side sections 31 rearward of the notches 36. The pair of tracks 38 are adapted to slidably engage a seat support structure for providing a depth-adjustable feature on the chair 20. Nonetheless, it is noted that the present inventive concepts can be used on chairs not having a depth-adjustment feature.

Figure 3:
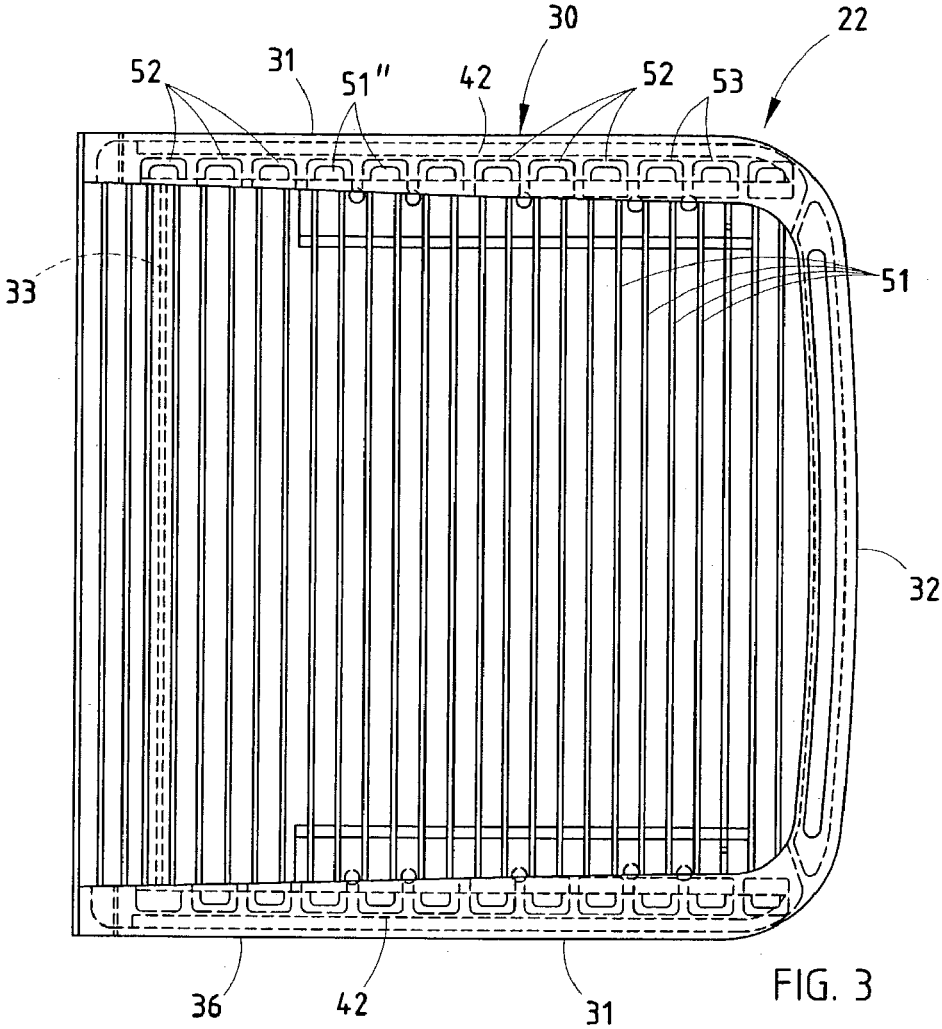
FIGS. 3–4 are plan and side views of the seat of FIG. 1.
Figure 4:
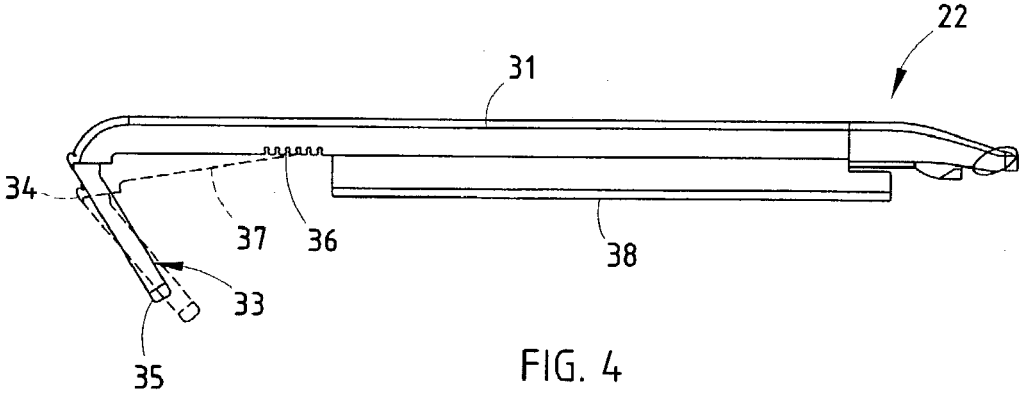
Figure 5:
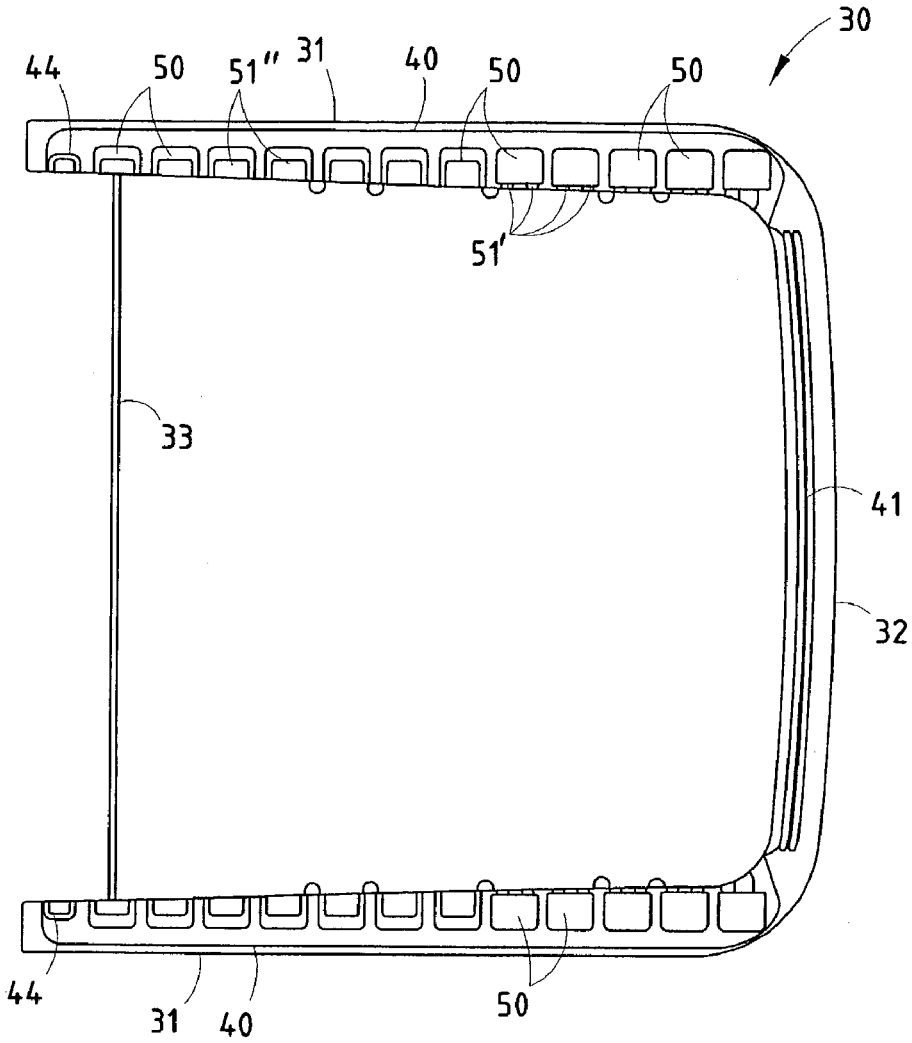
FIGS. 5–6 are plan and side views of the seat frame of FIG. 3.
Figure 6:
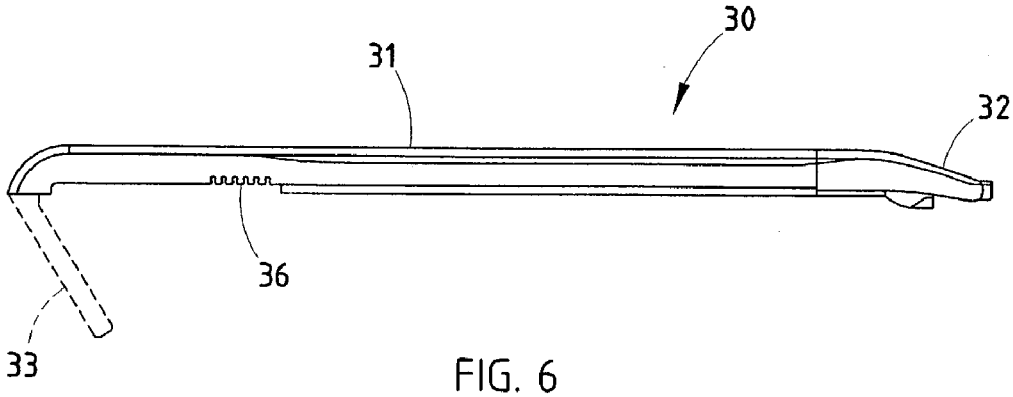
Figure 12:
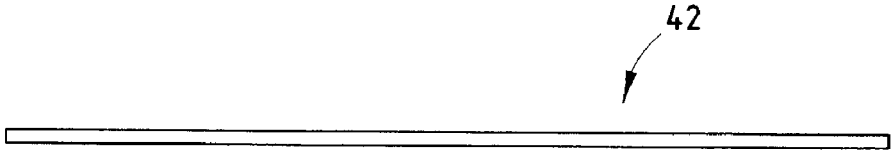

The side sections 31 of perimeter frame 30 (FIG. 5) each include longitudinally-extending recesses 40, respectively, in their top surfaces for receiving steel rods 42 (FIGS. 3 and 12). The side rods 42 resiliently support and stiffen the side sections 31, particularly in the area of notches 36. As illustrated (in FIGS. 3–4), the recesses 40 are primarily located rearward of the notches 36, but also include a front portion that extends forward past the notches 36 to provide added resilient support for side sections 31 at the notches 36. It is noted that the rods 42 can be different shapes or sizes, or multiple rods can be used. Also, different materials can be used in the rods 42, if desired, such as plastic or composite materials. However, the illustrated rods 42 are linear and made of a "hard-drawn spring steel" for optimal strength, low weight, long life, and competitive cost. Further, they are mechanically attached into position in their front and rear. It is contemplated that the rods 42 could also be insert-molded, snapped in, or otherwise secured in place.

The comfort surface of the seat 22 (FIG. 3) (and of the back) are formed by individual support members 45 with parallel long sections 51 and U-shaped ends 52 that slidably engage pockets 50 in the side sections 31. There are thirteen pockets 50 illustrated, but it is contemplated that more or less could be included depending on the chair design and functional requirements of the design. Further, the multiple pockets 50 could be replaced with continuous long channels formed longitudinally along the side sections 31, if desired. Each pocket 50 includes inwardly facing pairs of apertures 51' (FIG. 5) with an "up" protrusion 51" formed between the apertures 51'. The ends 52 of the front eight support members 45 are positioned in and directly slidably engage the front eight pockets 50 for limited inward and outward movement, while the ends 52 of the rear five support members 45 are carried by bearings 53 in the rear five pockets 50, as discussed below. The inboard surface of the pockets 50 (i.e. the "up" protrusion 51" formed between the apertures 51') forms a stop for limiting inward sliding movement of the ends 52 of the support member 45. By doing this, it limits the downward flexing of the long sections 51 with a "sling"-type action when a person sits on the comfort surface of the seat 22. Notably, this results in a "soft" stopping action when a seated user reaches a maximum flexure of the long sections 51. Part of the reason for the "soft" stopping action is the inward flexure of the side sections 31 as the ends 52 bottom out in the pockets 50, but also part of the "soft" stopping action is due to the independent action of the individual support members 45 and due to the paired arrangement of the long sections 51 on the support members 45. By this arrangement, a seated user remains comfortable and does not feel a sharp and sudden stop that is uncomfortable, even though the seat 22 is held to a maximum depression.

Figure 11:
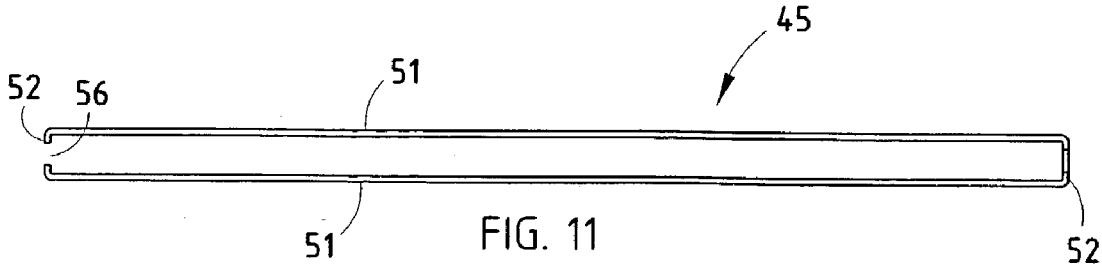
FIGS. 11–12 are plan views of two different wires used in the seat shown in FIG. 3.

Support members 45 (FIG. 7) are hard-drawn spring steel rods (FIG. 11) having a circular cross section. The rods (i.e. support members 45) are bent into a rectangular loop shape with relatively sharply bent corners, and include parallel/linear long sections 51 and flat/short end sections 52. The illustrated end sections 52 have relatively sharply bent corners, such that they form relatively square U-shaped configurations. Also, one of the illustrated end sections 52 has opposing ends of the wire that abut, but that are unattached. It is contemplated that the abutting ends in the one end section 52 could be welded together if needed, but this has not been found necessary in the present chair 20, particularly where bearings 53 are used, as discussed below. It is also contemplated that individual linear rods could be used instead of the support member 45 being a rectangular loop shape with parallel long sections 51, if desired. In such event, the ends 52 could be hook-shaped or L-shaped so that they engage the "up" protrusion in the pockets 50 for limited inwardly movement when a person sits on the seat 22. However, the interconnection of adjacent pairs of long sections 51 by end sections 52 can provide an additional stability and "coordinated" cooperative movement in the pairs that is believed to have beneficial effects. In particular, the rear five support members 45 with bearings 53 undergo considerable movement and flexure as a seated user reclines and/or moves around in the chair 20, such that bearings 53 with coupled wire sections 51 have been found to be desirable with those five support members 45.

Figure 8:
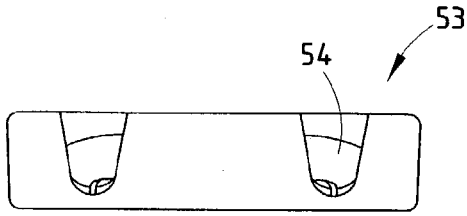
FIGS. 8–10 are side, top, and end views of a bearing shoe used to slidably support an end of one of the wires shown in FIG. 7.
Figure 9:
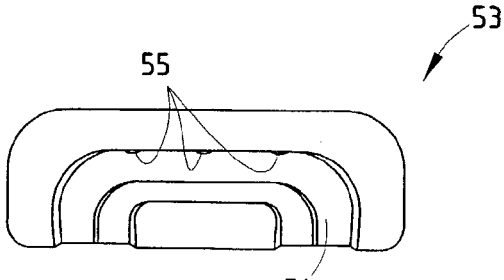
Figure 10:
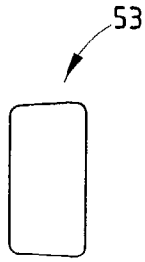

As noted above, the rearmost five support members 45 (FIG. 7) include bearing shoes 53 (also called "bearings" herein) (FIGS. 8–10) that are attached to the end sections 52. The bearing shoes 53 are made of acetal polymer and are shaped to operably fit into the pockets 50 for oscillating (inward and outward) sliding movement in a transverse direction as a seated user moves around in the chair 20 and as the long sections 51 of the support member 45 flex. The bearing shoes 53 include a U-shaped channel 54 shaped to mateably receive the U-shaped end sections 52. The bearing shoes 53 can include a friction tab at locations 55 for snap-attachment to the U-shaped ends 52, if desired, though a friction tab is not required per se when a top cap is provided that captures the bearing shoes 53 in the pockets 50. Notably, the bearing shoes 53 retain together the end sections 52 having the wire ends that touch each other even where the abutting ends of the wire are not attached directly together by welding.

Figure 7:
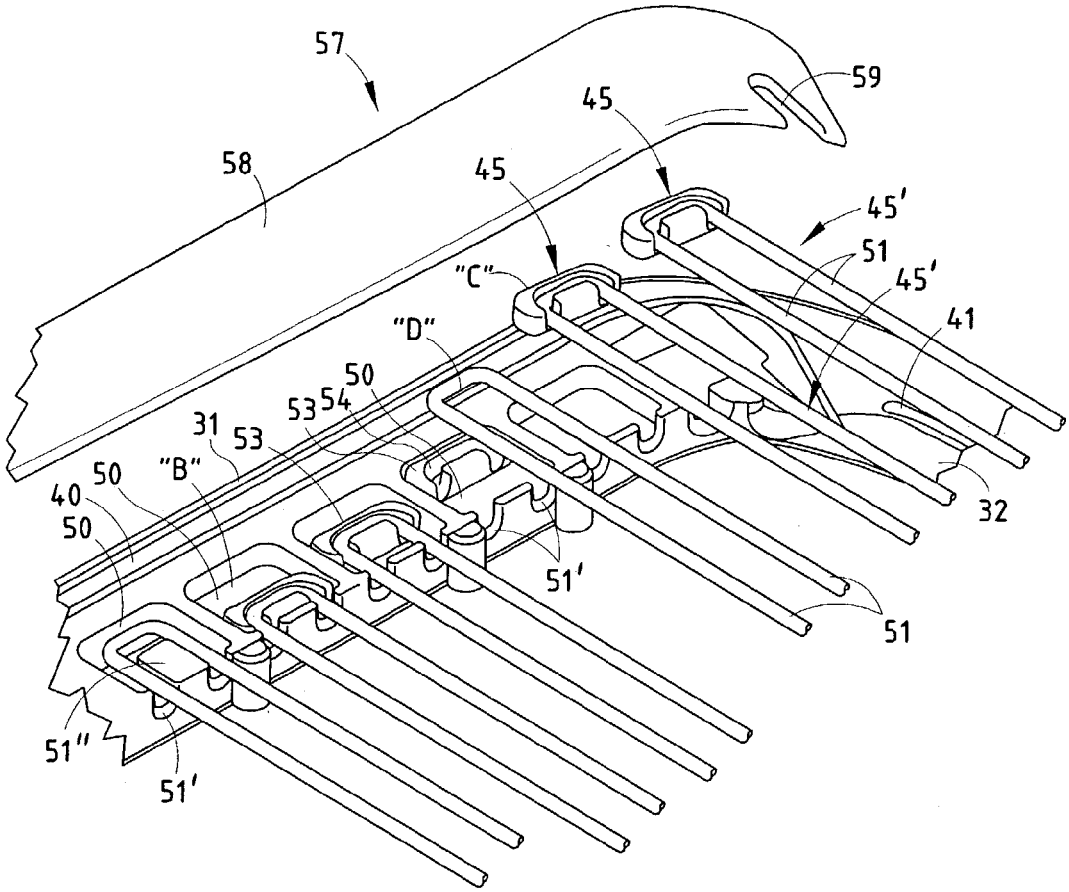
FIG. 7 is a partially exploded perspective view of a corner section of the seat in FIG. 3.
Figure 13:
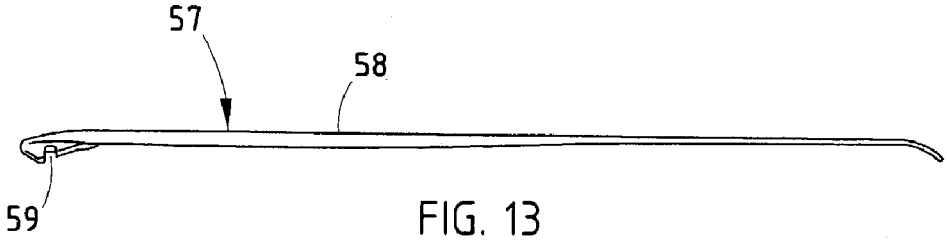
FIGS. 13–14 are side and plan views of a cover for side sections of the seat frame shown in FIGS. 5–6.
Figure 14:
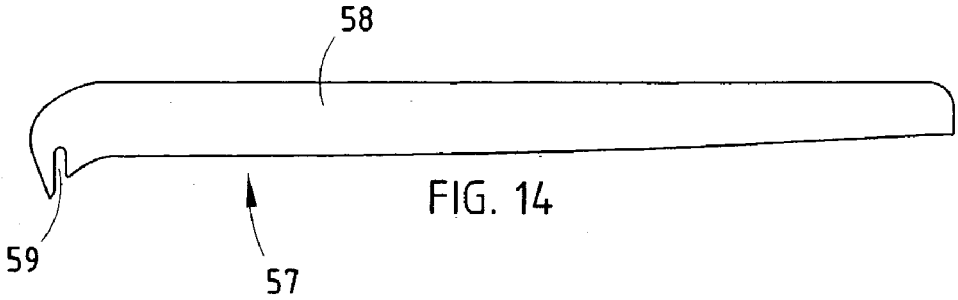

Right and left top caps 57 (FIGS. 13–14) are screw-attached, heat-staked, or otherwise attached to the side sections 31. The top caps 57 (FIG. 7) include a body 58 shaped to cover the pockets 50 and operably hold the bearing shoes 53 in place. A rear of the body 58 extends laterally and potentially includes a slot 59 to better cover a rearmost one of the pockets 50 while still allowing the rearmost wire section 51 to freely flex (FIG. 7). It is contemplated that the side sections 31 and top caps 57 will both be made of nylon, and the bearing shoes 53 made of acetal, because these materials have a very low coefficient of friction when engaged with each other. Further, the apertures 51' (FIG. 7) are oversized to be larger than a diameter of the long sections 51 of the rod support members 45, such that there is no drag during flexure of the support members 45 and concurrent movement of the bearing shoes 53 in the pockets 50.

The illustrated seat 22 (FIG. 1) is covered with a fabric 60, and potentially includes a top thin foam or non-woven PET fiber cushion under the fabric 60 on both the seat 22 and the back 23. However, it is contemplated that the seat 22 and/or back 23 may not require a foam cushion because, based on testing, the present seat 22 is so comfortable that a cushion is not necessary. Further, the space between the wire sections 51 allows the construction to breathe, so that a seated user does not become sweaty while resting on the present chair 20, which can also be a competitive advantage. A thin topper cushion or webbing could also be used under the fabric for aesthetics, if desired.

Figure 2:
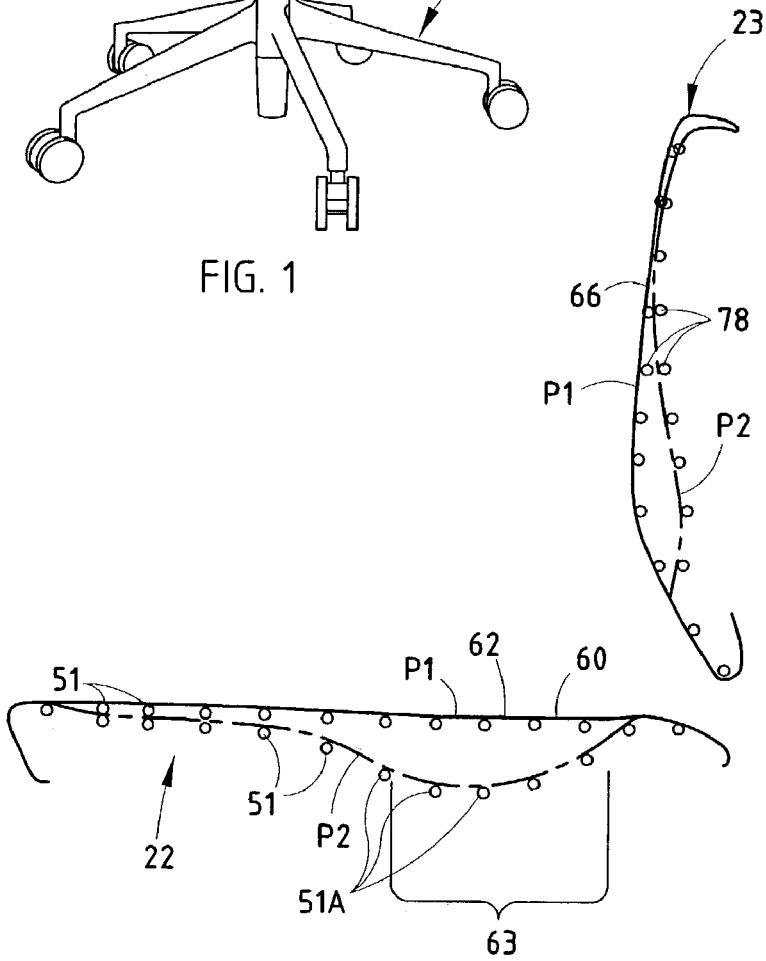
FIG. 2 is a schematic cross-sectional view showing the position of the transverse wires in the seat and back of FIG. 1, the wire support members being shown in solid lines without a seated user, the wire support members being shown in phantom lines with a seated user in an upright position.

The present arrangement of seat 22 offers several advantages. Assembly is easy, and it is difficult to incorrectly assemble the seat. By the present arrangement, each different pair of wire sections can be flexed different amounts, and further, each long section 51 in a given support member can be flexed more or less (and can be flexed in a different direction) than the other long section 51 in the pair. The pockets 50 engage the bearing shoes 53 and limit their movement, such that they in turn limit flexure of the wire long sections 51 to a maximum amount so that the support surface cannot flex "too far". Based on testing, the maximum limit of flexure provided by the pockets 54 is a soft limit, such that a seated user does not feel an abrupt stop or "bump" as the maximum flexure is achieved. It is noted that the present wire long sections 51/52 are all the same diameter and shape, but they could be different diameters, stiffnesses, or shapes. The individual wire long sections 51 travel to support a seated user's body along discrete and independent lines of support, with the wire long sections 51 moving in and out to meet the body and support the user. Specifically, as a seated user reclines, the wires move and flex to create a shifting new "support pocket" for the seated user. FIG. 2 shows the comfort surface 60 of the seat 22 as being relatively flat (i.e. position P1, see solid lines) when there is no seated user resting on the seat 22. (I.e. The wire long sections 51 of the support members 45 of the seat 22 are located in a generally horizontal common plane.) When a seated user sits in the chair 20 in an upright position, the comfort surface 60 flexes to a new shape (i.e. position P2, see phantom lines), which includes an "upright position" support pocket 63 formed by (and which receives and supports) the protruding bone structure, muscle, and tissue of a seated user's hips. As the seated user reclines the back 23 toward a fully reclined position (FIG. 2A), the comfort surface 60 flexes to a new shape (i.e. position P3, see dashed lines), which includes a newly formed "recline position" support pocket 65 formed by (and which receives and supports) the protruding portion, muscle, and tissue of a seated user's hips. Notably, the support pocket 65 formed in the seat 22 while in the recline position (FIG. 2B) is located rearward of the support pocket 63 formed in the seat 22 when in the recline position (see FIG. 2B, where a shape of the seat in the upright and reclined positions is overlaid to better show the shape change). This is caused by a rolling motion of the hips during recline. The long sections 51 of rod support members 45 are independent and provide a localized freedom and dynamic of movement able to comfortably accommodate the rolling activity of the hips of a seated user in a novel and unobvious way not previously seen in task chairs.

Figure 2A:
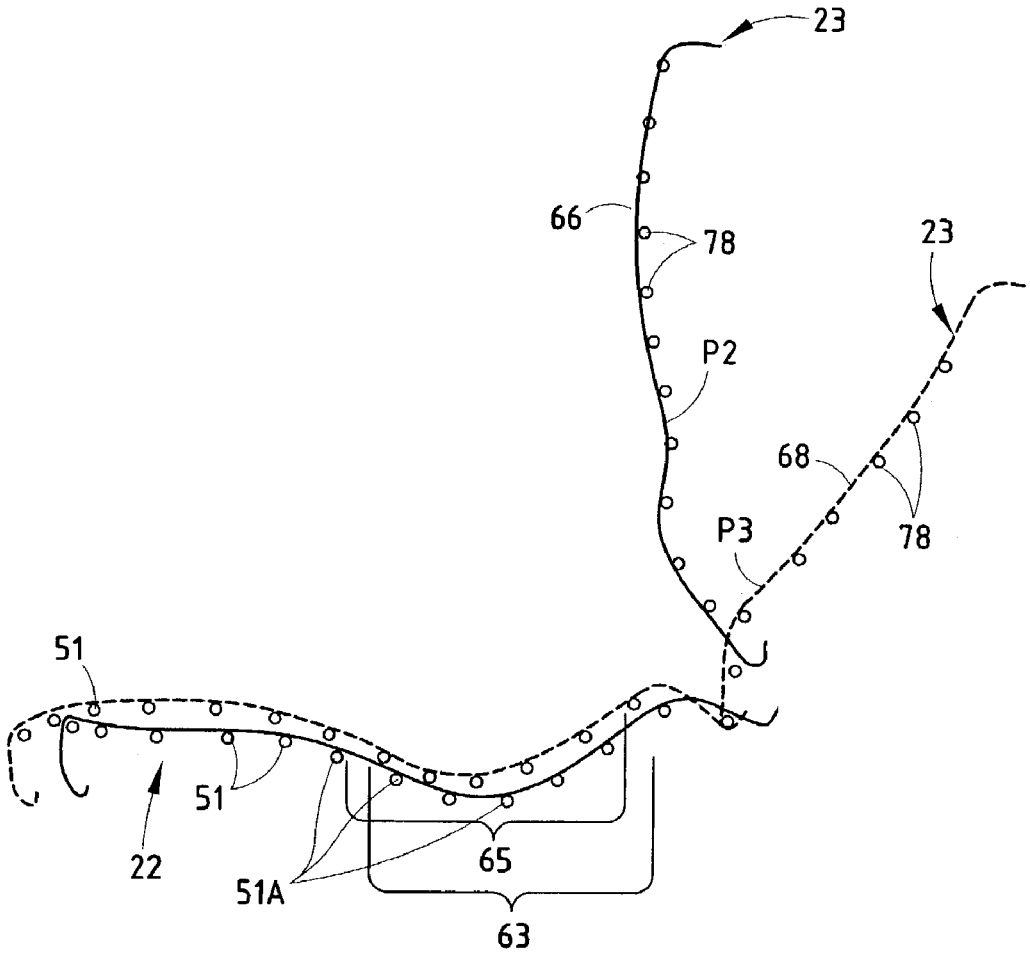
FIG. 2A is a view similar to FIG. 2, but showing the chair with seated user in the upright position in phantom lines and in a reclined position in dashed lines.

The back 23 (FIG. 2) also undergoes a shape change, as shown by the comfort surface 66 in the unstressed position P1 (unstressed, no seated user), the flexed comfort surface 66 in the upright stressed position P2 ("upright position" with seated user), and the flexed reclined comfort surface 66 in the reclined stressed position P3 ("recline position" with seated user) (FIG. 2A).

The pairs of long wire sections 51 act in a coordinated distributed dynamic fashion (primarily in a vertical direction) that provides an optimal comfort surface. This is a result of the constrained/limited movement of the bearing shoes 53 on adjacent pairs of the long sections 51 of the rod support members 45 and also is a result of the fabric 60 as it stretches across and covers the long sections 51. Nonetheless, it is noted that an extremely comfortable support can be achieved even without the fabric 60, because the long sections 51 flex in a manner that does not pinch or bind the seated user as the shape of the support pocket for their body changes.

It is noted that the long sections 51 in the seat 22 flex and move to provide support primarily vertically, but that some of the long sections 51 may have a horizontal or angled component of movement and/or may provide a horizontal or angled component of force to a seated user. In particular, the long sections 51 located at a front of the "recline" support pocket 65 (see wires 51A) tend to engage any depression in the flesh of a seated user at a front of the seated user's protruding hip area (i.e. behind the seated user's thighs and in front of the seated user's "main" hip area) which tends to securely hold the seated user in the seat 22. This occurs regardless of the location of the depression in the flesh of a particular seated user, due to the plurality of independently flexible long sections 51 in the seat 22. This added holding power appears to be important in preventing seated users from feeling like they will slide down an angled back (such as during recline) and forward and off the seat. The present inventors believe that this benefit, though subtle, is a very important and significant advantage of the chair 20. Notably, even with a fabric cover, there may be a horizontal component of force provided by the long sections 51, limited only by the movement of the long section 51 under the fabric, the stretchability of the fabric, the movement of bearing shoes 53, and the forces generated by the rolling action of the seated user's hips.

Figure 2B:
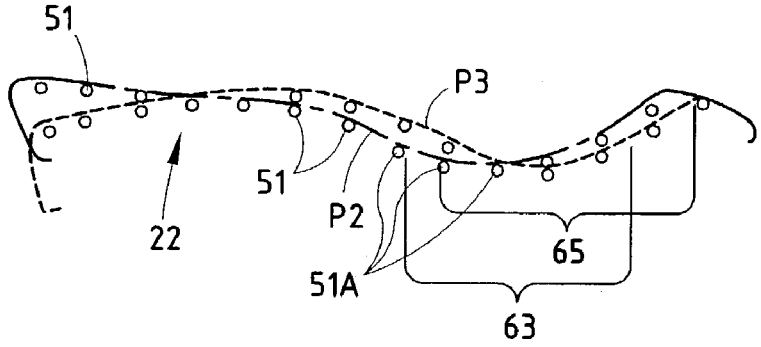
FIG. 2B is a schematic view similar to FIG. 2A, but with the change in shape of the seat being overlaid to eliminate confusion caused by a translation/rotational (up and forward) movement of the seat during recline.

The operation of the seat 22 is illustrated in FIGS. 2–2B. FIG. 2 shows flexure of a center of the long sections 51 of the support member 45 between the unstressed state (i.e. no seated user, see solid lines P1), and a stressed state (i.e. with a seated user, see phantom lines P2) (both in an upright position of the chair 20). FIG. 2A shows the chair 20 with a seated user in the chair 20 in the upright position (solid lines) and a reclined position (dashed lines). FIG. 2B is a schematic view intended to show the change of shape in the comfort surface of the seat 22 between the upright position (see solid lines P2) and the reclined position (see dashed lines P3). In FIG. 2B, the seat 22 is compared as if it did not move forward upon recline, to better show the change in shape of the "pocket" in the seat 22 where the seated user's hips are located. Nonetheless, it is noted that the seat 22 does move forward during recline in the present chair 20.

The FIG. 7 shows some of the support members 45 with long sections 51 unstressed (i.e. that are located in an outboard position in their respective pocket 50), and shows some of the rod support members 45 with wires 51 flexed (i.e. see the bearing shoes 53 at location "B" that are located in an inboard position in their respective pocket 50). FIG. 7 also shows some of the bearing shoes 53 exploded out of the pockets 50 and pre-attached to ends of the rod support members 45 (see location "C"). The bearing shoes 53 are ready to drop downward into the pockets 50, which illustrates a first assembly technique. FIG. 7 also shows one of the bearing shoes 53 positioned in a pocket 50, with the associated rod support member 45 being positioned above it and ready to be moved downward into engagement with the recess in the bearing shoe 53 (see location "D"), which illustrates a second assembly method.

Figure 15:
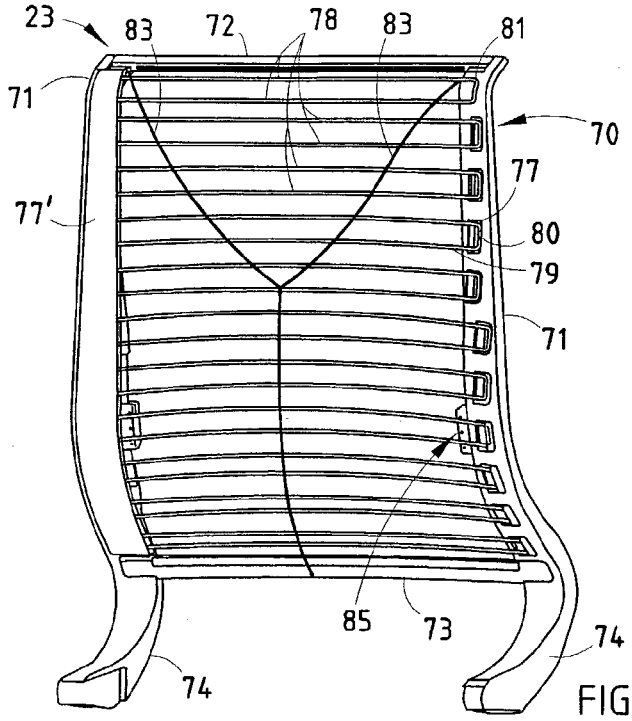
FIGS. 15–16 are front and rear perspective views of the back shown in FIG. 1.
Figure 16:
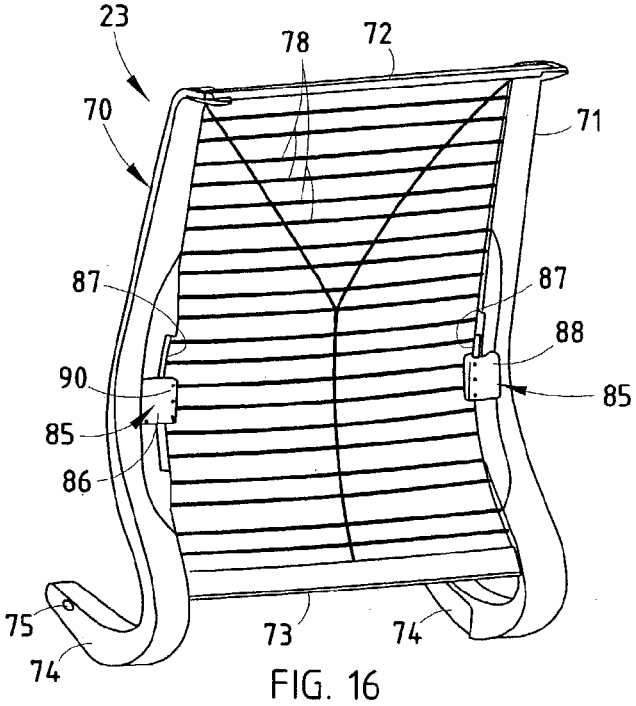

The back 23 (FIGS. 15–17) is similar to the seat 22. Thus, a detailed description of the back 23 is not required for an understanding by a person skilled in this art, since it would be quite redundant. Nonetheless, a description follows that is sufficient for an understanding of the present invention as used on backs, in view of the discussion regarding seat 22 above.

Briefly, the back 23 (FIGS. 15–17) includes a back perimeter frame 70 composed of L-shaped side frame members 71. Top and bottom transverse frame members 72 and 73 are attached to the side frame members 71 to form a semi-rigid perimeter. The frame 70 can be one-piece or multi-piece. An additional transverse frame member 72A (FIG. 1) can also be added, if needed for strength and stability. The side frame members 71 include forwardly-extended lower sections 74 extending below the bottom transverse frame member 73. The lower sections 74 are pivoted to a seat support 122 of the control mechanism 24, at location 75, and are pivoted to a flexible arm part of the control mechanism 24 at location 141, as described below.

Similar to the seat 22, the back side frame members 71 include pockets 77 (see seat frame pockets 50), covers 77' covering the pockets 77 (only a left cover 77' is shown), and support members 78 (similar to seat support members 45) are provided as hard-drawn spring steel wires with long sections 79 (similar to seat long sections 51). Several of the support members 78 have ends that are operably supported by bearing shoes 80 (similar to bearing shoes 53). Notably, the illustrated back support members 78 come in two different lengths because the back 23 has a smaller top width and a larger bottom width. (See FIG. 15 and notice the change in position of the pockets 77 at a middle area on the side frame members 71.) The top half of the side frame members 71 includes a plurality of U-shaped pockets 81 for receiving a wire 79 without a bearing shoe 80. A top edge of the top frame member 72 is U-shaped and bent rearwardly for increased neck support and comfort to a seated user. Wire strips 83 extend from the top corners of the back frame 70 to a center point located between a seated user's shoulders, and then extend downward into connection to a center of the bottom transverse member 73. When tensioned, the wire strips 83 cause the comfort surface of the back (i.e. support members 78) to take on an initial concave shape (sometimes referred to as a "PRINGLES potato chip shape"). This concave shape increases the comfort by providing a more friendly "pocket" in the back 23 for a seated user to nest into when they initially sit in the chair 20.

Figure 17:
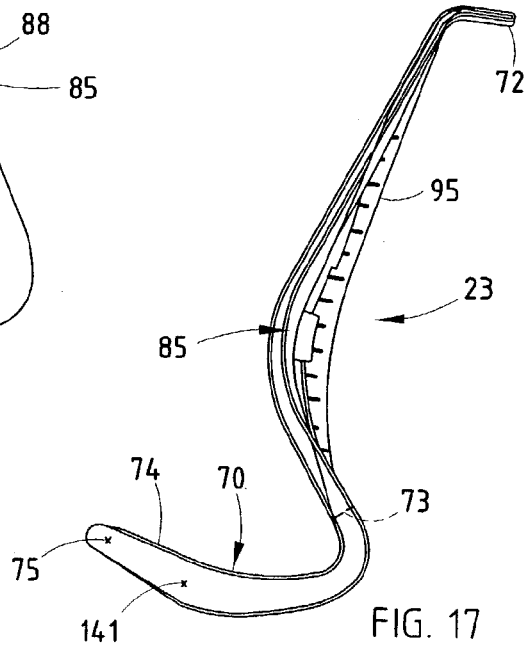
FIG. 17 is a side view of the back shown in FIG. 15.

An adjustable lumbar support 85 (FIGS. 15–17) is provided on the back that includes a pair of bodies 86 slidably connected to an inboard rib 87 on each of the side frame members 71. The bodies 86 may (or may not) be connected by a cross member. The bodies 86 are located behind the wires 79 adjacent the side frame members 71 and the wires 79. Handles 88 extend from a rear of the bodies 86 for grasping by a seated user reaching behind the back 23. The bodies 86 each include a flange 90 that engages a section of the wires 79 as the wire extends in an inboard direction out of the pockets 77. By adjusting the bodies 86 vertically, the flanges 90 move behind different wires 79, causing a different level of support (since an effective length of the supported wires are shortened). Alternatively, the flange 90 can physically engage and bend the wires 79 when vertically adjusted, if desired. FIG. 17 also shows a maximum of rearward flexure of the wires 79, as shown by the line 95.

Figure 18:
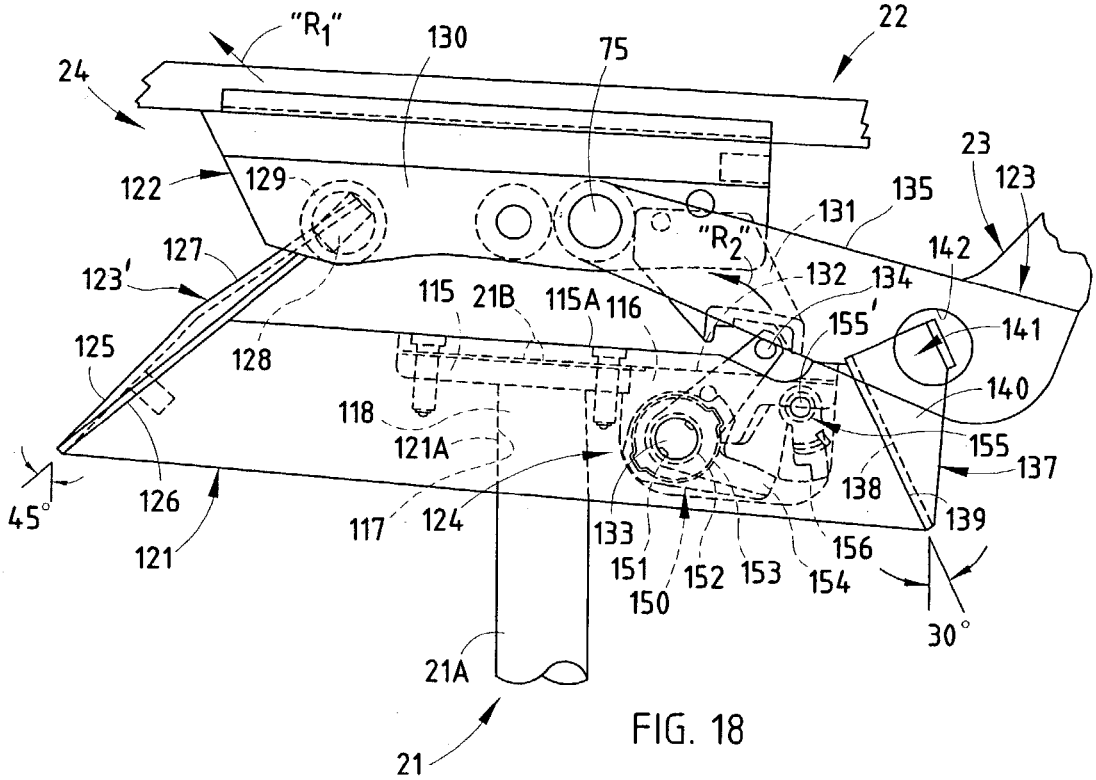
FIG. 18 is a side view of the underseat control shown in FIG. 1.

The present control mechanism 24 (FIG. 18) includes a stationary base support 121 forming a part of the base 21. The seat 22 includes a seat support 122, and the back 23 includes a back support 123. The seat and back supports 122 and 123 are operably attached to the base support 121 as follows. The base support 121 includes an upwardly-facing recess 115 covered in part by plate 115A. The recess 115 forms a first pocket 116 for receiving the booster mechanism 25. The recess 115 also forms a tapered second pocket 117 that extends vertically down through the base support 121 for receiving the tapered top section 118 of a height adjustable post 21A. The illustrated base 21 (FIG. 1) includes a hub at a bottom of the post 21A, radially extending side sections extending from the hub, and castors at ends of the side sections for supporting the chair 20. A lockable pneumatic spring is incorporated into the post 21A for providing counterbalancing support during height adjustment. The post 21A (FIG. 18) includes a vertically-actuated release button 21B positioned at a top of the base support 121. In this location, the release button 21B can be actuated by a handle (not shown) operably attached to a top or side of the base support 121, with the handle being pivotally or rotationally movable to selectively cause the handle to depressingly engage the release button 21B and release the pneumatic spring for height adjustment of the chair. Though one particular base is illustrated, it is specifically contemplated that a variety of different chair bases can be used in combination with the present chair 20.

The seat support 122 (FIG. 36) is operably supported on the base support 121 by a front leaf spring 123' and by a pivot mechanism 124 spaced rearward of the leaf spring 123'. Specifically, the front leaf spring 123' includes a center portion 125 supported on and attached to an angled front surface 126 (oriented at about 45°) of the base support 121 by threaded fasteners, and includes arms 127 having barrel-shaped or spherically-shaped bearings 128 on each end that slidably and rotatably fit into cylindrical recesses 129 in side members 130 of the seat support 122. The bearings 128 are barrel-shaped instead of cylindrically-shaped, so that the bearings 128 permit some non-axial rotation and axial sliding as the arms 127 flex, thus helping to reduce high stress areas and accommodating a wider range of movement during recline. However, it is contemplated that different bearing arrangements are possible that will still meet the needs of the present inventive concepts.

Figure 36:
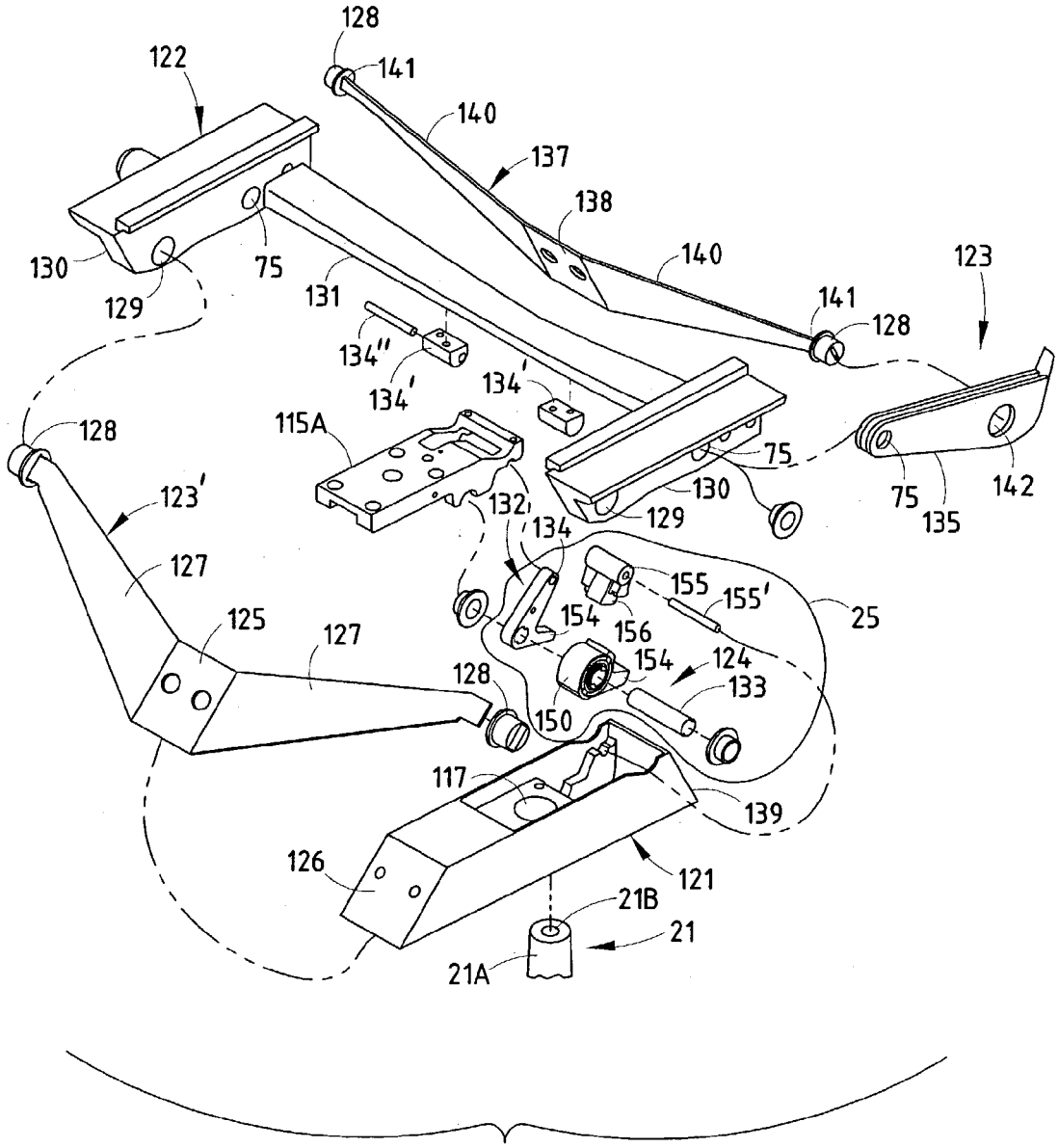
FIG. 36 is an exploded perspective view of FIG. 33.

The side members 130 are rigidly interconnected by a cross beam 131 (FIG. 36). The pivot mechanism 124 includes one (or more) pivoted arms 132 that are pivotally supported at one end on the base support 121 by a pivot pin 133, and pivotally connected to a center of the cross beam 131 at its other end 134 by pivot pin 134" and pin bearings 134'. Pin bearings 134' are attached to cross piece 131, such as by screws. The pivot pin 133 is keyed to the arm 132, so that the pivot pin 133 rotates upon movement of the seat (i.e. upon recline). Thus, the direction and orientation of movement of the seat support 122 (and seat 22) is directed by the linear movement of the bearing ends 128 as the arms 127 of leaf spring 123' flex (which is at a 45° angle forward and upward, see R1 in FIG. 38), and by the arcuate movement of the pivoted arm 132 on the pivot mechanism 124 as the pivot arm 132 rotates (which starts at a 45° angle and ends up near a 10° angle as the back 23 approaches a full recline position, see R2 in FIG. 38). The distance of travel of the front of the seat 22 is preferably anywhere from about ½ to 2 inches, or more preferably is about 1 inch upward and 1 inch forward, but it can be made to be more or less, if desired. Also, the vertical component of the distance of travel of the rear of the seat is anywhere from about ½ to 1 inch, but it also can be made to be more or less as desired. Notably, the vertical component of seat movement is the component that most directly affects the potential energy stored during recline in the chair 20. Restated, the greater the vertical component of the seat (i.e. the amount of vertical lift) during recline, the more weight-activated support will be received by the seated user during recline.

Figure 38:
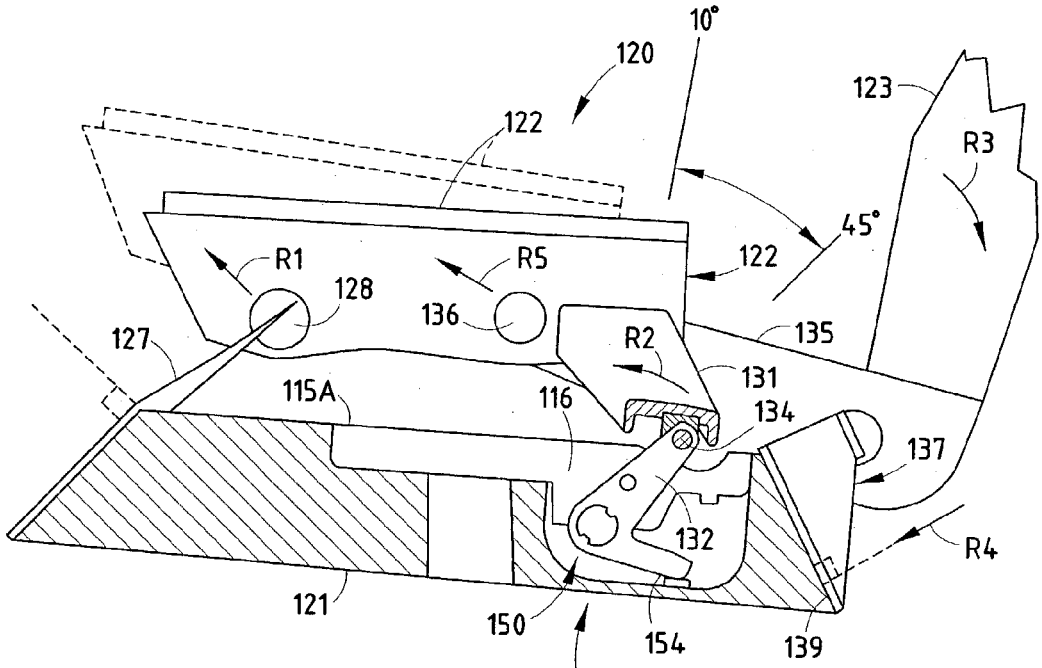
FIGS. 38–39 are cross sections taken along the line XXXIX in FIG. 33, and are side views of the control, seat and back, FIG. 38 being in an upright position and FIG. 39 being a recline position, FIGS. 38–39 being similar to FIG. 18, but being simplified to show operation of the pivot link during recline.
Figure 39:
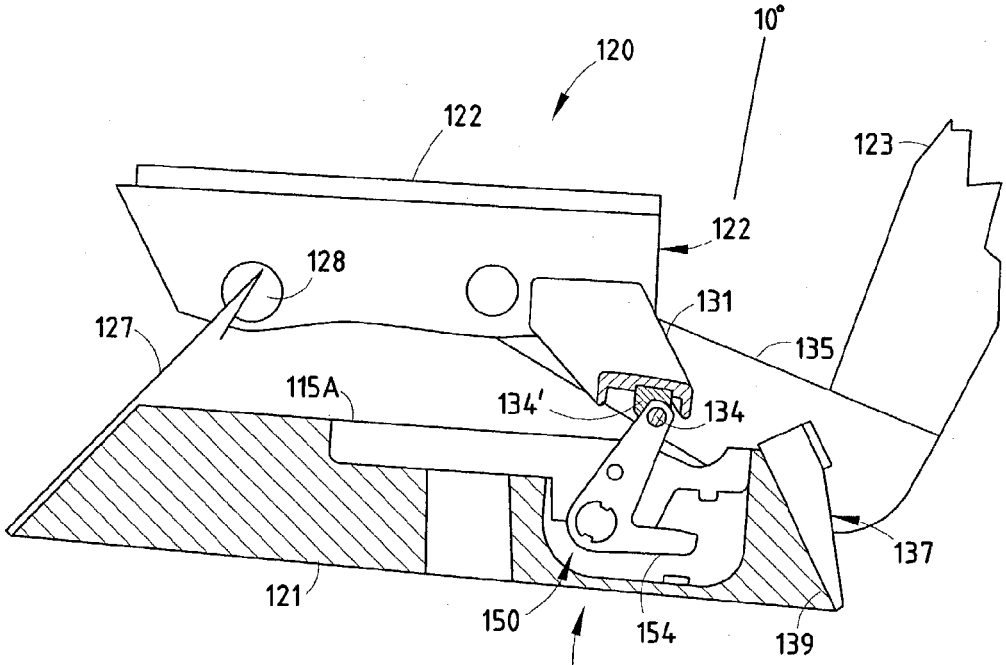

The back-supporting upright 123 (FIG. 36) includes side sections 135 pivoted to the side members 130 of the seat support 122 at pivot location 75, which is about halfway between the location of pivot 129 and the pivot 134. The illustrated pivot location 75 is about equal in height of the bearings 128 (see FIG. 19), although it could be located higher or lower, as desired, for a particular chair design. A rear leaf spring 137 (FIG. 36) includes a center portion 138 attached to a forwardly angled surface 139 on a rear of the base support 121, and includes arms 140 with barrel-shaped or spherically-shaped bearings 141 that pivotally and slidably engage a cylindrical recess 142 in the side sections 135 of the back upright 123. The rear surface 139 is oriented at about a 30° forward angle relative to vertical, which is an angle opposite to the rearward angle of the front surface 126. As a result, as the side sections 135 of the rear spring 137 are flexed during recline, the rear bearings 141 are forced to move forward and downward in a direction perpendicular to the rear angled surface 139 (see directions R3 and R4, FIG. 38). Thus, the pivot 75 drives the seat 22 forward along lines R1 and R2 upon recline, and in turn a reclining movement of the back 23 causes the seat support 122 to move forward and upward. As noted above, the movement of the seat support 122 is controlled in the front area by the flexure of the ends of the front spring 123, which moves the bearings 128 in a linear direction at a 45° angle (up and forward in direction "R1"), and is controlled in the rear area by the pivoting of the pivoted arm 132, which is arcuate (up and forward along path "R2"). The pivot arm 132 is at about a 45° angle when in the upright rest position (FIGS. 19 and 38), and is at about a 10° angle when in the full recline position (FIG. 39), and moves arcuately between the two extreme positions upon recline. The movement of the seat support 122 causes the pivot location 136 (FIG. 38) to move forwardly along a curvilinear path. As a result, the back upright 123 rotates primarily rearward and downward upon recline (see line R3), but also the lower side section 74 moves forward with a coordinated synchronous movement with the seat 22, as shown by arrows R1–R2 (for the seat 22) and R3–R5 (for the back 23) (FIG. 38).

Specifically, during recline, a rear of the seat support 122 initially starts out its movement by lifting as fast as a front of the seat support 122. Upon further recline, the rear of the seat support 122 raises at a continuously slower rate (as arm 132 approaches the 10° angle) while the front of the seat support 122 continues to raise at a same rate. The back 23 (i.e. back upright 123) moves angularly down and forward upon recline. Thus, the seat support 122 moves synchronously with the back upright 123, but with a complex motion. As will be understood by a person skilled in the art of chair design, a wide variety of motions are possible by changing the angles and lengths of different components.

Figure 37:
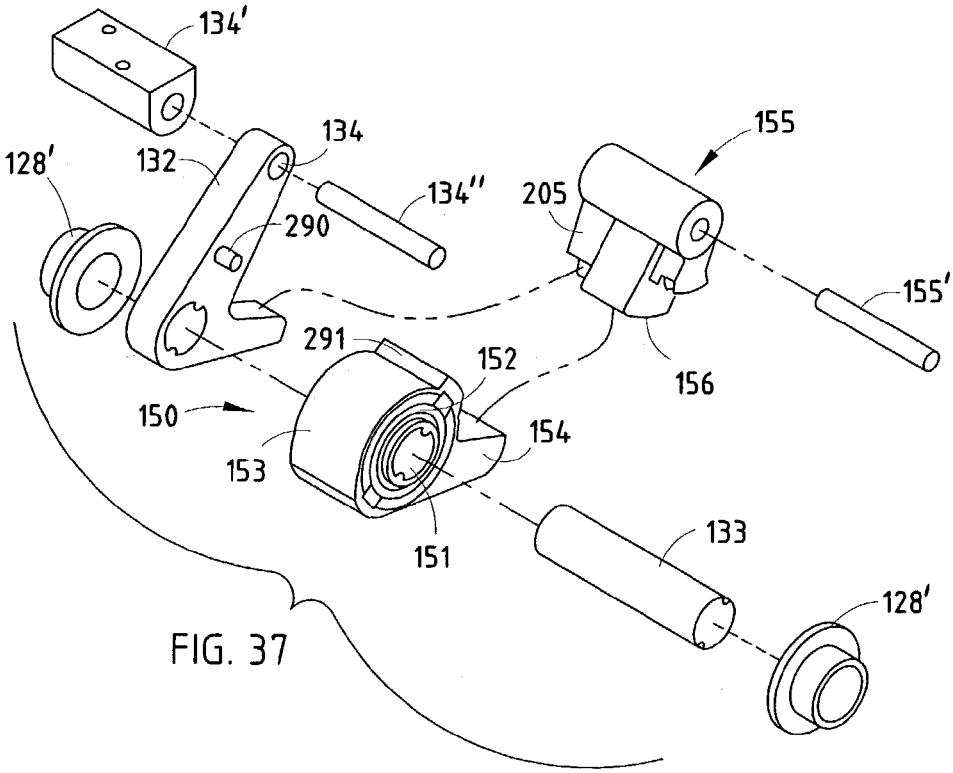
FIG. 37 is an enlargement of the energy boost mechanism shown in FIG. 36.

The booster mechanism 25 (FIG. 19) includes a torsion spring 150 mounted on the pivot pin 133 to seat support 121. The torsion spring 150 includes an inner ring 151 (FIG. 37) keyed to the pivot pin 133, a resilient rubber ring 152, and an outer ring 153 with an arm 154 extending radially outwardly. A stop member 155 is pivoted to the base support 121 by a pivot pin 155' (and is keyed to pivot pin 155') and includes a stop surface 156 that can be moved to selectively engage or disengage the arm 154. When the stop member 155 is moved to disengage the stop surface 156 from the arm 154 (FIG. 19), the torsion spring 150 freewheels, and does not add any bias to the control 120 upon recline. However, when the stop member 155 is moved to engage the stop surface 156 with the arm 154 (FIG. 20), the outer ring 153 is prevented from movement upon recline. This causes the torsion spring 150 to be stressed and tensioned upon recline, since the pivot pin 133 does rotate upon recline, such that the torsion spring 150 "boosts" the amount of energy stored upon recline, . . . thus adding to the amount of support received by a seated user upon recline. It is contemplated that the torsion spring 150 will be made to add about 15% to 20% of the biasing force upon recline, with the rest of the biasing force being supplied by the bending of the leaf springs 123 and 137 and by the energy stored by lifting the seat support and the seated user upon recline. However, the percentage of force can, of course, be changed by design to meet particular functional and aesthetic requirements of particular chair designs.

Figure 19:
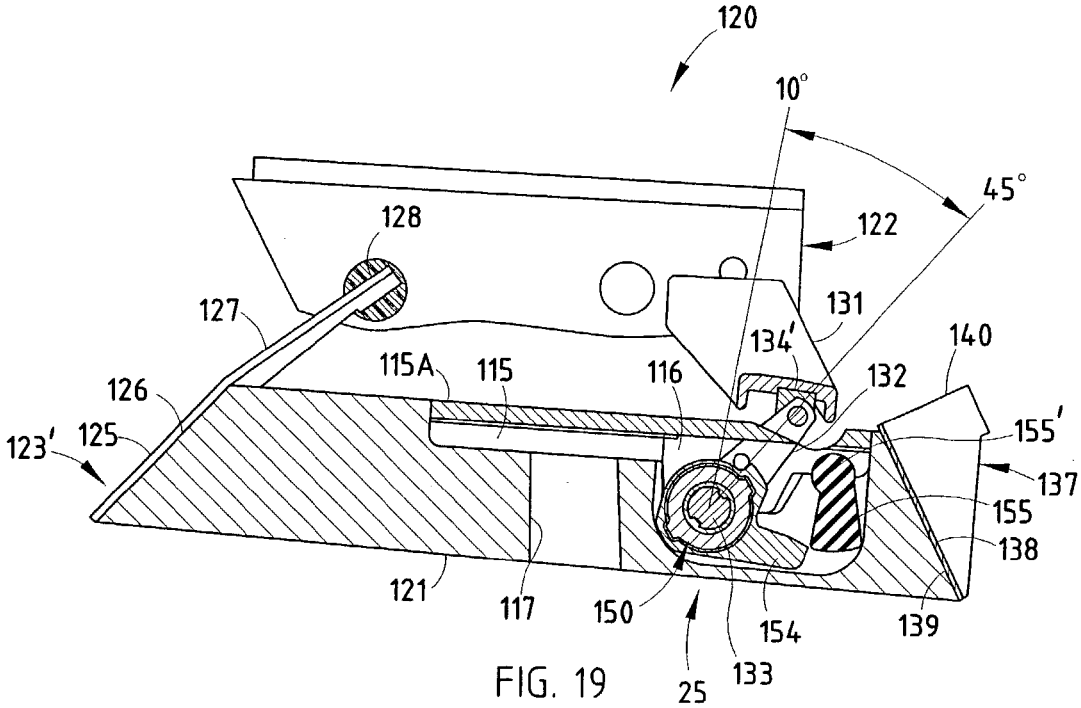
FIGS. 19–20 are cross-sectional views similar to FIG. 18, but showing cross-sectioned components, FIG. 19 being taken along line XIX in FIG. 33 and showing the booster mechanism disengaged, and FIG. 20 showing the booster mechanism engaged.
Figure 20:
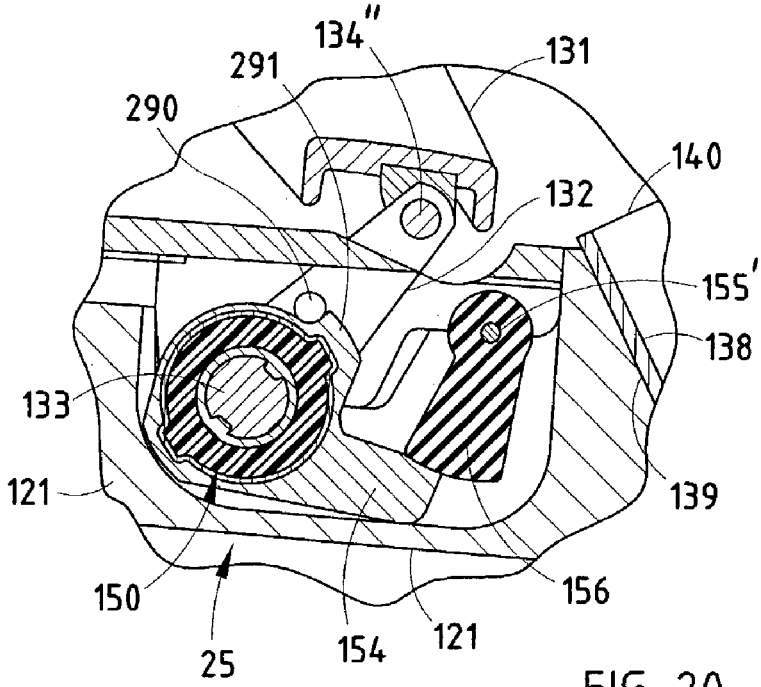

In operation, when the booster mechanism 25 is "off" (FIG. 19), the arm 154 moves freely as a seated user reclines in the chair. Thus, during recline as the seat rises and lifts the seated user, the flexible arms 127 and 140 of leaf springs 123' and 137 flex and store energy. This results in the seated user receiving a first level of back support upon recline. When additional support is needed (i.e. the equivalent of increased spring tension for back support in a traditional chair), the booster mechanism 25 is engaged by rotating stop 155 (FIG. 20). This prevents the arm 154 from moving, yet pivot pin 133 is forced to rotate by the arm 132. Therefore, during recline, the rubber ring 152 of the torsion spring 150 is stretched, causing additional support to the seated user upon recline. In other words, the support provided to the back 23 during recline is "boosted" by engagement of the booster mechanism 25.

Figure 25:
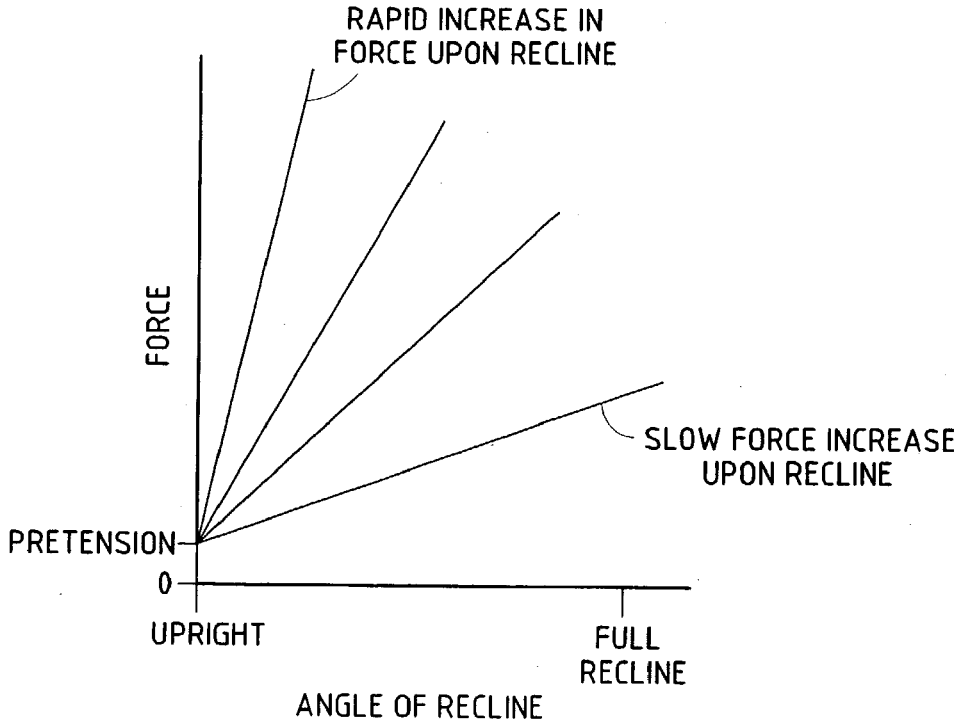
FIG. 25 is a graph showing different strength booster mechanisms on a chair where they provide selectively increasing amounts of energy as each successive one is engaged.

It is contemplated that several separate torsion springs 150 can be added to the axle of pivot 154', and that they can be sequentially engaged (such as by having their respective stops 155 engage at slightly different angles). This would result in increasing back support, as additional ones of the torsion springs were engaged. (See FIG. 25.) In another alternative, it is contemplated that a single long rubber ring 152 could be used and anchored to the pivot pin 133 at a single location, and that several different outer rings 153 and arms 154 (positioned side-by-side on a common axle) could be used. As additional arms were engaged, the torsional force of the torsion spring would increase at a faster rate during recline. It is also conceived that the stop 155 could have steps, much like the stop 205 (FIG. 21), such that the "booster" torsion spring 150 engages and becomes active at different angular points in time during recline. There are also several other arrangements and variations that a person of ordinary skill will understand and be able to make from the present disclosure. These additional concepts are intended to be covered by the present application.

A stop pin 290 (FIG. 37) is provided on the arm 132, and an abutment 291 is provided on the outer ring 153 of torsion spring 150. The engagement of the components 290 and 291, and also the engagement of the arm 132 with the base support 121 results in a positive location of the back 23 in the upright position. The rubber ring 152 can be pre-tensioned by engagement of the pin 290 and abutment 291. Thus, when the stop member 156 is engaged, this preload in rubber ring 152 must be overcome prior to initiation of recline of the back 23. This results in the elevated pre-tension (see FIG. 24) whenever the stop member 155 is engaged (see FIG. 20). In an alternative construction, a stop pin 290' is located on the arm 132 and positioned to abut a surface on the chair control base support 121 as a way of setting the upright position of the back 23.

A backstop 205 (FIG. 21) is formed on the stop member 155. The backstop 205 is keyed directly to the pivot pin 155' so that it moves with the pivot pin 155'. There is no torsion spring element on the illustrated backstop 205. The arm 132 includes a lever 202 with an abutment surface 203. A backstop 205 is pivoted to pivot pin 155' at a location adjacent to the booster stop member 155. The backstop 205 includes a first abutment surface 206 and a second abutment surface 207.

Figure 21:
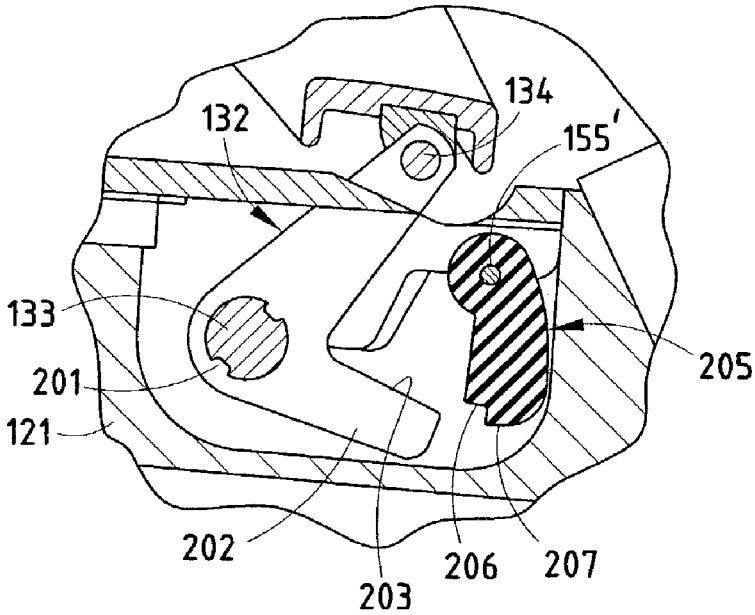
FIGS. 21–23 are cross-sectional views similar to FIG. 18, but showing cross-sectioned components, FIG. 21 being taken along line XXI in FIG. 33 and showing the backstop mechanism disengaged, and FIG. 22 showing the backstop mechanism engaged to a first level for partial back recline, and FIG. 23 showing the backstop mechanism engaged to a second level for no back recline.
Figure 22:
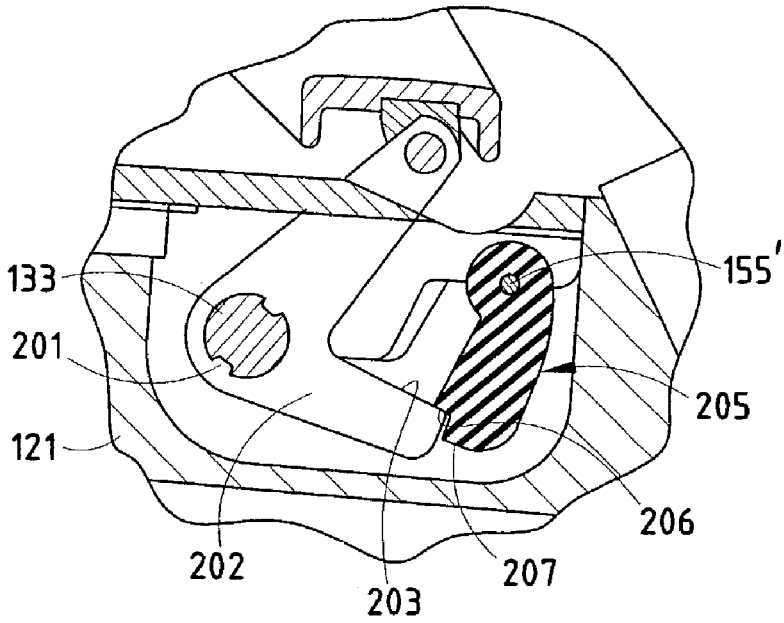
Figure 23:
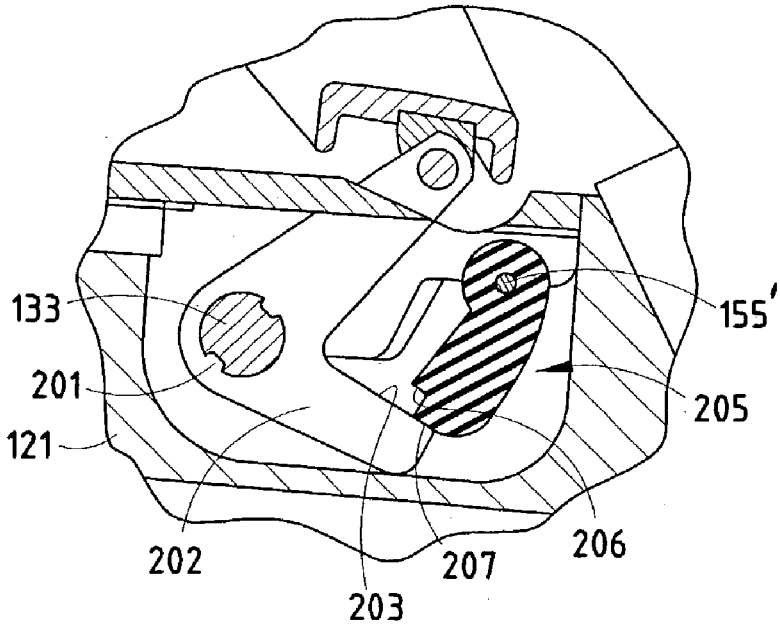

A manual control mechanism 220 (FIG. 26) includes a selector device 227 mounted to base support 121 under the seat-supporting structure 122. The selector device 227 is operably connected to pivot pin 155' as noted below for moving the booster stop 155 and backstop 205. The backstop 205 does not engage the abutment surface 203 of lever 202 when the manual control mechanism 220 for booster mechanism 25 and backstop 205 is in a "home" disengaged position (FIGS. 19 and 21). The stop member 155 of booster mechanism 25 engages and activates the torsion spring 150 when the selector device 227 is moved to a first adjusted position (FIG. 20). In the first position, the abutment surface 203 is not yet engaged (FIG. 20). However, when the control 220 is moved to a second adjusted position (FIG. 22), the backstop abutment surface 206 engages the abutment surface 203 of the lever 202, and the back 23 is limited to only ⅓ of its full angular recline. (The backstop 205 can of course have additional intermediate steps if desired.) When the selector device 227 is to a third adjusted position (FIG. 23), the backstop abutment surface 207 engages the abutment surface 203 of the lever 202, and the back 23 is limited to zero recline. The effect of these multiple positions of selector device 227 are illustrated by the lines labeled 211–214, respectively, on the graph of FIG. 24.

Figure 24:
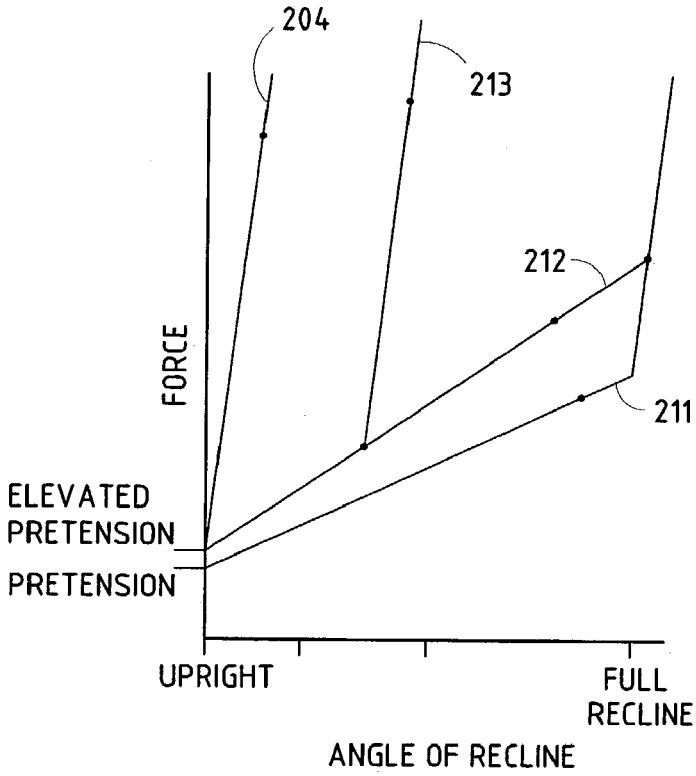
FIG. 24 is a graph showing different lines of back support force versus deflection, depending upon whether the booster is disengaged or engaged, and whether the backstop is engaged for partial recline or to prevent any recline.

The combination of the booster mechanism 25 and the backstop 205 results in a unique adjustable control mechanism, as illustrated in FIG. 24. Literally, the device combines two functions in a totally new way—that being a single device that selectively provides (on a single member) a backstop function (i.e. the backstop mechanism 202/205) and also a back tension adjustment function (i.e. the booster mechanism 150/155).

It is contemplated that the pivot pin 155' can be extended-to have an end located at an edge of the seat 22 under or integrated into the seat support 122. In such case, the end of the pivot pin 155' would include a handle for grasping and rotating the pivot pin 155'. However, the selector device 227 of the manual control mechanism 220 (FIGS. 26–27) can be positioned anywhere on the chair 20.

A manual control mechanism 220 (FIG. 26) includes a Bowden cable 251 having a sleeve 221 with a first end 221' attached to the base support 121, and an internal telescoping cable 222 (FIG. 27) movable within the sleeve 221. A wheel section 223 is keyed or otherwise attached to the pivot pin 155' of the back booster and backstop mechanism, and an end 224 of the cable 222 is attached tangentially to a perimeter of the wheel section 223. (Alternatively, if the diameter of the pivot pin 155' is sufficiently large, the cable end 224 can be connected tangentially directly to the pivot pin 155'.) Optionally, a spring 225 can be used to bias the wheel section 223 in direction 225', pulling the cable in the first direction 225. However, spring 225 is not required where the cable 222 is sufficient in strength to telescopingly push as well as pull. The cable sleeve 221 includes a second end attached to the seat support 122, such as on the end of a fixed rod support 226 extending from the seat support 122. A selector device 227 is attached near an end of the rod support 226 for operating the cable 222 to select different back supporting/stopping conditions.

Figure 28:
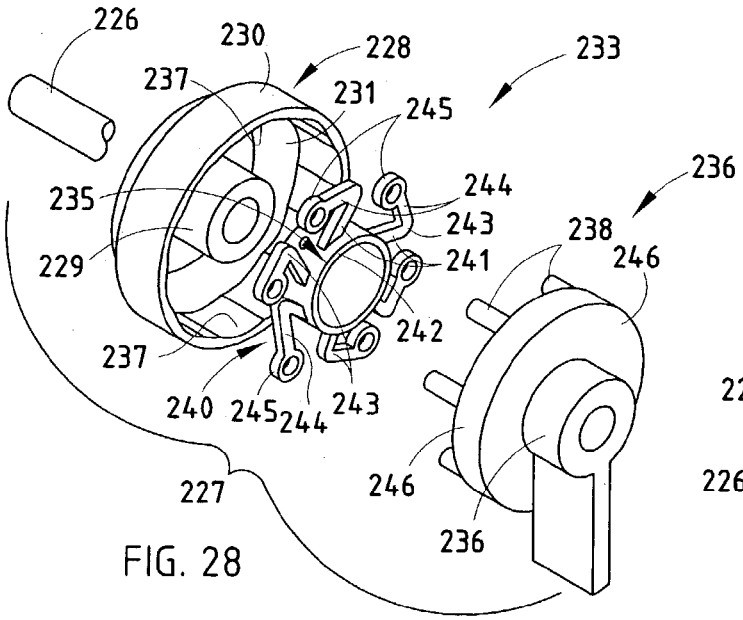
FIG. 28 is an exploded perspective view of the manual control of FIG. 26.

The selector device 227 (FIG. 28) operates very much like a gearshift found on a bicycle handle bar for shifting gears on the bicycle. The selector device 227 is also not unlike the lumbar force-adjusting device shown in U.S. Pat. No. 6,179,384 (minus the gears 56 and 56'). It is noted that a patent entitled "FORCE ADJUSTING DEVICE", issued Jan. 30, 2001, U.S. Pat. No. 6,179,384, discloses a clutch device of interest, and the entire contents of U.S. Pat. No. 6,179,384 are incorporated herein by reference in its entirety for the purpose of disclosing and teaching the basic details of a sprag clutch and its operation.

Figure 29:
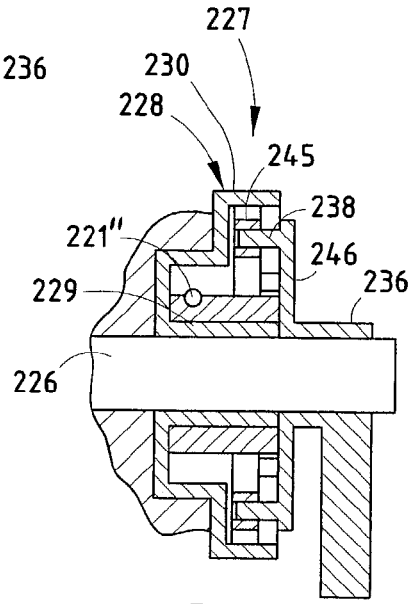
FIGS. 29–30 are cross-sectional views of the hand control of FIG. 28, FIG. 29 being fully assembled, FIG. 30 being exploded apart.
Figure 30:
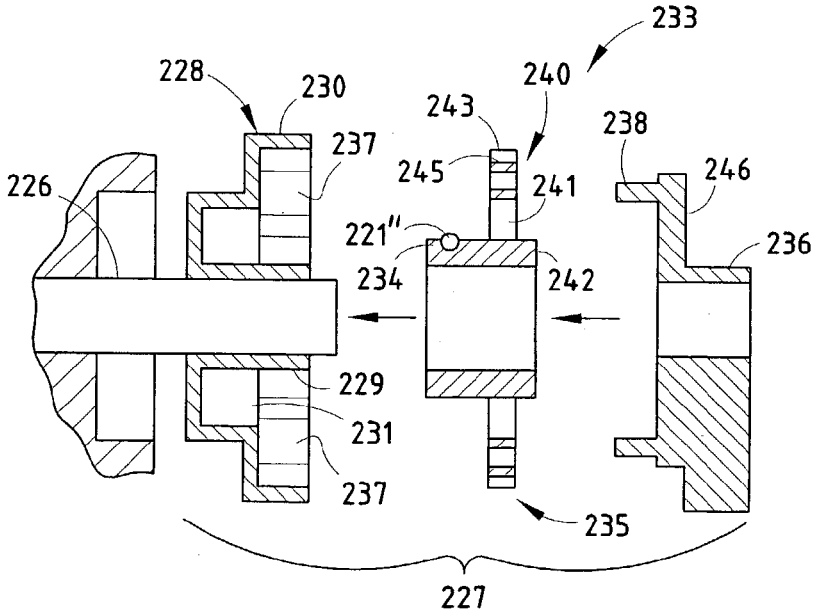

The illustrated selector device 227 (FIGS. 28–30) includes a housing 228 fixed to the rod support 226 with an inner ring section 229 attached to the rod, and an annular cover 230 rising from the ring and forming a laterally-open cavity 231 around the ring 229. Detent recesses 237 are formed around an inside of the cover 230. A one-piece plastic molded rotatable clutch member 233 including a hub 242 is positioned in the cavity 231 and includes a first section 234 attached to the cable end 221". The rotatable clutch member 233 further includes a clutch portion 235 integrally formed with hub 242. A handle 236 is rotatably mounted on an end of the support 226 and includes protrusions 238 that engage the clutch 235 to control engagement with the detent recesses 237 as follows.

Figure 31:
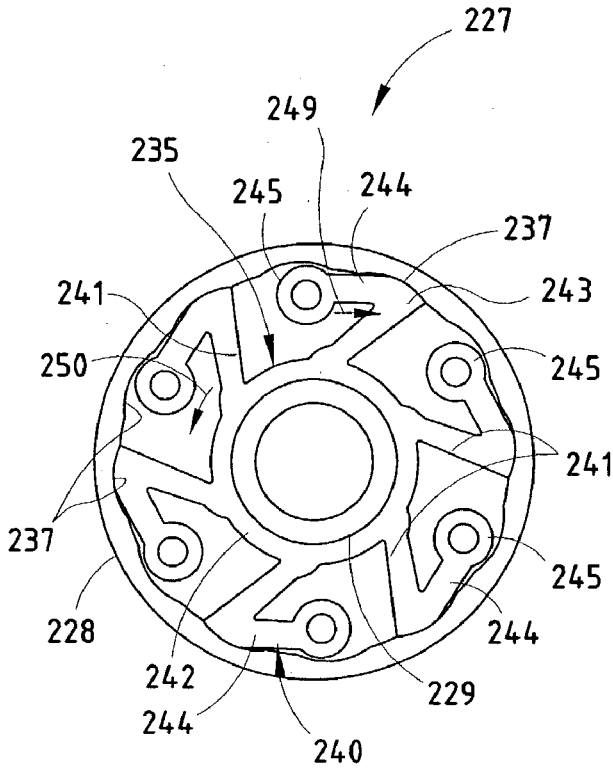
FIG. 31 is an enlarged fragmentary view of the clutch and its engagement with the exterior housing, showing the clutch in a locking position.
Figure 31A:
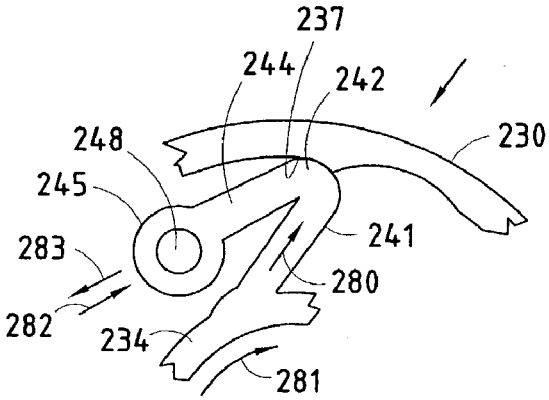
FIGS. 31A and 31B are enlarged fragmentary views of a portion of FIG. 31, FIG. 31A showing a locked position and FIG. 31B showing a released position.
Figure 31B:
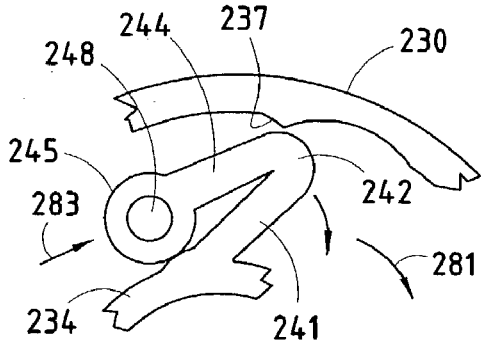
Figure 32:
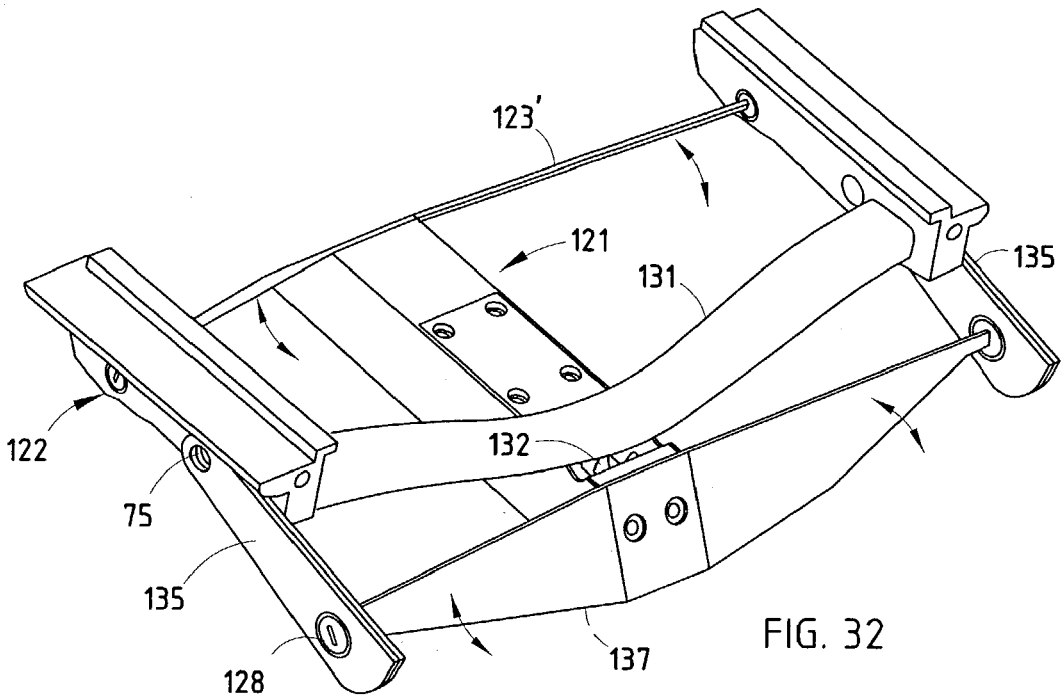
FIGS. 32–33 are front and rear partial perspective views of the base and control of FIG. 18.
Figure 33:
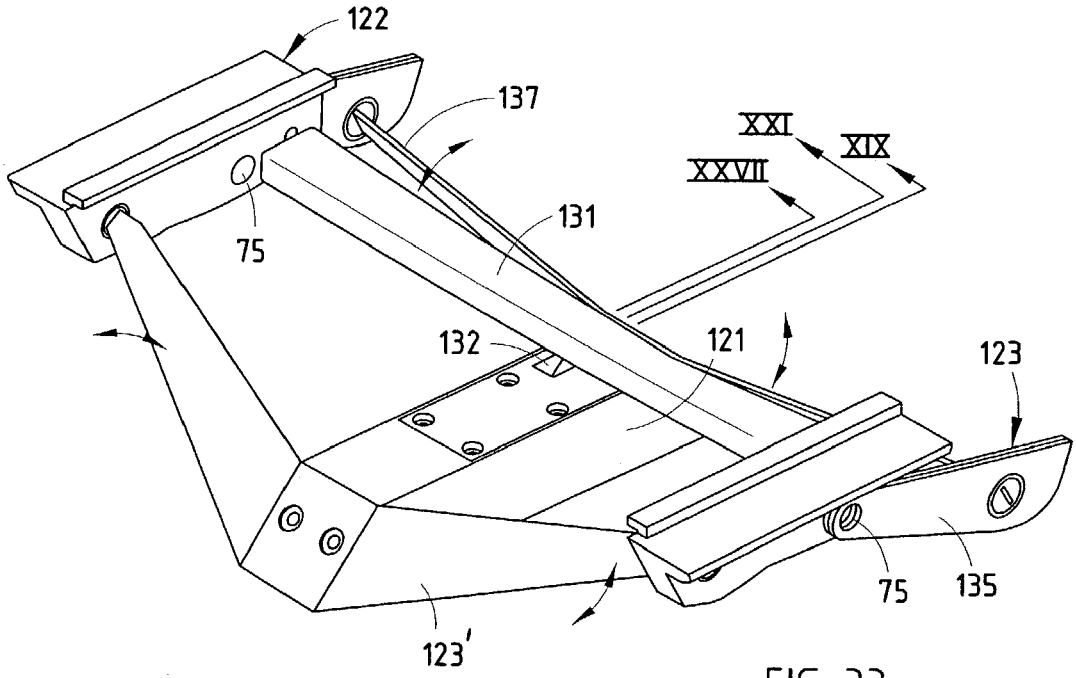
Figure 34:
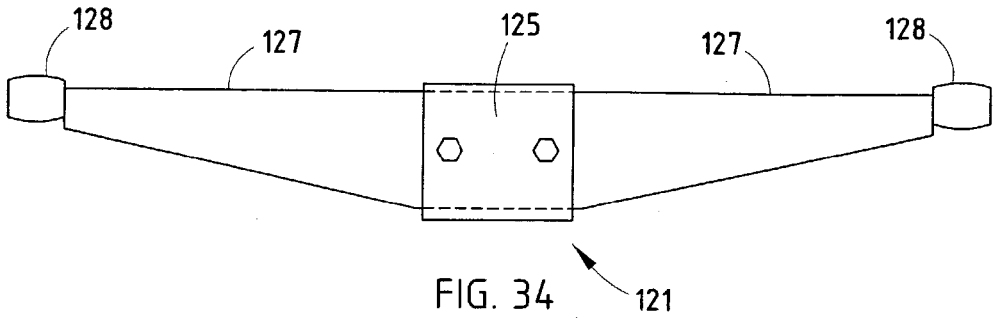
FIGS. 34–35 are front and plan fragmentary views of the control shown in FIG. 33.
Figure 35:
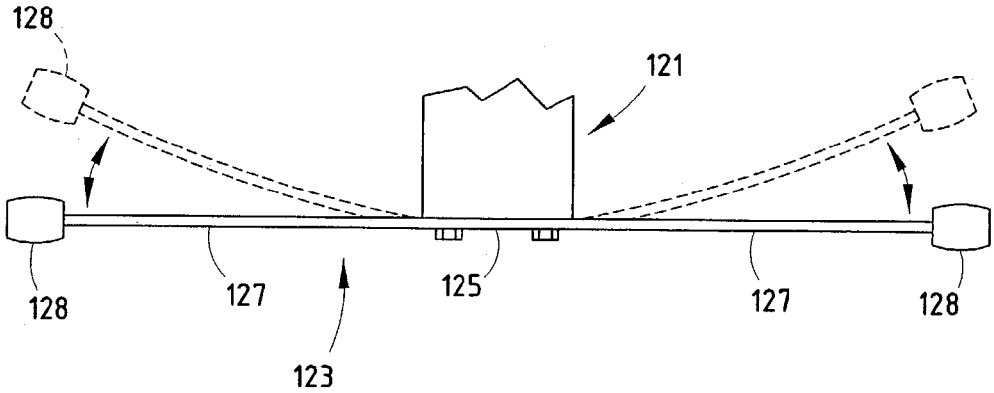

The clutch portion 235 (FIG. 28) includes one or more side sections 240 (preferably at least two side sections 240, and most preferably a circumferentially symmetrical and uniform number of side sections, such as the illustrated six side sections) having a resilient first section 241 that extends at an angle from the hub 242 to an elbow 243 that is in contact with the detent recesses 237, and a second section 244 that extends in a reverse direction from the end of the first section 241 to a free end 245 located between the hub 242 and the detent recesses 237. Each free end 245 includes a hole 248. The handle 236 includes a clutch-adjacent section 246 that supports the protrusions 238 at a location where the protrusions 238 each engage the hole 248 in the associated free end 245 of every side section 240. Due to the angle of the first sections 241 (FIG. 31A, see arrow 280) relative to the inner surface of the housing that defines detents 237, the first sections 241 interlockingly engage the detent recesses 237 against the bias of the spring 225 as communicated by the tension in cable 222 (see arrow 281), preventing movement of the clutch 235 when it is biased in direction 249 (FIG. 31) by the hub 242. Thus, when handle 236 is released, the clutch 235 again locks up against the force 281 of spring 225 (FIG. 27) as communicated by cable 222 to the clutch 235. However, when the handle 236 is grasped and moved in the rotational direction 283 (FIG. 31A) relative to housing 228, the handle protrusions 238 pull the second section 244 to thus pull the first and second sections 241 and 244 so that the rotatable member 230 (and the clutch 231) rotates. When the handle 236 is moved in a rotational direction 282 (FIG. 31A), the handle protrusions 238 push the second section(s) 244 at a low angle relative to the detent recesses 237, such that the second sections 244 (and first sections 241) slip out of and over the detent recesses 237 (FIG. 31B), allowing the rotatable member 230

(and clutch 231) to adjustingly move in direction 281. Thus, the present arrangement allows adjustment in either direction, but interlocks and prevents unwanted adjustment in a particular direction against a spring biasing force.

Figure 26:
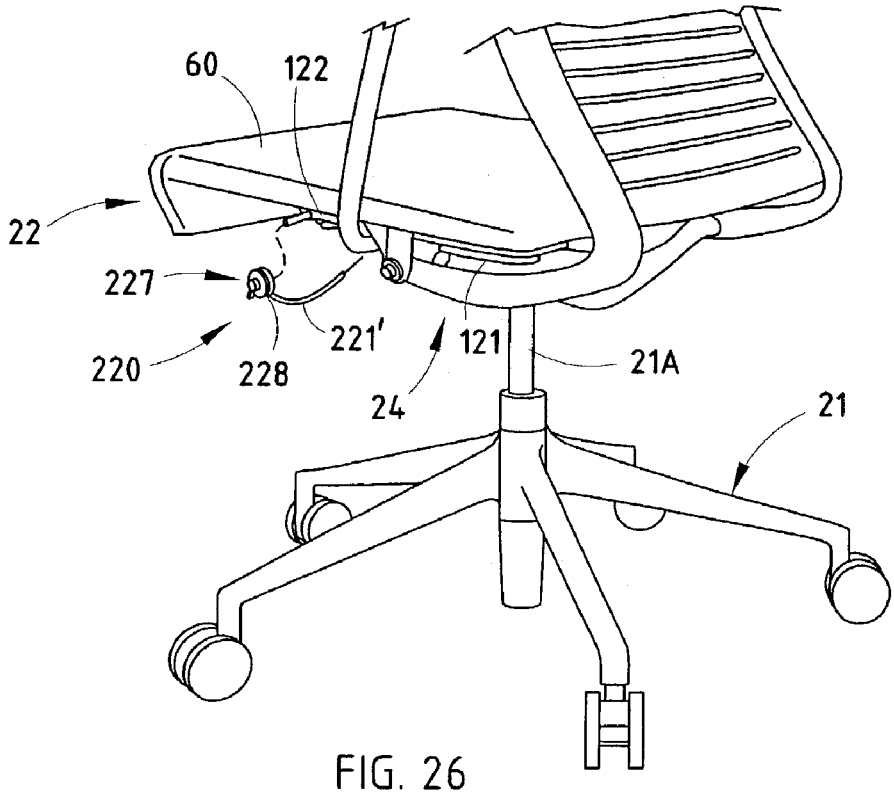
FIG. 26 is an exploded perspective view showing an underseat-located manual control for the booster and backstop mechanism.
Figure 27:
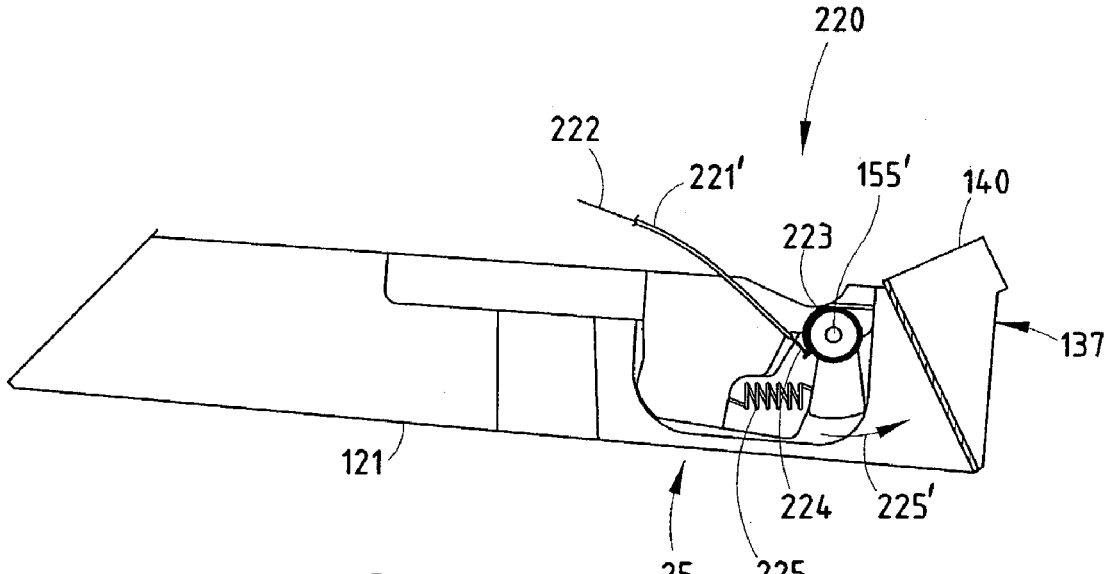
FIG. 27 is a cross-sectional view taken along the line XXVII in FIG. 33.
Figure 26A:
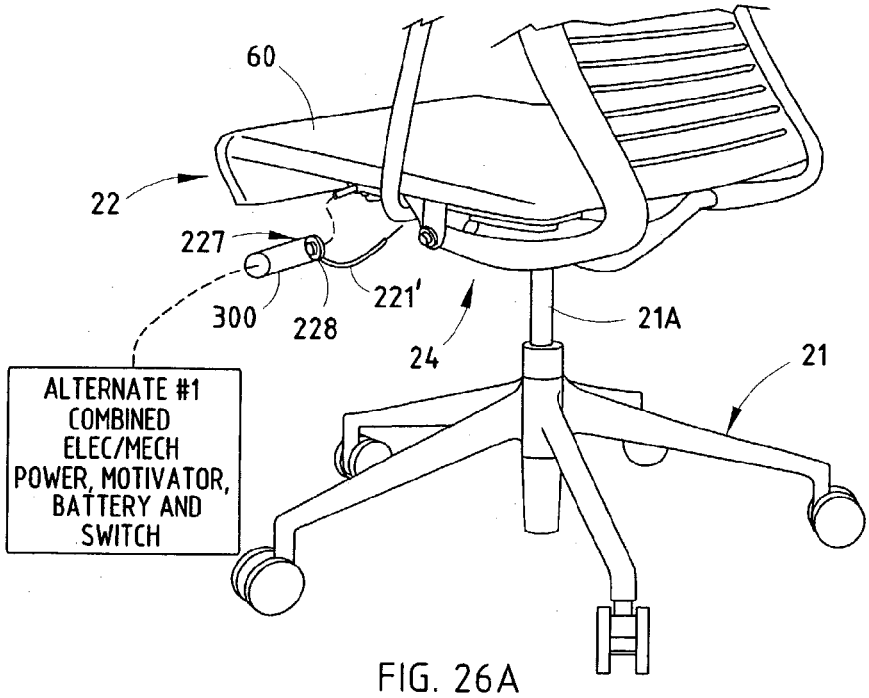
FIGS. 26A and 27A are similar to FIGS. 26 and 27, but showing alternative embodiments.
Figure 27A:
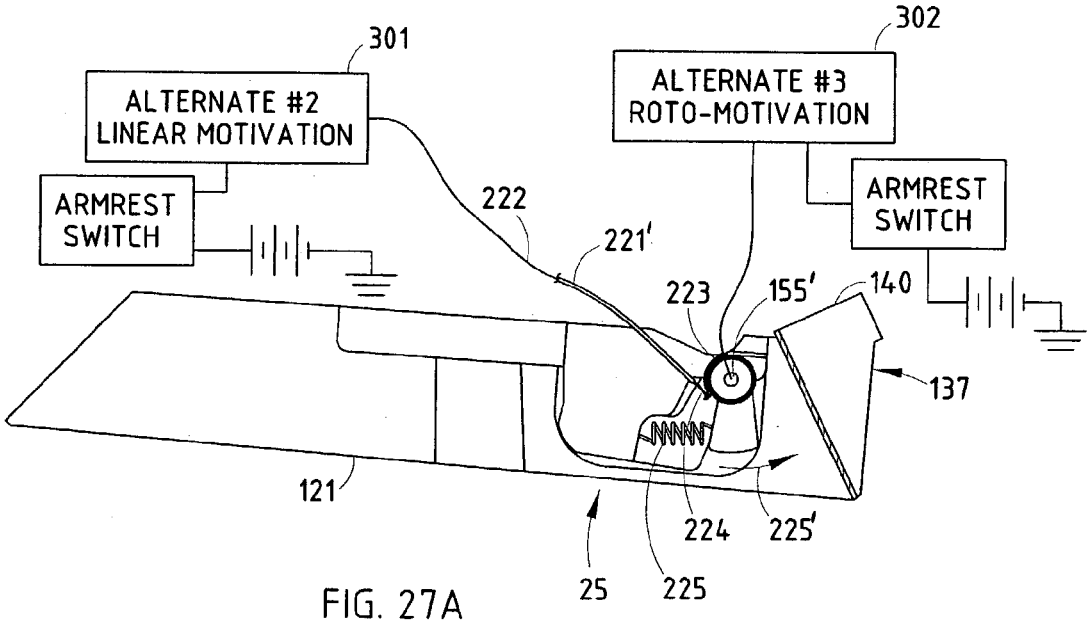

It is noted that actuation of the booster mechanism 25 and the backstop 205 is particularly easily accomplished, since the actuation action does not require overcoming the strength of a spring nor of overcoming any friction force caused by the spring 150. Further, the actuation action does not require movement that results in storage of energy (i.e. does not require compressing or tensioning a spring). Thus, a simple battery-operated DC electric motor or switch-controlled solenoid would work to operate the booster mechanism 25 and/or the backstop 205. FIG. 26 illustrates a housing 300 supporting a battery pack and electric rotary motivator (such as a DC motor), and includes an end-mounted switch. FIG. 27A illustrates a linear motivator 301 operably connected to cable 222, and also illustrates a rotary motivator 302 connected to axle 155'. Since the movement of the booster mechanism 25 and the backstop 205 requires only a very small amount of energy with minimal frictional drag, it can be accomplished without a need for a large energy source. Thus, a small battery-operated device would work well for a long time before needing recharge of its battery.

The illustrated control mechanism 24 above has front and rear leaf springs used as flexible weight bearing members to support a seat and back for a modified synchronous movement, and has a pivoted link/arm that assists in directing movement of a rear of the seat. However, the present arrangement can also include stiff arms that are pivoted to the base support 121, or can include any of the support structures shown in application Ser. No. 10/241,955, filed on Sep. 12, 2002, entitled "SEATING UNIT WITH MOTION CONTROL", the entire contents of which are incorporated herein in their entirety. Also, a "booster" mechanism 25 provides added biasing support upon recline when a stop is engaged. However, it is contemplated that a continuously adjustable biasing device such as a threaded member for adjusting a spring tension or cam could be used instead of the booster mechanism 25.

Since the seat support 122 raises upon recline, potential energy is stored upon recline. Thus, a heavier seated user receives greater support upon recline than a lightweight seated user. Also, as a seated user moves from the recline position toward the upright position, this energy is recovered and hence assists in moving to the upright position. This provides a weight-activated movement seat, where the seat lifts upon recline and thus acts as a weight-activated motion control. (I.e. The greater the weight of the seated user, the greater the biasing support for supporting the user upon recline.) It is noted that a variety of different structures can provide a weight-activated control, and still be within a scope of the present invention.

Modification

Figure 40:
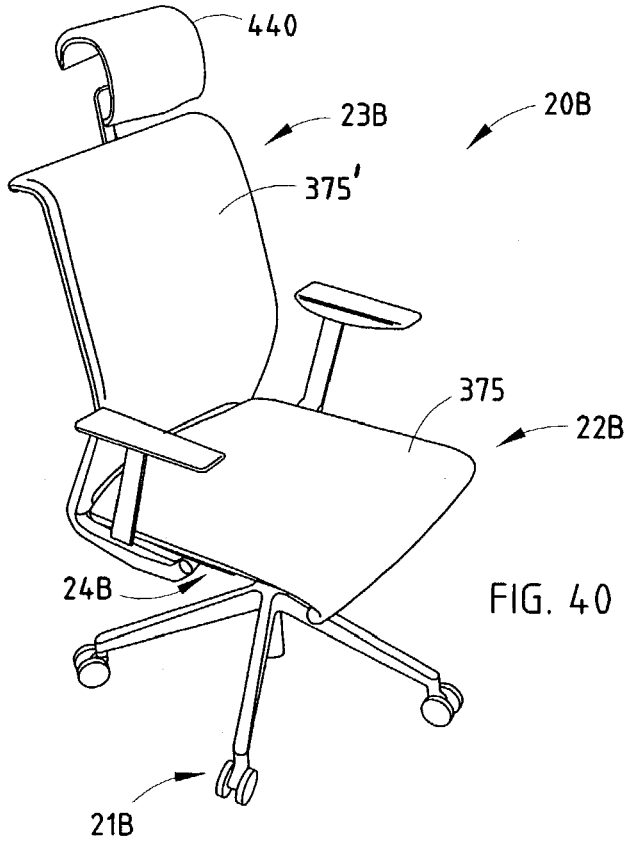
FIGS. 40–42 are front perspective, rear perspective, and side views of a modified form of the present inventive chair.
Figure 41:
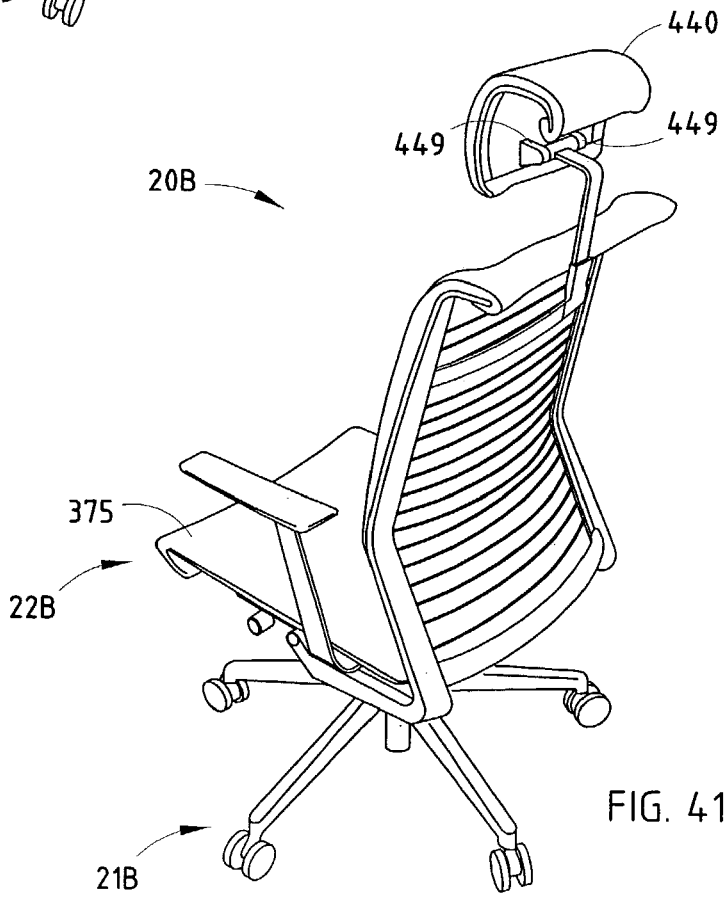
Figure 42:
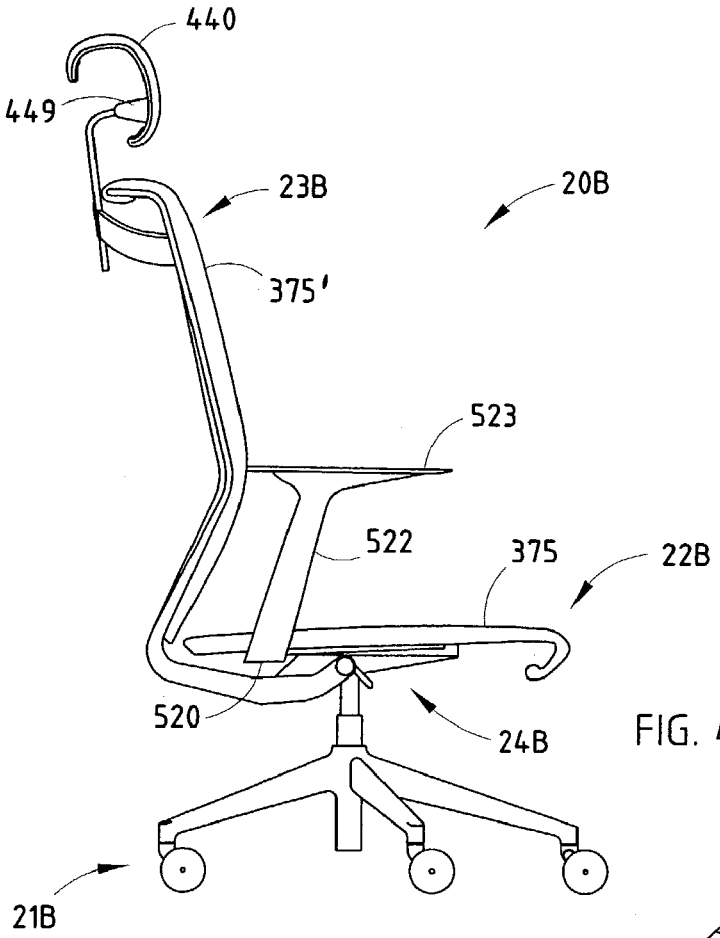

A modified chair or seating unit 20B (FIGS. 40–42) includes changes and improvements from that of chair 20. In order to minimize redundant discussion and facilitate comparison, similar and identical components and features of the chair 20B to the chair 20 will be identified using many of the same identification numbers, but with the addition of the letter "B".

The chair 20B (FIG. 40) includes a base 21B, a seat 22B, and a back 23B, with the seat 22B and back 23B being operably supported on the base 21B by an underseat control mechanism 24B for synchronous movement upon recline of the back 23B. As with chair 20, upon recline of chair 20B, the control mechanism 24B moves and lifts the seat 22B upwardly and forwardly, such that the back 23B (and the seated user) is automatically provided with a weight-activated back-supporting force upon recline. The seat 22B (and also the back 23B) includes a highly comfortable support surface formed by a locally-compliant support structure (hereafter called "a comfort surface") that adjusts to the changing shape and ergonomic support needs of the seated user, both when in an upright position and a reclined position. Specifically, the comfort surface changes shape in a manner that retains the seated user comfortably in the chair during recline, yet that provides an optimal localized ergonomic support to the changing shape of the seated user as the user's pelvis bones rotate during recline. In addition, the chair 20B avoids placing an uncomfortable lifting force under the seated user's knees and thighs, by well-distributing such forces at the knees and/or by flexing partially out of the way in the knee area. Further, comfort surfaces of the seat 22B and back 23B create a changing bucket shape (similar to that shown in FIGS. 2A and 2B) that "grips" a seated user and also actively distributes stress around localized areas, such that the seated user feels comfortably retained in the seat 22*b*, and does not feel as if they will slide down the angled/reclined back and forward off the seat during recline, as described below.

Figure 43:
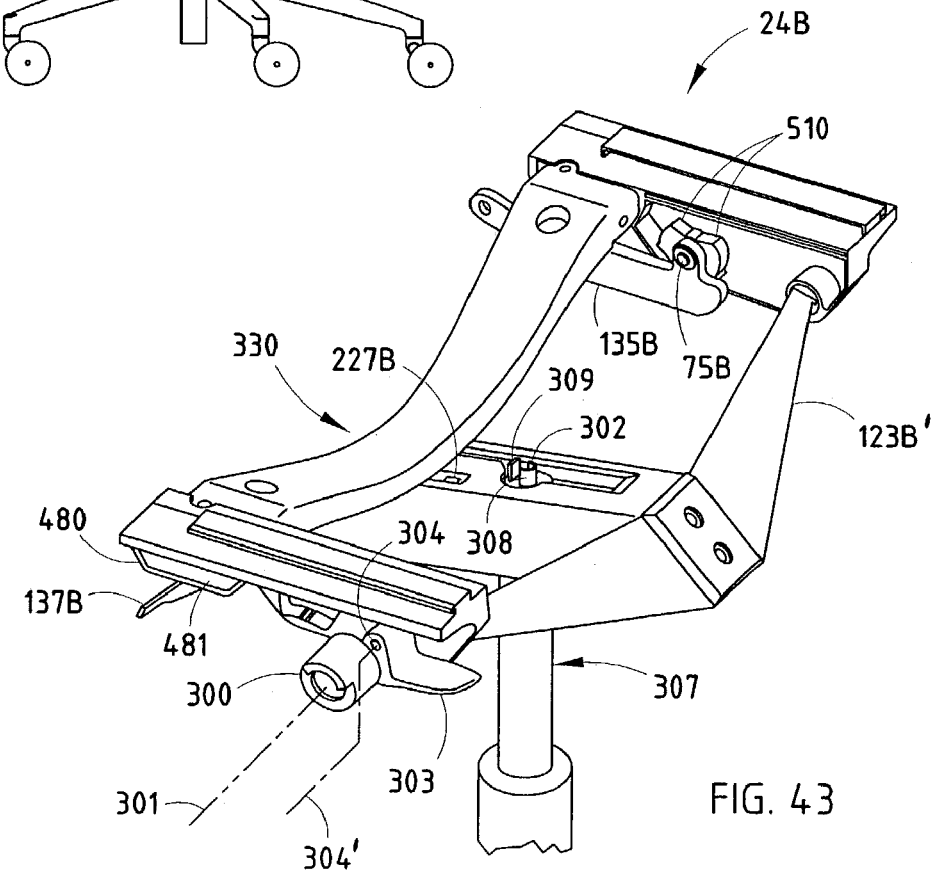
FIG. 43 is a perspective view of the underseat control for the chair in FIG. 40.
Figure 48:
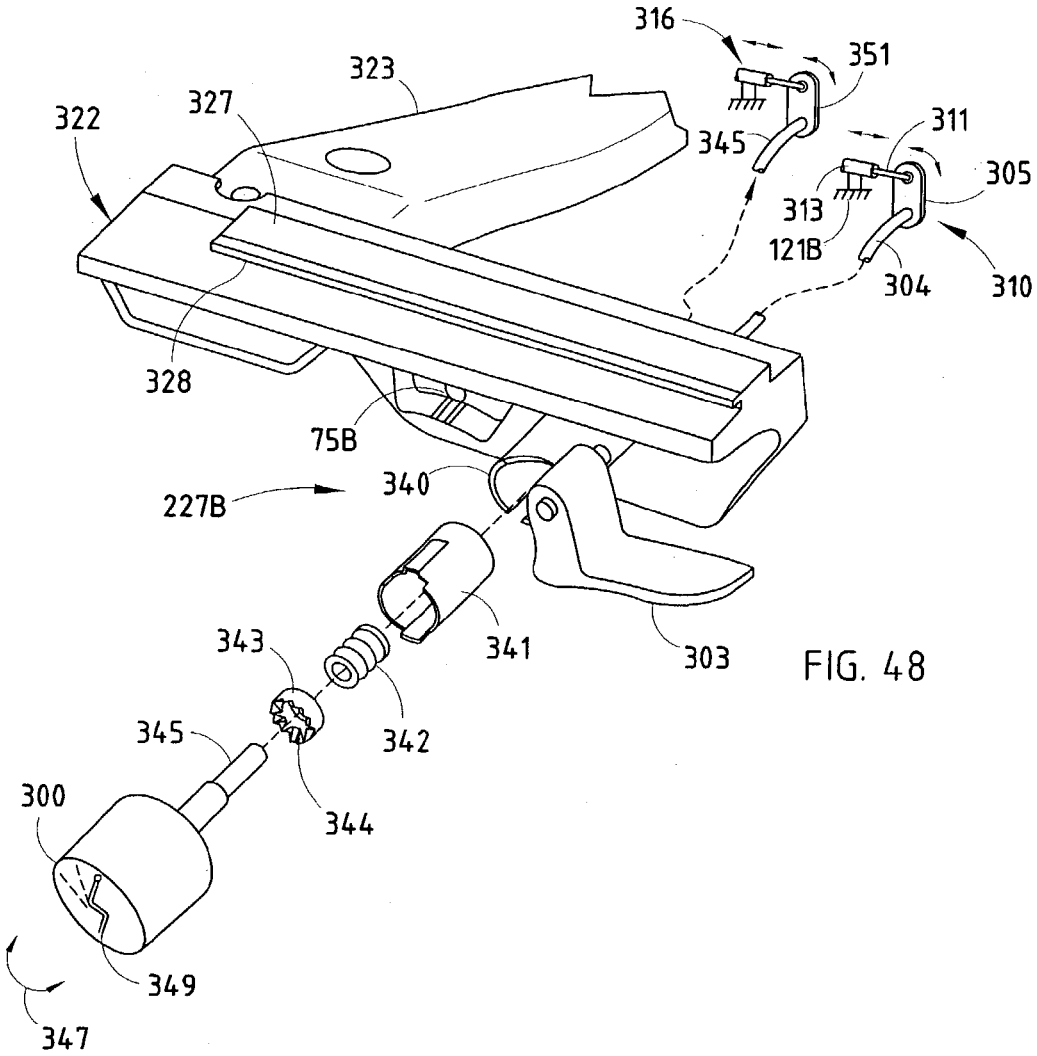

The chair control mechanism 24B (FIG. 43) includes a booster/back stop selector device 227B with a handle 300 rotatable about a first axis 301 for selectively moving the backstop and booster mechanisms (see FIGS. 19–23) (components 156 and 205) between the multiple positions illustrated in FIGS. 19, 20, 22, and 23. The control mechanism 24B further includes a second control device 302 with a radially-extending lever handle 303 rotatable about a rod 304 forming a second axis 304'. The second axis extends parallel to but is spaced from the first axis 301. The handle 303 is made to be positioned adjacent the handle 300, and includes a projection that engages the handle 300 to form a stop surface to limit back rotation of the handle 303. On an inner end of the rod 304 (FIG. 48) is a radially extending finger 305. The base 21B (FIG. 45) includes a releasable self-locking pneumatic spring 307 having two fixed tabs 308 for engaging a sheath on a cable sleeve, and a side-activatable lever 309 that operably engages an internal release button in the spring 307. A side-activatable pneumatic spring such as pneumatic spring 307 is commercially available in commerce and need not be described in detail in this application. (See Cho U.S. Pat. No. 6,276,756.) A cable assembly (FIG. 48) includes a cable 310 connected at one end 311 to the finger 305 and at another end 312 (FIG. 45) to the lever 309. The cable assembly further includes a sleeve 313 (FIG. 48) that is connected to the base support 121B near the handle 303, and that extends to and is connected to the tabs 308 (FIG. 45) on the pneumatic spring 307.

Figure 44:
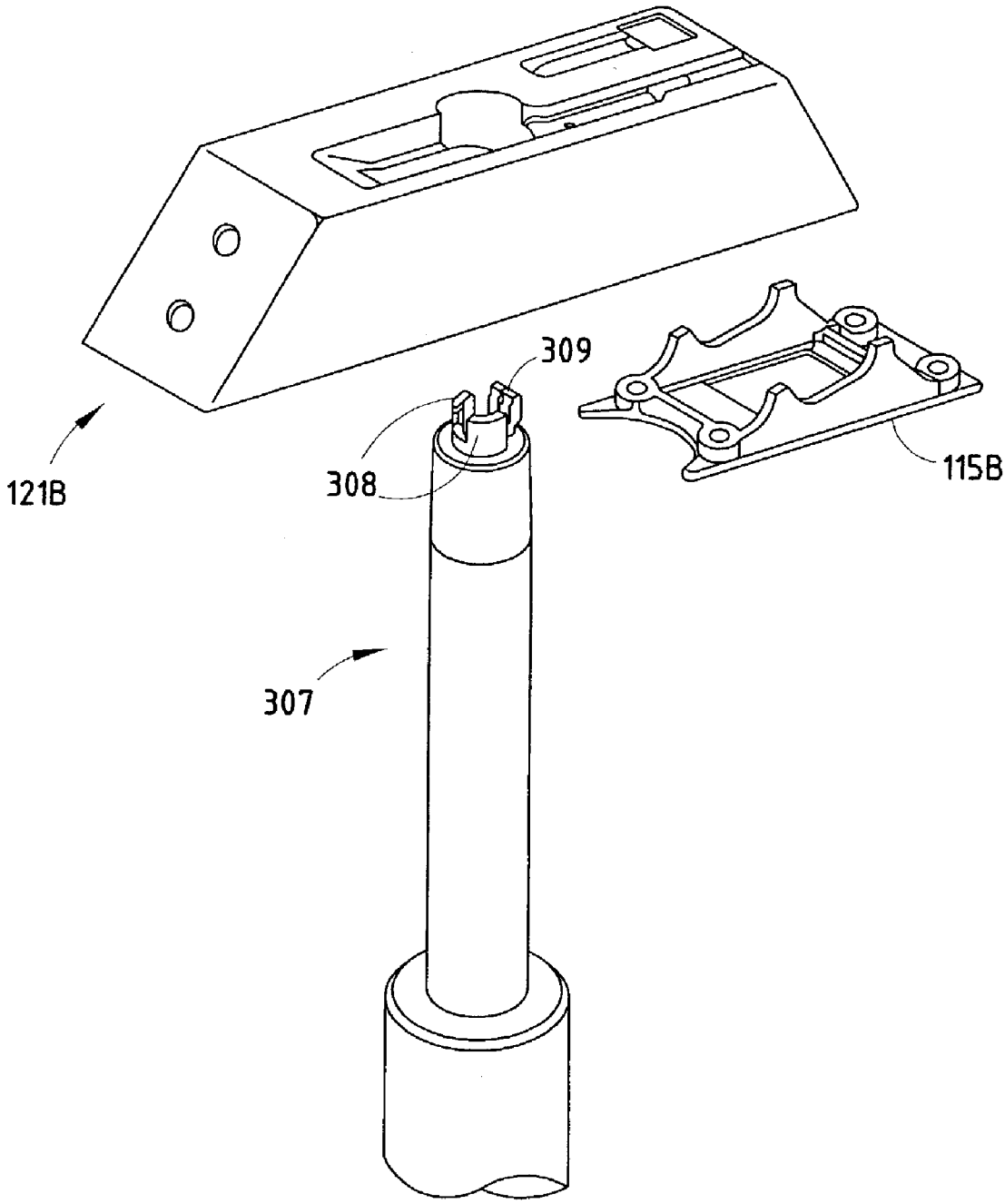
FIGS. 44–46 are a top perspective, a second top perspective, and a bottom perspective exploded view of a portion of the underseat control and related base components of FIG. 43.
Figure 45:
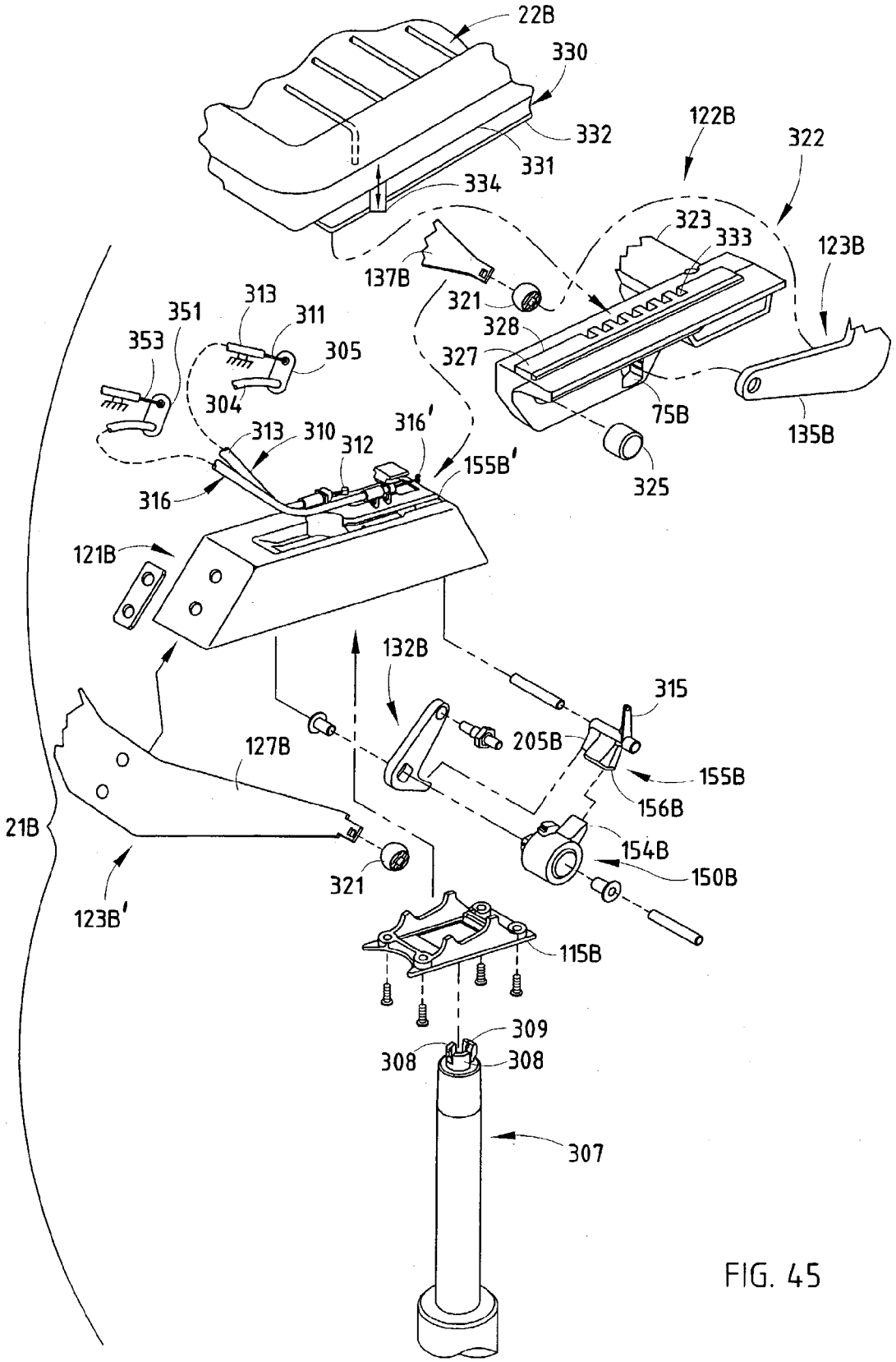
Figure 46:
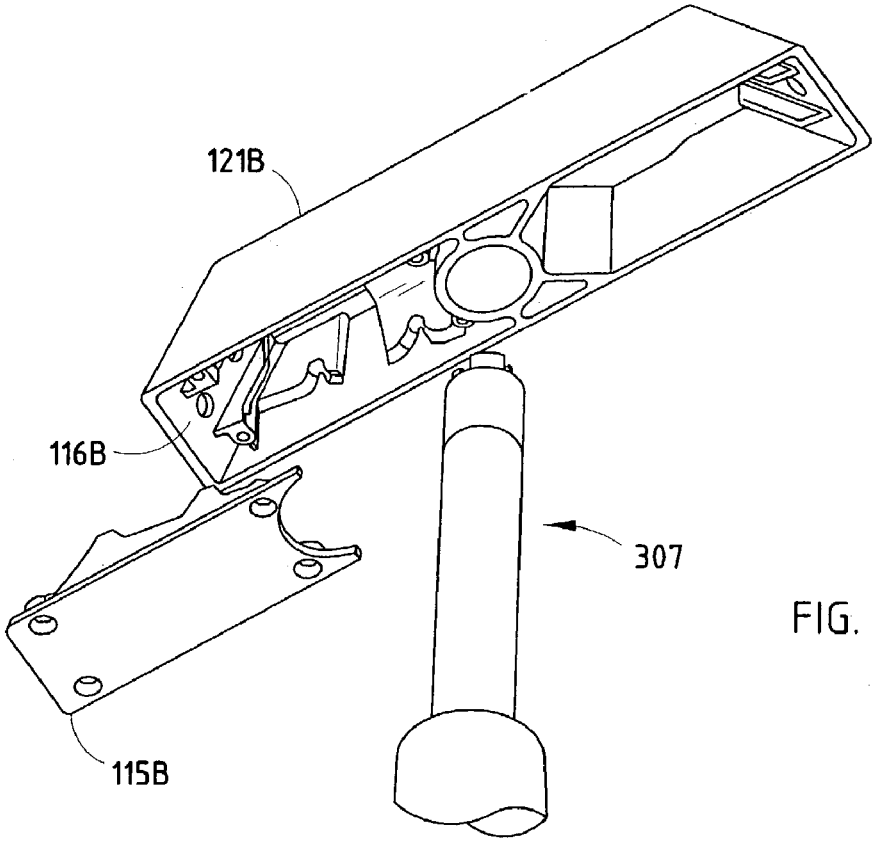

As shown in FIGS. 44–46, the base support 121B is inverted from the base support 121. Specifically, the base support 121B (FIG. 46) includes a similar cavity and internal surfaces and structure for supporting the levers, stops, and booster mechanisms within the base support 121B, similar to base support 121. However, the front portion 116B of the cavity in base support 121B opens downwardly, and the cover 115B engages a bottom of the base support 121B. An upright arm 315 (FIG. 45) is attached to the stop member 155B and extends up through a top aperture 155B' in the base support 121B. An end 316' of a cable 316 is connected to the arm 315 and extends to a tangential connection on the booster/back stop selector device 227B (FIG. 48), such that when the handle 300 is rotated, the cable 316 is pulled (and/or pushed) . . . and hence the stop member 155B is moved to a selected position. (See FIGS. 19, 20, 22 and 23).

Figure 47:
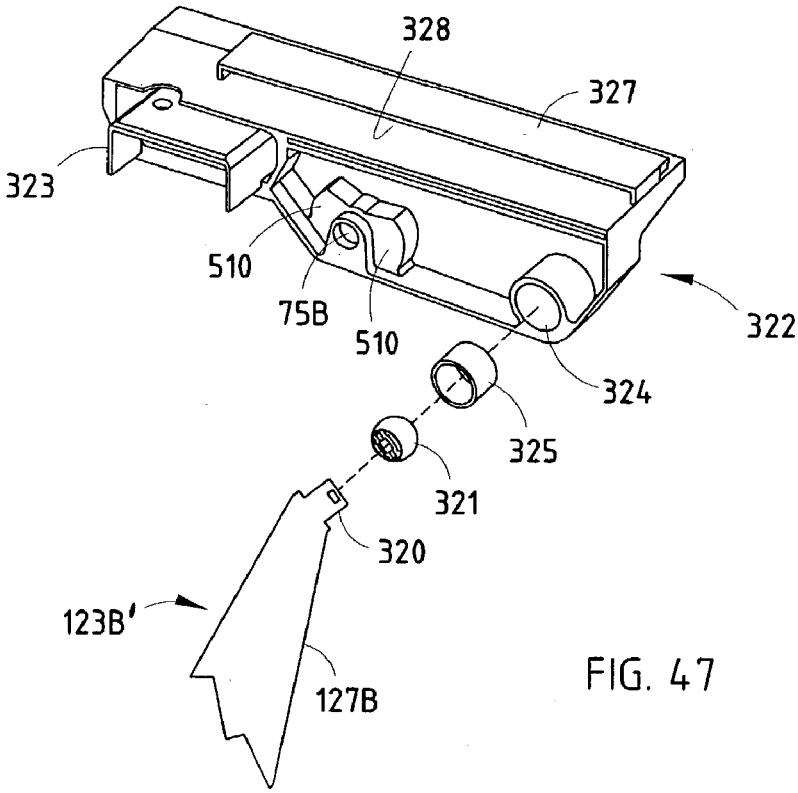
FIGS. 47–49 are exploded perspective views of the underseat control of FIG. 43, FIGS. 48 and 49 showing a hand control for adjusting the booster and back stop mechanism shown in FIG. 45.

The laterally-extending arms 127B of the front spring 123B' (FIG. 47) include a tab 320 that non-removably snap-attaches into a spherical bearing 321. The seat support 122B (FIG. 45) includes a pair of side frame members 322 and a transverse cross piece 323 rigidly connecting the opposing side frame members 322. Each side frame member 322 includes a bore 324, which, if desired, includes a bearing sleeve 325. The spherical bearings 321 on the ends of leaf springs 123B' each rotatably and telescopingly slidingly engage the sleeve 325/bore 324 to accommodate non-linear movement of the spherical bearing 321 during recline of the back 23B. Hole 75B (FIG. 47) receives a pivot pin that rotatably connects the respective side sections 135B of the back supporting upright 123B to the seat support 122B. A flange 327 forms a slot 328 along a top of the side frame members 322.

Each seat 22B (FIG. 43) includes a bracket 480 that forms a mounting socket 481 on seat side frame members 322 for receiving and fixedly supporting an "L-shaped" armrest support structure 482 (FIG. 42) and T-shaped armrest 483.

Figure 65:
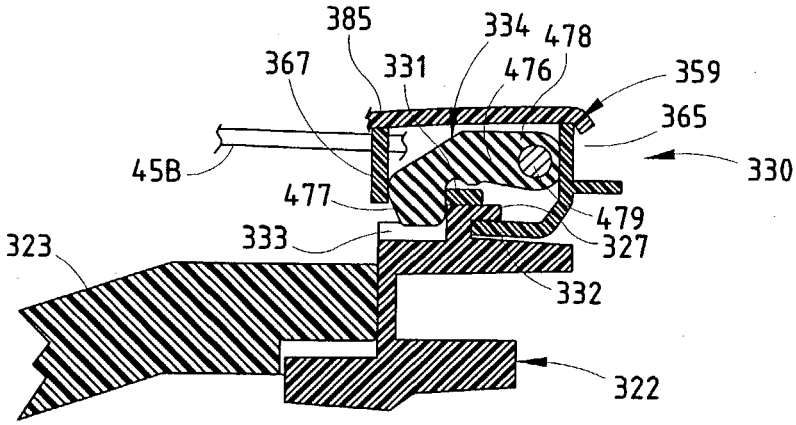
FIGS. 65 and 66 are cross sectional views taken perpendicularly through the latching area of FIG. 64, FIG. 65 showing a latched position and FIG. 66 showing an unlatched position of the latching member.
Figure 66:
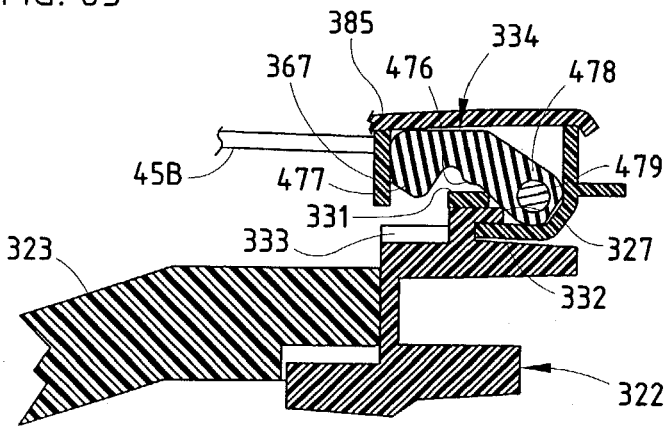

The seat 22B is depth adjustable, and includes a pair of seat carriers 330 (FIG. 45) attached to each side for sliding depth adjustment. Specifically, the seat carriers 330 each include a body 331 (FIG. 65) adapted to slidably engage a top of the side frame members 322 of the seat support 122B, and further include a lateral flange 332 that fits into and slidably engages the slot 328 for providing fore/aft depth adjustment of the seat 22B. The seat 22B is captured on the seat support 122B because flanges 332 on the right side and left side seat carriers 330 face in opposite directions. A series of notches 333 in the top inboard side of the seat carriers 330 are engaged by a latch 334 mounted on the seat carriers 330, the latch 334 being movable downward into an engaged position to engage a selected notch 333 for holding the seat 22B at a selected depth position. The latch 334 is movable upward to disengage the notches 333, thus permitting horizontal depth adjustment of the seat 22B. It is contemplated that the latch 334 can be a variety of different constructions, such as a blade mounted for vertical movement on the seat 22B, or a bent wire rod that when rotated has end sections that move into and out of engagement with the notches 333. It is contemplated that other latching and adjustment arrangements can also be constructed.

Figure 63:
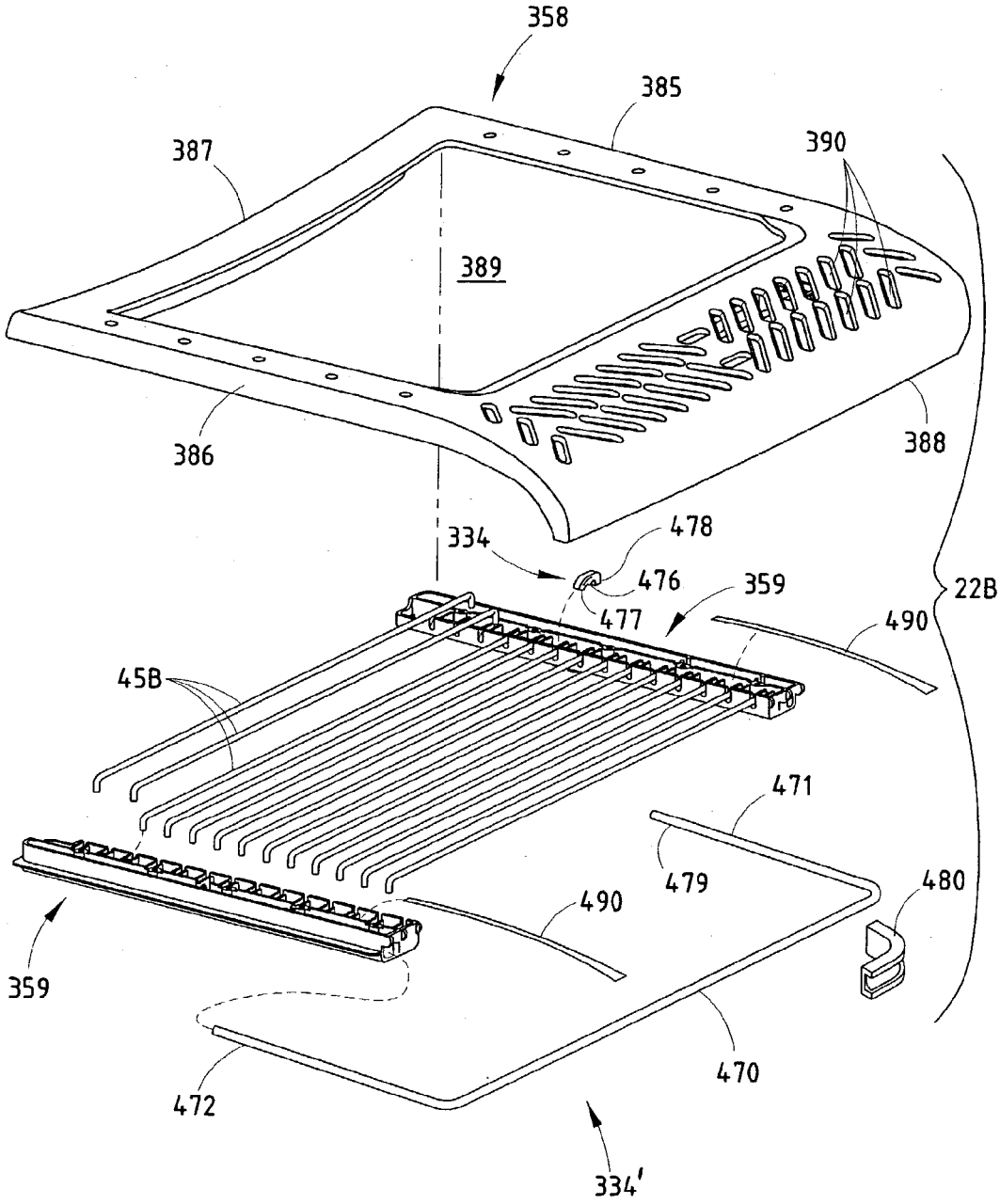
FIG. 63 is an exploded perspective view of the seat frame and wire support members of FIG. 50, including the depth adjustment latch and release handle.

In the illustrated chair design, the latch 334 is two-sided (FIG. 63) and is adapted to engage both sides of the seat 22B to prevent racking and unwanted angular twisting and rotation in the horizontal plane of the seat 22B. In other words, it is preferable that both seat carriers 330 be fixed to their respective side frame members 322 when latched to provide a stable seat arrangement that does not torque and twist in an undesirable unbalanced manner when a seated user is attempting to recline.

Figure 64:
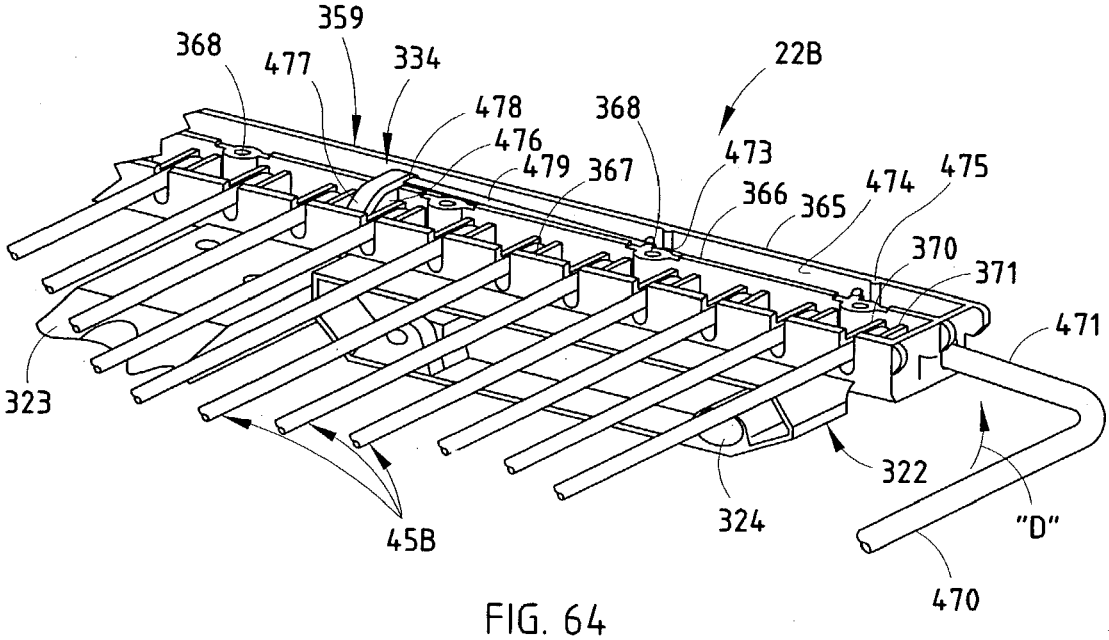
FIG. 64 is an enlarged top perspective view similar to FIG. 51, but which focuses on a front corner of the seat subassembly of FIG. 50.

The illustrated latch 334 (FIG. 63) is actuated by a U-shaped bent wire actuator 334' which includes a transverse handle section 470 forming a handle graspable under the seat front section 388, and includes a pair of legs 471 and 472. Each leg 471 (and 472) (FIG. 64) fits into a space between sidewall 365 and side section 359 (and between sidewall 366 and side section 359) of seat 22B. An annular groove 473 (FIG. 64) fits, mateably into a notch 474 in a rib 475 between walls 365 and 366 to form a pivot for leg 471 (and 472). The latch 334 is pivoted on an axle 476, and includes a latching end 477 shaped to move into and out of engagement with notches 333, and includes a second end 478 operably connected to a rear tip 479 of leg 471 in direction "D". When handle section 470 is moved up, side legs 471 and 472 pivot at rib 475, such that leg tip 479 moves down. When leg tip 479 moves down, latching member 334 pivots about pivot 476 to lift latching end 477 out of notches 333. A depth of seat 22B can then be adjusted. One or more resilient springs 480 (FIG. 63) located between transverse handle section 470 and seat front section 388 bias section 470 downwardly, causing latching tip 479 to again engage a selected notch 333 when handle section 470 is released.

Figure 49:
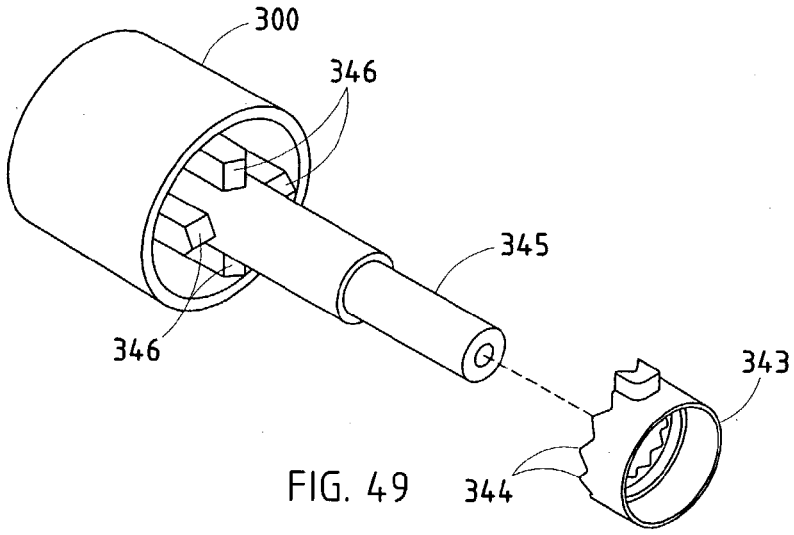

As noted above, the chair control mechanism 24B (FIG. 43) includes a booster/back stop selector device 227B with a handle 300 rotatable about a first axis 301 for selectively moving the backstop and booster mechanisms (see FIGS. 19–23) (components 156 and 205) between the multiple positions illustrated in FIGS. 19, 20, 22, and 23. More particularly, a tubular support 340 (FIG. 48) is attached to the outboard side of the right side frame member 322. A bearing sleeve 341 is positioned in the tubular support 340 along with a coiled compression spring 342, a crown-shaped detent ring 343 with pointed axial tips 344, and the handle 300. A rod 345 extends from the handle 300 through the components 343, 342, and 340 to an inside of the side frame member 322. The handle 300 includes teeth-like projections 346 (FIG. 49) that engage the axial tips 344 of the detent ring 343, and the detent ring 343 is biased axially in an outboard direction so that the tips 344 continuously engage the projections 346. Further, the detent ring 343 is keyed to the tubular support 340 so that the detent ring 343 cannot rotate, but is able to telescope axially. The tips 344 and projections 346 include angled surfaces so that upon rotation of the handle 300, the detent ring 343 will move axially inward against the bias of spring 342, and then snap back outwardly as the tips 344 fit between adjacent projections 346, thus permitting rotation of the handle 300 in directions 347. This arrangement causes the handle 300 to move with a detented rotation. The illustrated arrangement includes four projections 346 on the handle 300, and sixteen tips on the detent ring 343, but it is contemplated that more or less of each can be used. It is contemplated that the handle 300 can include markings 349 to identify its function, and that any of the handle shapes commonly used in the chair art can be incorporated into the illustrated design.

A lever 351 (FIG. 48) extends from an inner end of the rod 345, and is operably connected to one end 353 of the cable 316. Recall that the other end 316' (FIG. 45) of the cable 316 is connected to the arm 315 of the stop member 155B of the booster and back stop engaging member 155B.

Figure 50:
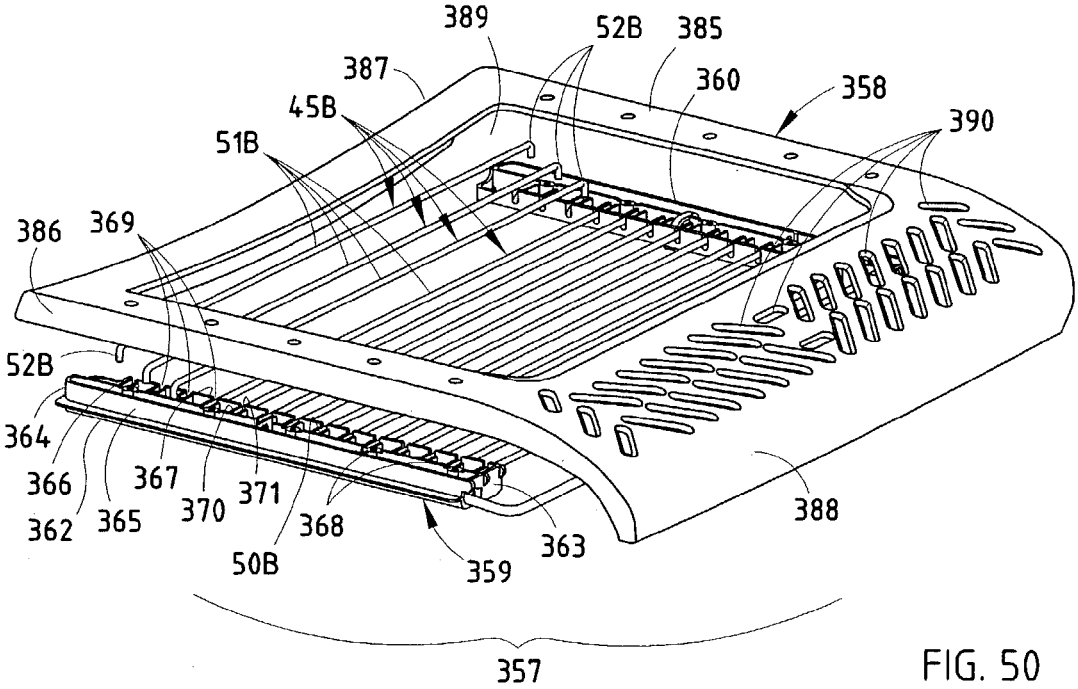
FIGS. 50–51 are perspective and fragmentary perspective views of the seat shown in FIG. 40.
Figure 51:
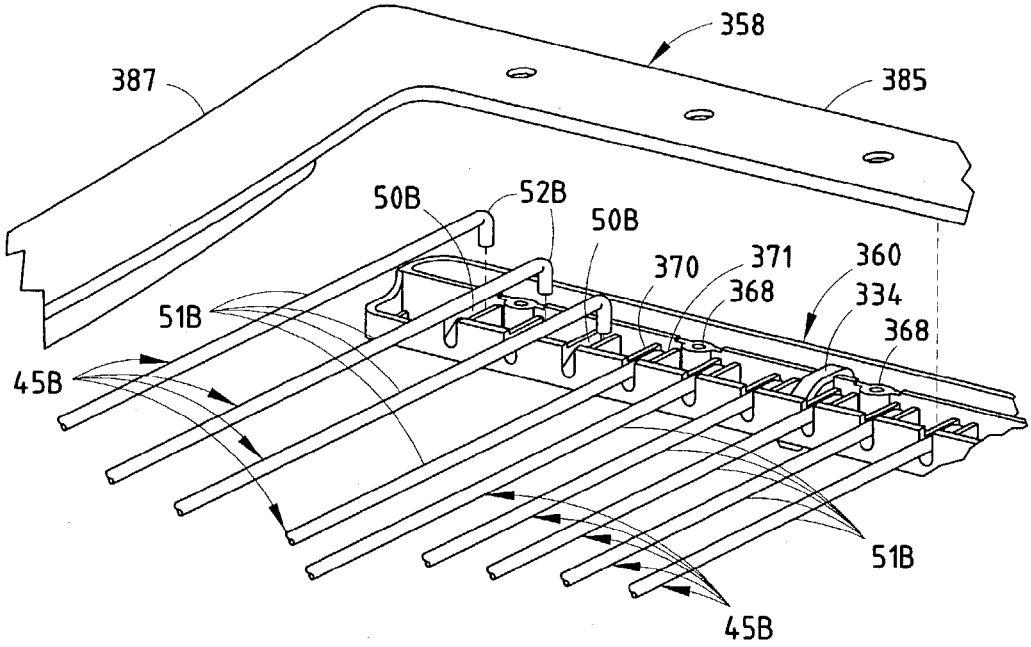

The seat 22B (FIG. 50) includes a seat frame 357 comprising an upper frame component 358 and right and left seat lower frame components 359 and 360 attached to right and left sides of the upper frame component 358. The lower frame components 359 and 360 are attached directly to the top of the seat carriers 330 mentioned earlier (FIG. 45), or can be integrally formed to incorporate the features of the illustrated carriers 330. The support members 45B (FIG. 50) comprise single wires with down-hooks formed at each end, as described below.

Figure 52A:
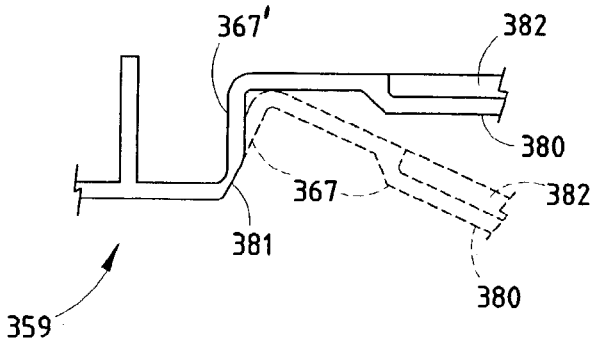
FIG. 52A is a similar view showing an alternative mounting structure.
Figure 52:
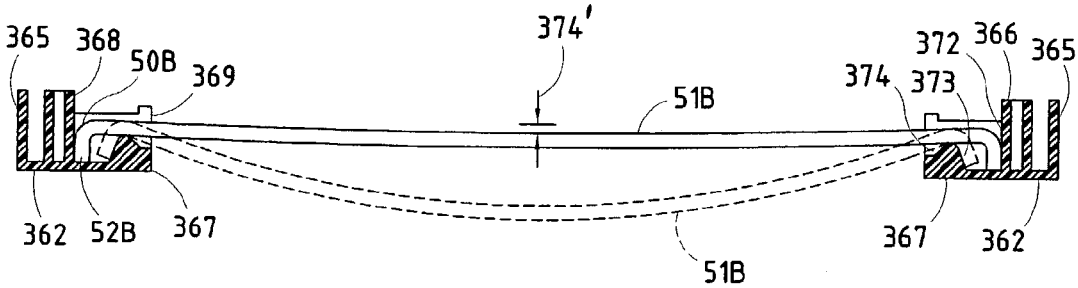
FIG. 52 is a cross section showing flexing of the wire support member for the wire support members shown in FIG. 50.
Figure 58A:
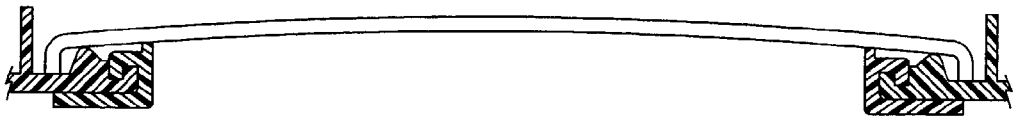
FIG. 58 is a schematic showing the lumber device of FIG. 57.

The lower frame components 359 and 360 (FIG. 50) are mirror images of each other, and accordingly only the lower frame component 359 will be described. The lower frame component 359 is a plastic molded component having a bottom wall 362, front and rear end walls 363 and 364, and three longitudinal walls 365–367. The outer wall 365 formed an aesthetic and structural outer surface. The intermediate wall 366 includes a plurality of apertures bosses 368 for receiving screws (not shown) to attach the upper and lower frame components 358 and 359/360 together. The inner wall 367 includes a plurality of vertically open slots 369 that extend from its top surface to about halfway down into its height, and further includes parallel walls 370 and 371 that extend from wall 367 to wall 366 on each side of the slots 369. A recess or pocket 50B is formed between each of the parallel walls 370 and 371 for receiving the end sections 52B, as described below. The inboard side of the intermediate wall 366 forms a first stop surface 372 (FIG. 52), and the outboard side of the inner wall 367 forms a second stop surface 373 with an angled ramp surface 374 extending inwardly and downwardly away from the second stop surface 373.

Each support member 45B (FIG. 50) comprises a single wire of the same type wire as support member 45 described above. Each support member 45B has a long section 51B and has L-shaped down-formed end sections 52B forming hooks. The long section 51B is linear and extends generally horizontally through a bottom of the slots 369 when in an installed position without a user setting on the seat 22B. The end sections 52B are linear and extend downwardly into the pockets 50B. When in an installed position without a user setting on the seat 22B (see solid lines in FIG. 52), the end sections 52B abut the outer (first) stop surface 372, causing the wire long section 51B to have a slight downward bow in its middle area at location 374'. This provides a pretension and pre-form in the wire support member 45B. When a user sets on the seat 22B (see dashed lines in FIG. 52), the long section 51B bends until the end sections 52B engage the inboard (second) stop surface 373. This limits further bowing or bending of the long section 51B. Further, the angled ramp surface 374 provides additional support to the end portions of the long section 51B, inboard from the end sections 52B, such that the effective length of the long section 51B is reduced. This results in the support member 45B having a preset maximum bend that is limited by the inner stop surface 373 (i.e. a sling type effect), and further is limited by a shorter effective length of the long wire section 51B (which feels stiffer). Both of these circumstances cause a soft bottoming out as the wire support member 45B deflects to a maximum bend. At the same time, the wire support member 45B can bend at any location, more than only at their center point, such that the seated user receives a particularly comfortable and ergonomic support.

Figure 70:
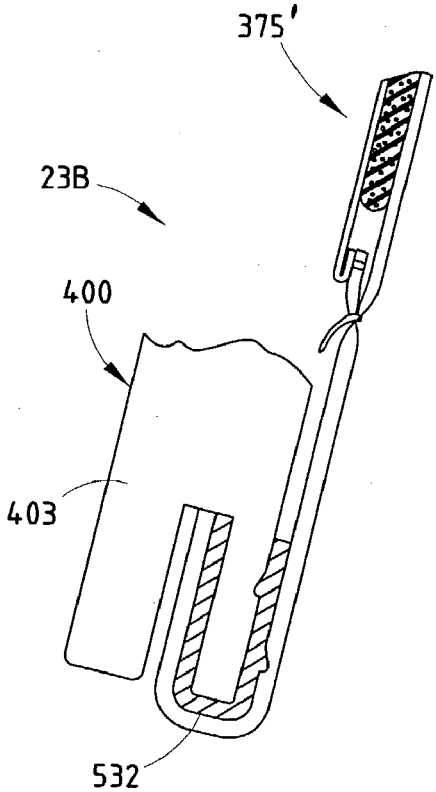
FIGS. 70 and 71 are cross sectional views showing an attachment configuration for attaching a cushion assembly to the back frame of FIG. 53.

The seat 22B also includes a cushion assembly 375 (FIG. 40) comprising a cushion and an upholstery or cloth covering. It is contemplated that the supports 45B are so flexible and comfortable that the cushion can be eliminated. Alternatively, a cushion assembly 375 can be used that is preferably anywhere from ¼ inch to 1 inch in thickness. The upholstery covering can be any material, but preferably should allow some (though not too much) elastic stretch and give to accommodate the shape changes permitted by the individual movement of the support members 45B.

Where the cushion assembly 375 is sufficiently elastic and resilient, the cushion assembly 375 can include front and rear hook-like formations that permit it to be hook-attached to a front and a rear of the seat support structure (i.e. frame 30B). (See the discussion of FIGS. 70–71 below.)

It is contemplated that, instead of the support members 45B comprising a single long wire with bent ends, that the support members 45B can be made to include long resilient wires or stiff members, supported at their ends by hinges to the side frame components, with the axis of rotation of the hinges extending forwardly and being at or slightly below the long resilient wires. For example, FIG. 52A discloses seat having a modified lower frame component 359 made to include a strap 380 supported by a downwardly offset living hinge 381 at a bottom of where the second (inner) stop surface 373 would be. The strap 380 has a groove shaped to receive a straight length of wire 382. When there is no seated user, the wire 382 extends horizontally, and the living hinge 381 moves to allow the inner wall 367' to move to a normal raised position. When a person sits on the seat, the living hinge 381 flexes, causing the wall 367' to tip inward and downward. (See dashed lines.) This results in an action and movement similar to that noted above in regard to seat 22B.

The seat upper frame component 358 (FIG. 50) includes a perimeter frame portion with side sections 385 and 386, rear section 387 and under-the-knee "waterfall" front section 388 defining a large opening 389 across which the support members 45B extend. The side sections 385 and 386 screw-attach to the lower side frame components 359 and 360, and both stiffen the side frame components 359 and 360 and also capture the end sections 52B in the pockets 50B. The rear section 387 forms a stiff rear area of the seat 22B. The front section 388 extends forwardly 3 to 6 inches, and forms a front "waterfall" front surface that comfortably supports the thigh area of seated users of the chair 20B. Multiple slots 390 and/or stiffening ribs provide an optimal stiffness so that the front section 388 will resiliently flex but provide adequate support and a good feel in both the upright and reclined positions of the chair 20B.

Fore-aft leaf springs and transverse leaf springs can be added to optimize anyone of the sections 385–388. In particular, it is contemplated that fore/aft springs will be added to help support the transition area at ends of the front section 388 near a front of the side sections 385–386.

The illustrated reinforced-plastic springs 490 (FIG. 63) are pultruded flat leaf-springs made to flex without taking a permanent set. They fit snugly into a recess in the upper frame component 358, and are held thereagainst by the lower frame components 359. It is contemplated that they will have a flat horizontal cross-sectional shape, and that they will extend forward of the front end of the side sections 359, but other configurations and arrangements are possible, while still accomplishing the same function.

Figure 53:
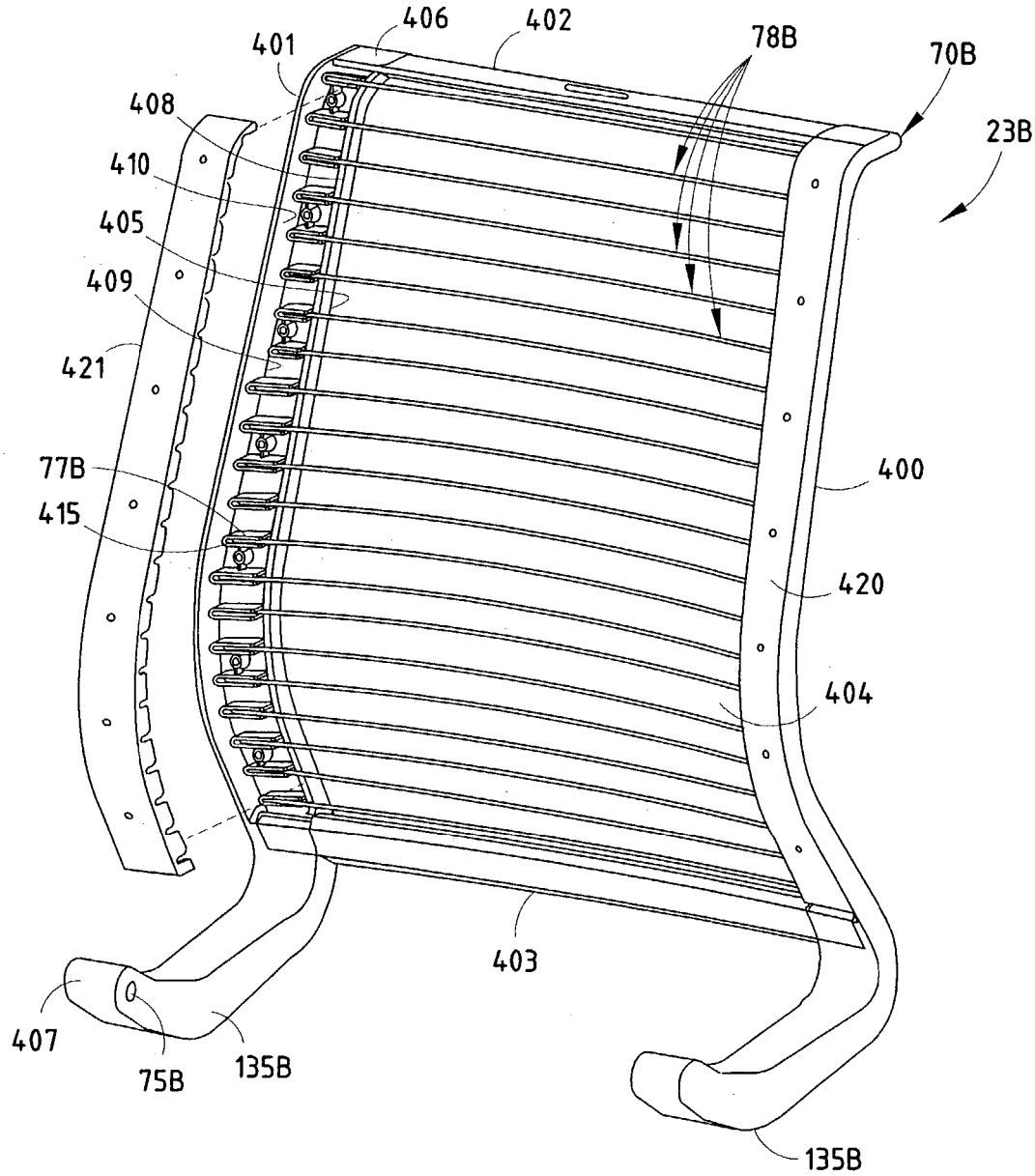
FIGS. 53–54 are exploded perspective views of the back shown in FIG. 40.
Figure 54:
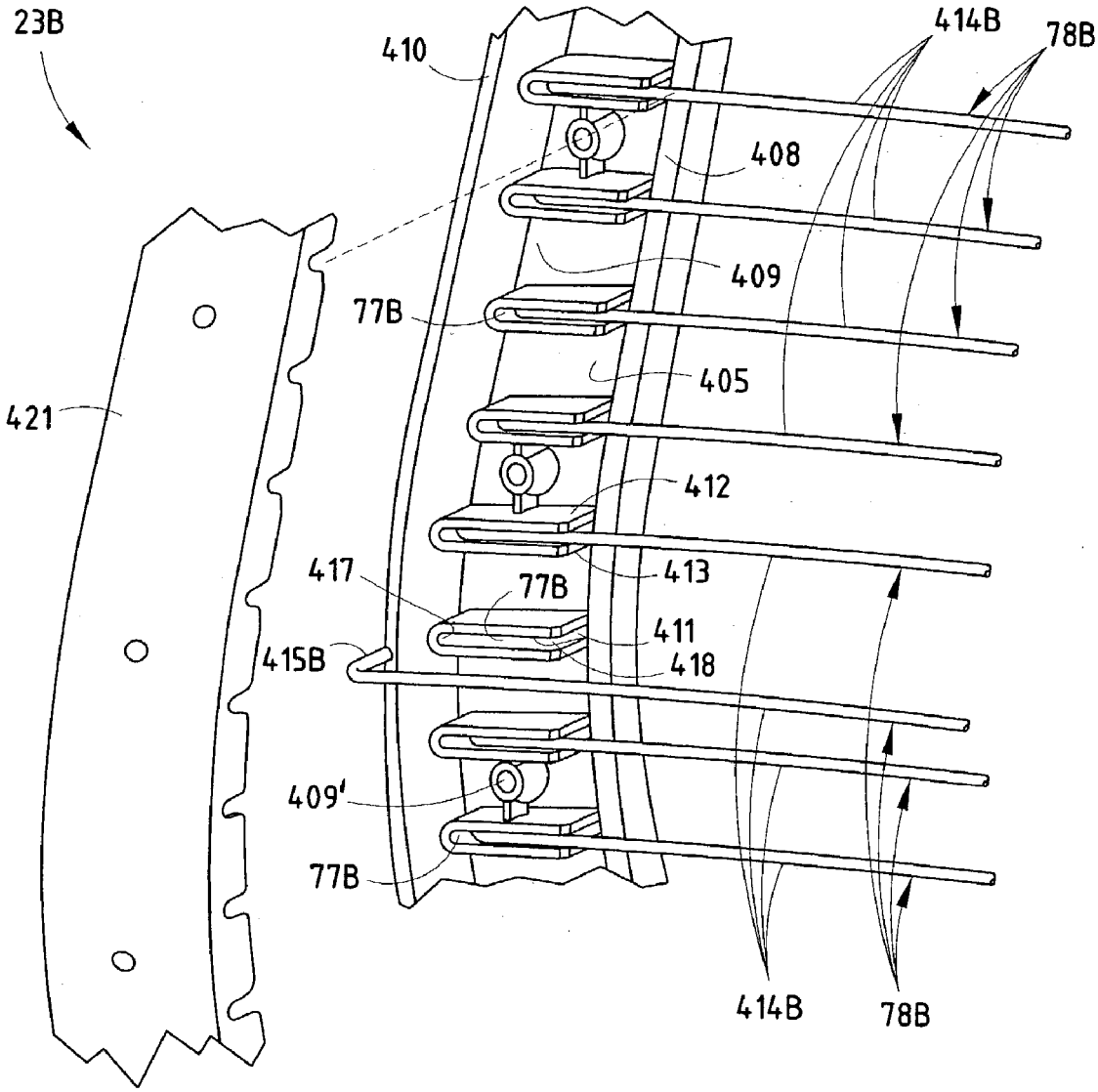

The structure of back 23B (FIGS. 53–54) is not dissimilar to the structure of the seat 22B. Hence a detailed repetitious description is not required. Nonetheless, it is noted that the back 23B includes a back perimeter frame 70B with upright side sections 400, 401, top transverse section 402 and bottom transverse section 403 defining a large open area 404. A bottom of the side sections 400 and 401 extend forwardly to form forwardly-extending side leg sections 135B, and are pivotally connected to the seat side sections at pivot 75B. The upright side sections 400 and 401 include a bottom wall 405 (FIG. 53), end walls 406 and 407, and inner and outer walls 408 and 410. Half-depth slots 411 (FIG. 54) are formed in inner wall 408, and parallel walls 412 and 413 extend between the inner and outer walls 408 and 410 on each side of each slot 411. A pocket 77B is formed on the bottom wall 405 between the parallel walls 409–410. Bosses 409' are formed between the inner and outer walls 408 and 410, and are supported by a short intermediate wall 409 that extends between adjacent ones of the parallel walls 412 and 413 (at locations not interfering with the recesses or pockets 77B). Support members 78B (similar to support members 50B in the seat 22B) are positioned on the back 23B, and each include a long wire section 414 that extend into the slots 411, and L-shaped bent end sections 415 that extend down into the pockets 77B. The movement of end sections 415 within the pockets 77B is similar to that described above in regard to the seat 22B. In the rest position, the end sections 415 abut outer surfaces 417 of the pockets 77B, thus holding the wires in a partially bent condition. When a seated user rests in the chair and leans on the back, the long wire sections 414 flex, until the end sections 415 move abuttingly into the inboard stop surface 418, thus limiting any further flex of the wire support members 78B. Front covers 420 and 421 (FIG. 53) are attached to a front of the back upright side sections 400 and 401. The covers 420 and 421 both stiffen the side sections 400 and 401, and also hold the end sections 415 within the pockets 77B.

A cushion assembly 375' (FIG. 40) similar to that described above in regard to the seat 22B is attached to the back frame 70B. It can be attached in different manners. It is contemplated that one optimum method is to stretch and hook attach the cushion assembly to the top and bottom transverse frame sections 402 and 403. It is contemplated that a person skilled in the art will be able to use and adapt the attachment structure shown in FIGS. 70–71 to the top and bottom of the back 23B for attaching the back cushion assembly 375', and to the front and rear of the seat 22B for attaching the seat cushion assembly 375. Thus, a detailed description of each is not required.

Figure 71:
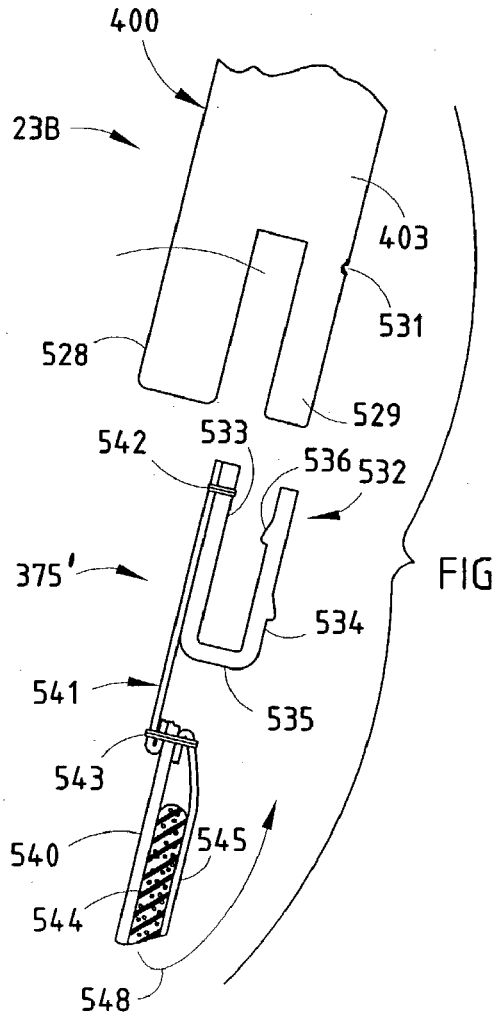

As shown in FIG. 71, the bottom frame section 403 of the back frame 400 includes a pair of ridges 528 and 529 that define a downwardly-facing rectangularly-shaped pocket or channel 530 that extends continuously across a width of the back frame 400. A detent channel 531 (or ridge if desired) is formed parallel the channel 530 along an outside front surface of the bottom frame section 403. The cushion assembly 375' includes a U-shaped extruded plastic attachment clip 532, including a flat leg 533, a barbed leg 534, and a resilient section 535 connecting the legs 533 and 534. The legs 533 and 534 are spaced apart to receive and matably engage the forward ridge 529. A detent protrusion 536 is biased into engagement with the detent channel 531 by the resilient section 535.

The cushion assembly 375' further includes a sheet of upholstery material 540 connected to the flat leg 533 by a strip of elastic sheet material 541. (Alternatively, the elastic sheet material 541 can be eliminated, and the upholstery material 540 attached directly to the flat leg 533, if testing shows that the added elastic stretch from the sheet material 541 is not required.) Specifically, one edge of the elastic sheet material 541 is sewn to the flat leg 533 of clip 532 by stitching 542, and an opposite edge is sewn to the upholstery material 540 by stitching 543. The strip 541 extends completely across a width of the back frame 400. Different methods are known for attaching and sewing the upholstery material 540 to the strip 541, and of for attaching and sewing the strip 541 to the flat leg 533, such that only a single simple seam is illustrated. It is contemplated that in a preferred form, in addition to the sheet material 541, a foam layer 544 and stable backing sheet 545 will be attached to the cushion assembly 375', although this is not required.

To attach the cushion assembly 375' to the back frame 400, the flat leg 533 of the extruded clip 532 of the cushion assembly 375' is pressed into the channel 530 of the bottom frame section 403 of the back frame 400, with the opposing leg 534 frictionally engaging an outer front surface of the bottom frame section 403. The combined thickness of the elastic sheet material 541 and the flat leg 533 captured within the channel 530, along with the detent protrusion 535 engaging the detent channel 531, form a strong secure connection that retains and holds the cushion assembly 375' to the back frame 400. It is noted that the sheets 540 and 541 overlay onto the barbed leg 534 when the cushion assembly 375' is fully installed onto the back frame 400 (see the arrow 548 in FIG. 71, and see the assembly of FIG. 70). Since the barbed leg 534 has a thickened cross section, a tension in the sheets 540 and 541 further biases the detent protrusion 535 into engagement with the detent channel 531. Also, the thickened section of the barbed leg 534 can help hide the stitching, by providing a space to receive the stitched area and to receive the multiple thicknesses of pleats in the stitched area.

Figure 55:
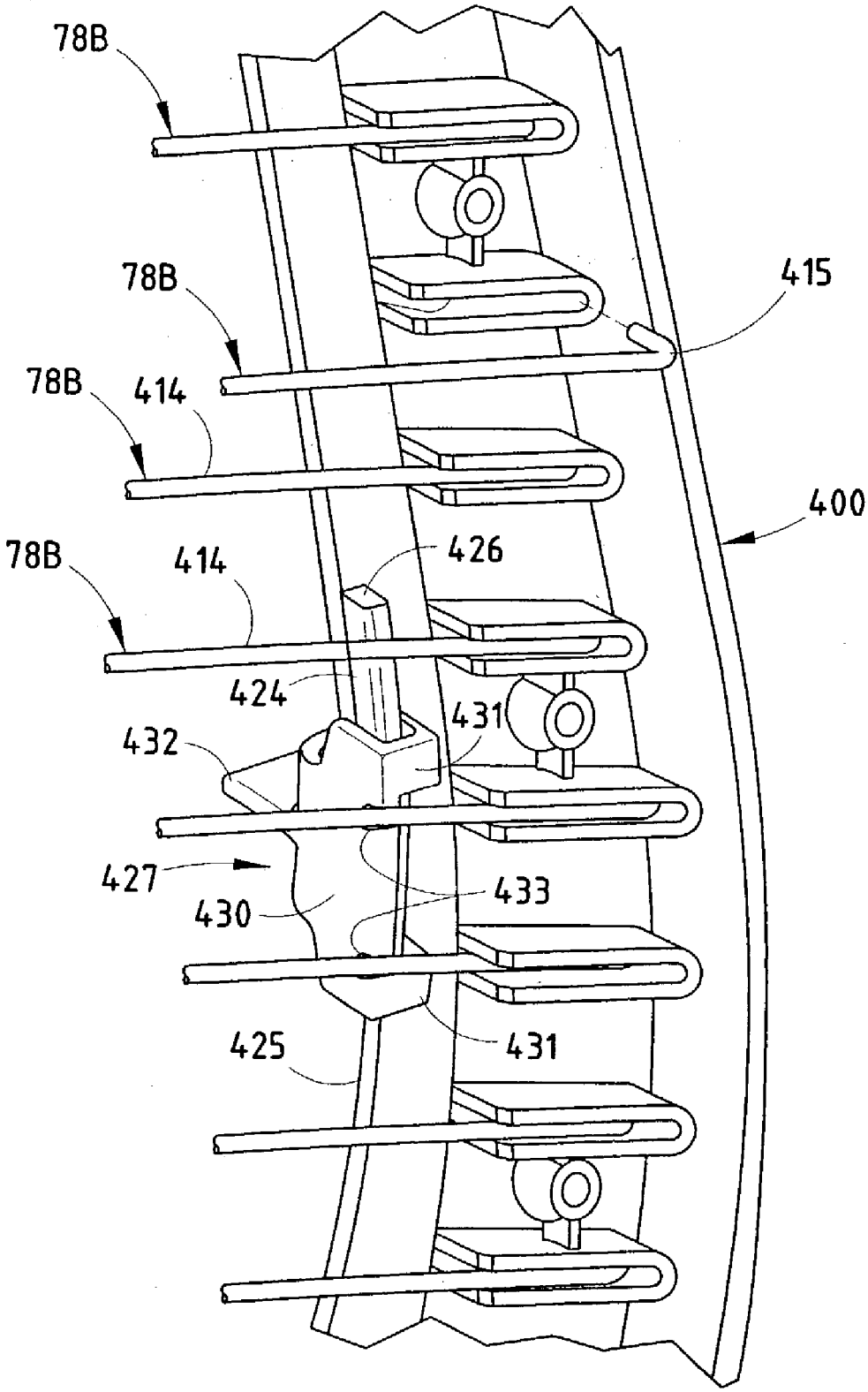
FIGS. 55–57 are perspective views of the lumbar devices and their effect on the wire support sections.

A rail 424 (FIG. 55) is formed on a front of an inwardly-directed flange 425 on the side sections 400 and 401. The rail 424 extends vertically about half to two-thirds of a length of the side sections 400 and 401, and includes a top termination or end 426 that forms a access port for engaging the rail 424. Different accessories can be mounted on the rail 424. For example, a lumbar device 427 and a headrest support 428 (FIG. 40) are illustrated.

Figure 56:
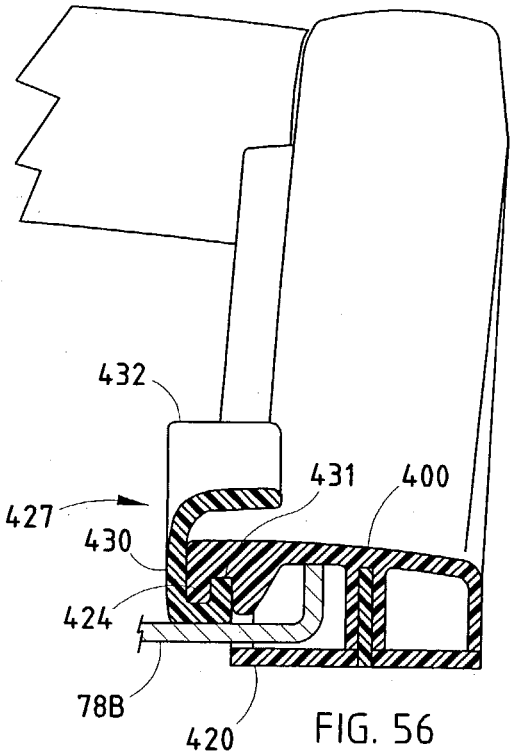
Figure 57:
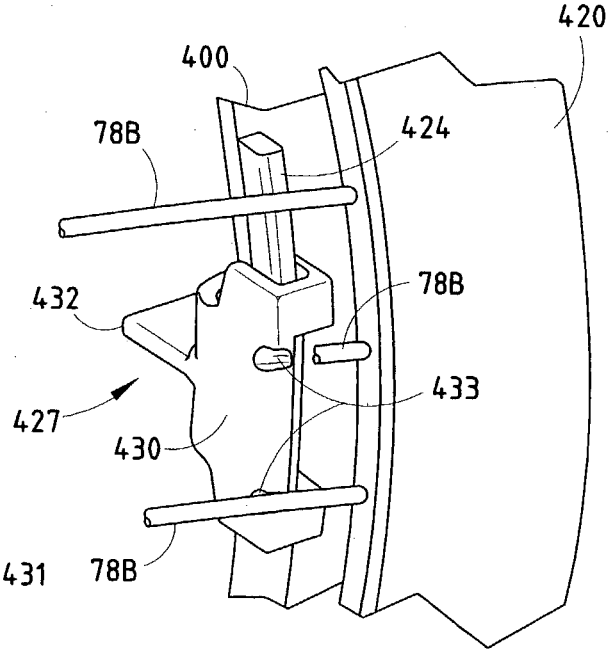
Figure 58:
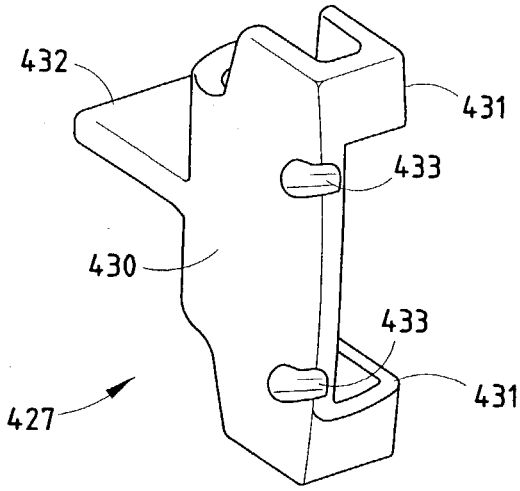
Figure 59:
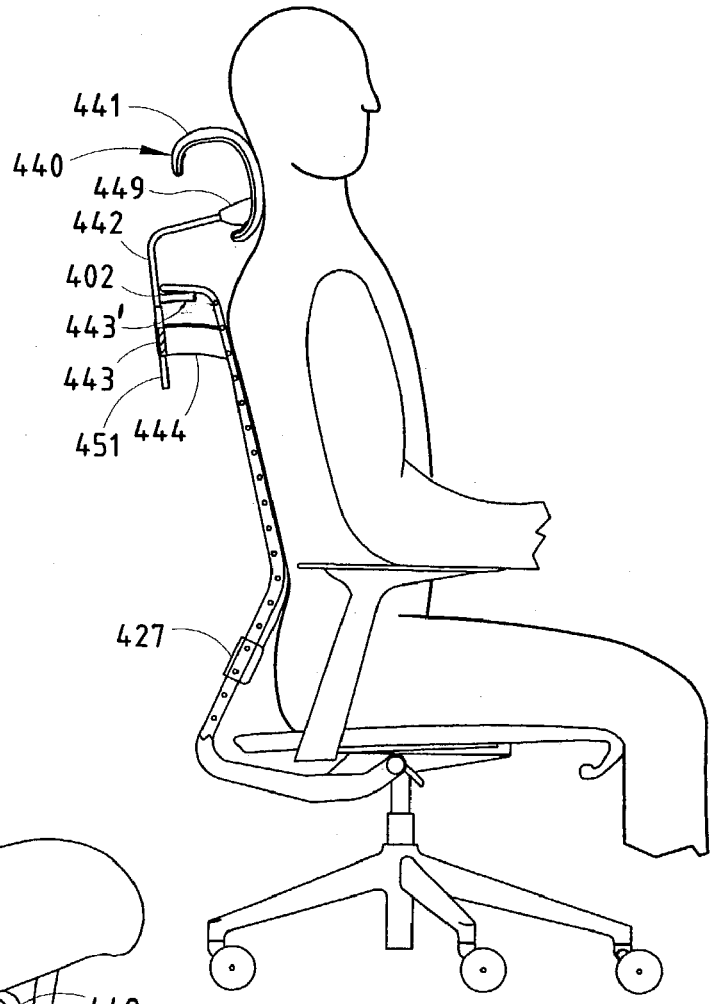
FIG. 59 is a perspective view of the chair of FIG. 40 with the lumber device of FIG. 55 in a disabled storage position.

The illustrated lumbar device 427 (FIG. 55) includes a plastic body 430 that extends around flange 425, a pair of hook-shaped retainer fingers 431 that slidably engage the rail 424, and a handle 432 that extends from body 430 opposite the retainer 431. A pair of detent bumps or recesses 433 are formed on the body 430 adjacent the retainer fingers 431, and are adapted to detentingly engage successive wire support members 78B as the lumbar device 427 is moved up and down. Interestingly, the lumbar device 427 can be adjusted downwardly to a non-use storage position (see FIG. 59), where the lumber device 427 is so low that it is effectively disabled since it is no longer effective to provide lumbar support to a seated user. As the lumbar device 427 is moved upwardly, the area of body 430 adjacent the detent bumps 433 supports the long wire sections 414 at locations inboard of the inner wall 408. (See FIG. 56.) Thus the effective bendable length of the long wire sections 414 is foreshortened, as illustrated by FIGS. 56–57. Thus, the added lumbar support comes from less flexing of the long wire sections 414, and does not come from a forced shape change to the lumbar support area on the back 23B (although it could also be designed to create a shape change in the lumbar, if desired). This "flat" adjustment is believed to have good ergonomic benefits, since a seated user receives the added lumbar support that they desire, yet their back and upper torso are not forced to take on a different body shape.

Another important discovery is the independent action of the right and left lumbar devices 427. By adjusting the right and lumber devices 427 to a same height, a maximum lumbar support force can be achieved in a particular area (i.e. two wire long support sections 414 are supported). By adjusting the right and left lumbar devices 427 to different heights, the lumbar support area is effectively enlarged (i.e. four wire long support sections 414 are supported). Further, where one lumbar device 427 is adjusted high and the other is adjusted relatively low but still in an effective lumbar supporting area, the lumber devices 427 provide an exceptionally wide range of non-uniform adjustability, i.e. more to the right in one area and more to the left in another area. It is also conceived that different lumbar devices 427 can be provided, such that a user can select the lumbar support that they desire by choosing an appropriate lumber device 427.

Even if a single one of the illustrated lumbar devices 427 is used (e.g. if the other side lumbar support device 427 is parked in the disabled position), the seated user does not feel an unbalanced lumber support from the back 23B. However, it is conceived that the present lumbar device 427 can be designed to appreciably shift the lumbar support to one side (i.e. the long wire section 414 is supported only on one side, such that more lumber support is provided on one side of the chair and less support on the other side). This initially may seem to be undesirable since the lumbar support is unbalanced. However, testing has shown that some seated users want and even prefer an unbalanced lumbar support. This may be particularly true for users having a curved spine, where non-uniform support has beneficial health effects. Also, users may want different lumbar support at different times as they sit and/or recline sideways in unsymmetrical positions, and as they turn and shift to different unbalanced positions in their chairs.

Figure 67:
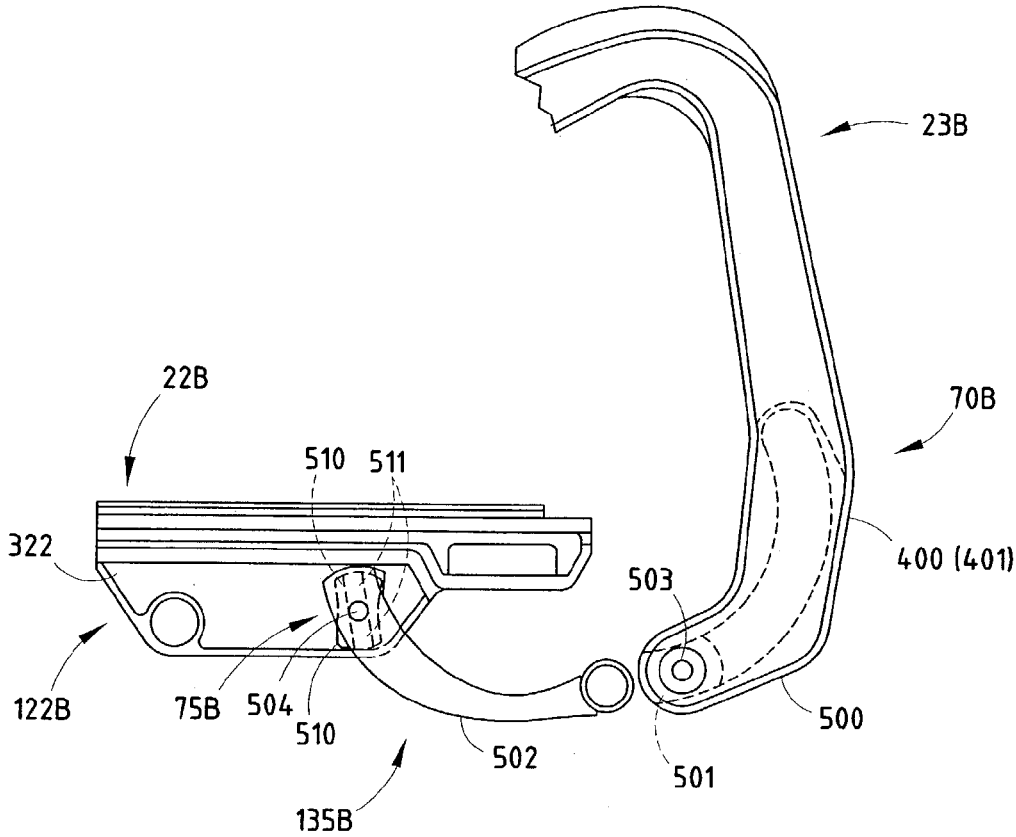
FIGS. 67–69 are fragmentary views of the back frame of FIG. 53 and side frame members of FIG. 45.
Figure 68:
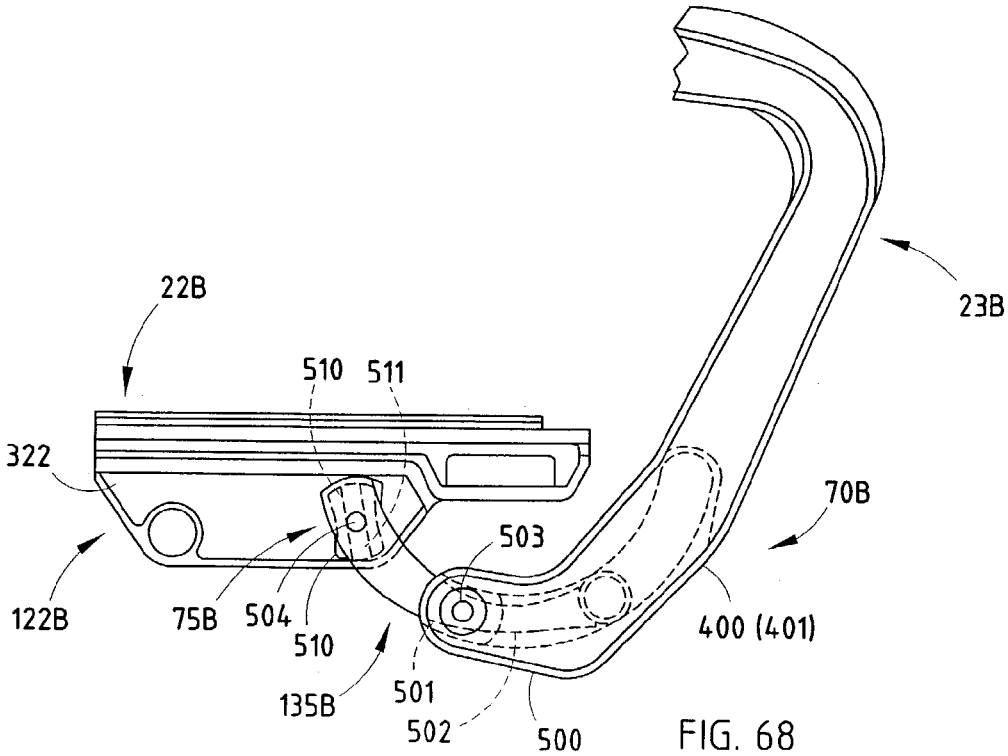

The illustrated back frame 70B (FIG. 67) has a unique construction that facilitates assembly. The bottom 500 of side sections 400 and 401 are hollow and each define an arcuate cavity 501. Side leg sections 135B include an arcuately-shaped body 502 configured to telescopingly slide into cavity 501. Once telescoped together, holes 503 and 504 on the bottoms 500 and side leg sections 135B align. Pivot pins are extended through holes 503 and 504 to form pivot 75B, and both secure the components (bottoms 500 and side leg sections 503 and 504) together, but also act as pivots for the back frame 70B on the seat 22B.

The side frame members 322 of the seat 22B include a pair of arcuate recesses 510 (FIGS. 48 and 67) that extend partially circumferentially around the hole 75B. The recesses 510 and holes 75B form a bow-tie-shaped feature. An inboard side of the side leg sections 135B include a pair of opposing protrusions 511 (FIG. 67) that fit into recesses 510. The protrusions 511 engage opposing ends of the recess 510 as the back frame 70B (i.e. back 23B) is rotated around pivot pins 505 between upright and fully-reclined positions, thus acting as a stop to set a maximum recline position of the back 23B.

Figure 60:
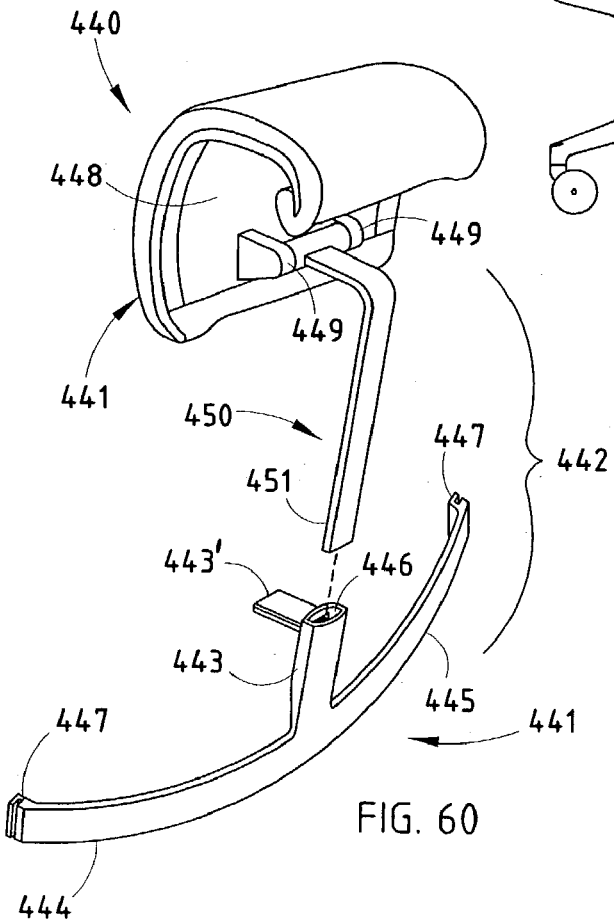
FIG. 60 is an exploded perspective view of the headrest assembly on the chair of FIG. 40.

A headrest 440 (FIG. 60) can be added to the chair 20B. The headrest 440 includes a headrest support 441 and a vertically and angularly adjustable headrest assembly 442. The headrest support 441 includes a center tube 443 and right and left arms 444 and 445 that extend to side sections 400 and 401 of the back frame 70B. The center tube 443 is positioned rearward of the transverse upper frame section 402 and includes a tab 443' configured to securely engage and be attached to the top frame section 402 of the back frame 70B. Alternatively, it is contemplated that the tube 443 can be positioned under and in-line with an opening in the rearwardly flared top frame member 402 of the back 238. The arms 444 and 445 each have an end 447 configured to engage the accessory rail 424 for stability. The headrest assembly 442 includes a cushioned C-shaped head-engaging support 441. A pair of mounts 449 are attached to a rear of a stiff sheet 448 under the C-shaped support 441. An upright support 450 includes a vertical leg 451 that extends slidably through the opening in the center tube 443. Detents can be provided in the upright support 450 and tube 443 to retain the headrest in a selected position.

Figure 61:
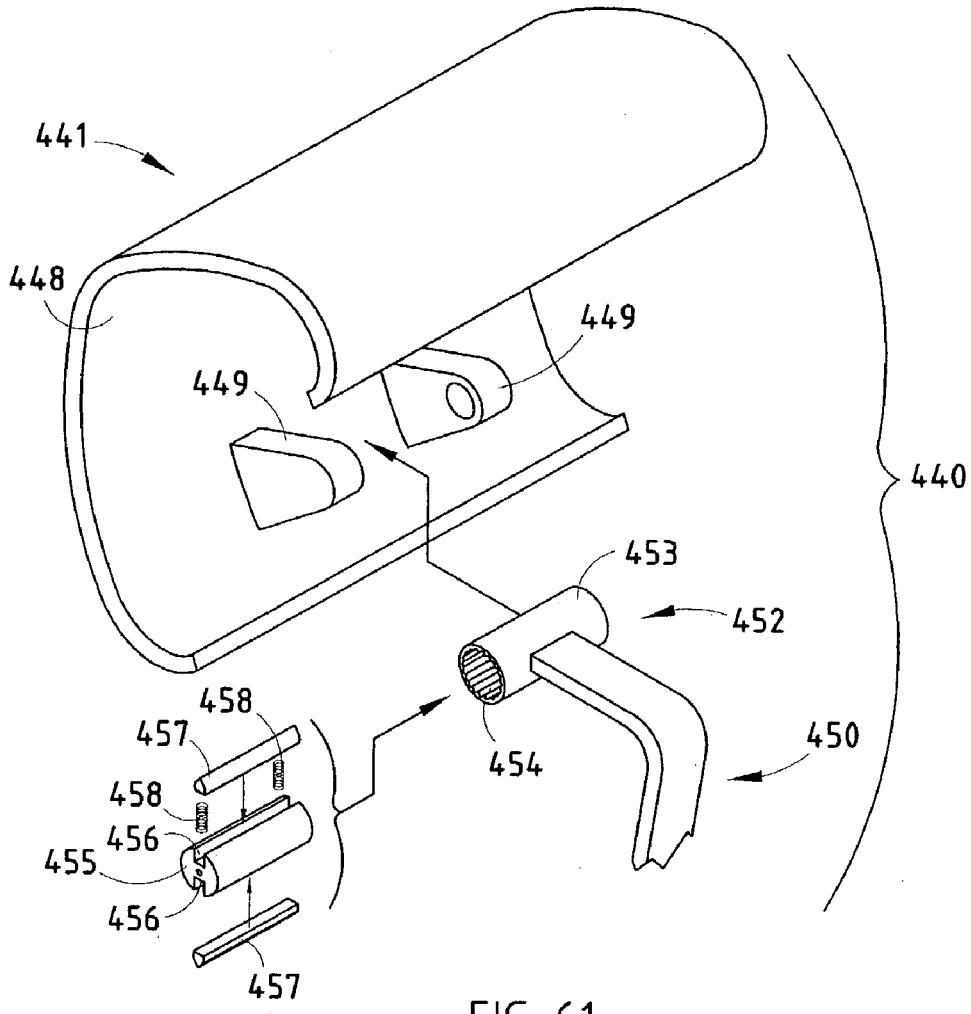
FIGS. 61–62 are an exploded perspective and exploded cross section of the headrest assembly of FIG. 60.
Figure 62:
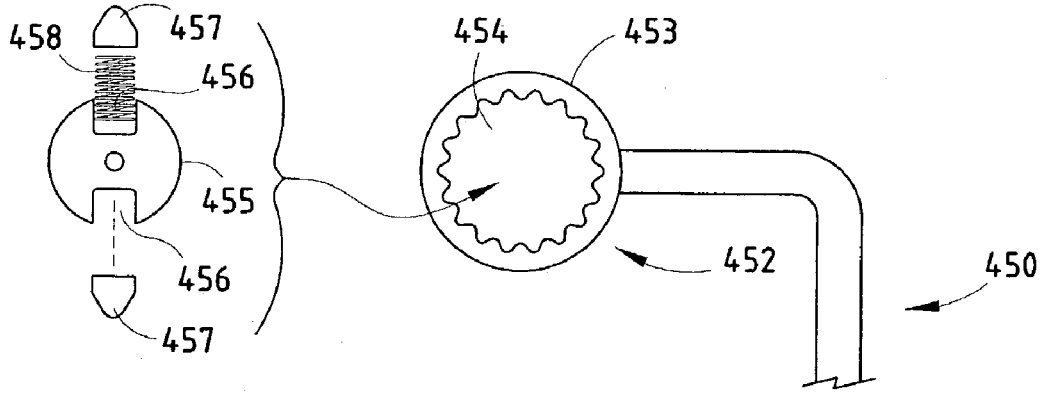

A top of the upright support 450 includes a transverse T-shaped hand 452 (FIG. 61) that extends between the mounts 449. The hand 452 (FIG. 61) includes a hollow tube member 453 with longitudinal serrations 454 around its inner surface. A bar 455 extends between and is fixed to the mounts 449. The bar 455 includes a pair of longitudinal channels 456, and a pair of detent rods 457 are positioned in the channels 456. Springs 458 are positioned in transverse holes in the bar 455, and bias the detent rods 457 outwardly into engagement with the serrations 454. By this arrangement, the headrest assembly 442 can be angularly adjusted on the headrest support 441. The C-shaped headrest support structure 448 has a forward surface that, in cross section, is spiral in shape and is non-symmetrical about the bar 455. Due to the shape of the C-shaped headrest support structure 448, the effective area for supporting a seated user's head moves forward as the headrest support structure 448 is angularly rotatingly adjusted.

Figure 69:
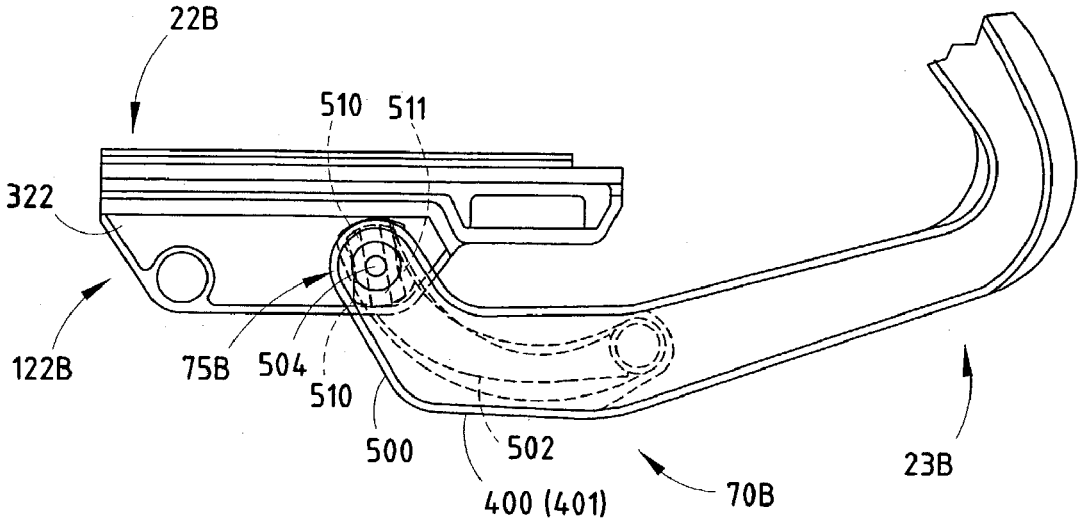

The seat supports (FIG. 50), back supports 78B (FIG. 53), seat frame 30B (FIGS. 45 and 50), back frame 70B (FIGS. 53 and 69), springs 123B' and 137B and control mechanism 24 (FIG. 45) form a compliant chair assembly that results in a soft stop as the back 23B reaches a full upright position, and results in a soft stop as the back 23B reaches a full recline position. This avoidance of a hard "clunk" or jerky stop, in combination with the fluidity and smoothness of the ride during recline is noticeable, and results in a surprising and unexpected level of support and comfort to a seated user.

It has been discovered that during recline of the chair 20B (FIG. 40) (and similarly chair 20 of FIG. 1), the structure of the link 132B and the arms 127B and the back frame upright 123B permit some compliant motion of the back 23B even when the back stop member 205B is engaged. Specifically, with the illustrated components, when the back 23B "bottoms out" against the back stop during recline, the support arms 127B and related components in the present chair control provide a compliancy internal to the control not previously seen in prior chair controls. Specifically, the arms 127B and related components allow the back 23B to give and comply a limited but noticeable amount. Thus, at the point of engaging the back stop, an increased back support force is provided to a seated user . . . but the feel of a rigid "brick wall" stop is avoided. Instead, the compliant support arms 127B and back frame upright 123B flex permitting the back 23B to move along a limited changed path to provide a compliant "soft stop". The forces on the back 23B along this limited changed path can be controlled by varying a strength and massiveness of the various structural elements of the chair, as will be understood by a person skilled in the art of manufacturing chairs and seating units.

It is noted that the present appearance and design of the illustrated chairs and individual components of the chairs, (such as the armrest, headrest, wires visible on a rear of the back, "gull wing" shape of the underseat control spring, and other items) are considered by the present inventors to be novel, ornamental, and non-obvious to a person of ordinary skill in this art, and hence are believed to be patentable.

Although an office chair is illustrated, it is specifically contemplated that the present inventive concepts are useful in other seating units other than office chairs. It is also contemplated that the present inventive concepts are useful in non-chair furniture and other applications where movement of a first structure relative to a second structure is desired, particularly where simultaneous coordinated or synchronized movement is desired and/or where a bias force is desired or adjustable stop is desired.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. A seating unit comprising:

a base, a reclineable back component, a seat component, and a control operably supporting the back component and the seat component on the base for synchronous movement between upright and reclined positions;

the control including at least one flexible support member supported on the base and also a link pivoted to the base for movement about a generally horizontal axis at a location spaced from the flexible support member; the flexible support member having arms with end sections operably attached to at least one of the seat and back components and being stiff in a generally vertical direction for carrying a combined weight of the one component and of the seated user, but being flexible in a generally horizontal direction to permit synchronous movement upon recline; the link being rigid and pivoted to the base and also pivotally coupled to the one component; whereby the flexible member and the link move the one component along a defined path during recline of the back component.

2. The seating unit defined in claim 1, wherein the one component is the seat component.

3. The seating unit defined in claim 1, wherein the one component is the back component.

4. The seating unit defined in claim 1, wherein the at least one flexible support member includes first and second support members that engage the back component and the seat component, respectively.

5. The seating unit defined in claim 1, wherein the flexible member comprises a leaf-spring-like compliant member.

6. The seating unit defined in claim 1, wherein the link is pivoted to a rear portion of the seat component and causes an arcuate movement of the rear portion, and the flexible member is attached to a front portion of the seat component and causes a generally linear movement of the front portion.

7. The seating unit defined in claim 1, wherein the ends of the arms are movable along an upward angle upon recline so that the seat component and any seated user on the seat are lifted upon recline, whereby energy is absorbed during recline, to automatically provide a heavier person with added counterbalancing force during recline and also automatically provide a supplemental lifting force to the heavier person during movement from the recline position back toward the upright position.

8. The seating unit defined in claim 1, including a booster mechanism operably attached to the link, the booster mechanism having a torsion spring selectively engageable to boost and increase a support force provided during recline.

9. A seating unit comprising:

a base;

a seat component and a reclineable back component;

an underseat control for operably supporting the seat component and the back component for coordinated synchronous movement upon recline of the back component, the control including arms that are moveable in a generally horizontal direction for supporting at least one of the seat component and the back component;

the one component including a comfort surface structure, the comfort surface structure including horizontally-extending support wires adapted to individually flex in response to contours of a seated user.

10. The seating unit defined in claim 9, wherein the arms lift the seat component during recline to provide an automatic weight-activated increased back support force upon recline.

11. The seating unit defined in claim 9, wherein the wires include parallel linear sections that extend across the one component.

12. The seating unit defined in claim 9, wherein the one component is the seat component.

13. The seating unit defined in claim 9, wherein the one component is the back component.

14. The seating unit defined in claim 9, wherein the one component moves primarily in a horizontal direction but also with a vertical component of direction.

15. The seating unit defined in claim 9, including a link pivoted to a rear portion of the seat component and causes generally arcuate movement of the rear portion, and the flexible member is attached to a front portion of the seat component and causes a generally linear movement of the front portion.

16. The seating unit defined in claim 9, wherein the control includes at least one flexible member attached to the base and operably supporting one of the back and seat components.

17. The seating unit defined in claim 16, wherein the control includes a link pivoted to the seat and the base, the link being spaced from the flexible member.

18. A seating unit comprising:

a base;

a back component;

a seat component; and an underseat control operably coupled to and supporting the back component and the seat component on the base for synchronous movement between upright and reclined positions; the control including compliant arms that are moveable in a generally horizontal direction for supporting at least one of the seat component and the back component, and also including a link pivoted to the base and pivoted to the seat component for movement about a generally horizontal axis on the base at a location spaced from the arms.

19. The seating unit defined in claim 18, wherein the compliant arms are resilient and flexible in a first direction, but stiff and structural for carrying a load in a second direction perpendicular to the first direction.

20. The seating unit defined in claim 18, wherein the compliant arms include at least one first arm supporting the back component and at least one second arm supporting the seat component.

21. A seating unit comprising:

a base;

a back component;

a seat component; and an underseat control operably coupled to and supporting the back component and the seat component on the base for synchronous movement between upright and reclined positions; the control including compliant arms that are moveable in a generally horizontal direction for supporting at least one of the seat component and the back component, and also including a booster mechanism selectively engageable to bias the one component toward the upright position.

22. The seating unit defined in claim 21, including an on/off actuator for switching the booster mechanism between on and off positions.

23. A seating unit comprising:

a base;

a back component;

a seat component; and an underseat control operably coupled to and supporting the back component and the seat component on the base for synchronous movement between upright and reclined positions; the control including compliant arms that are moveable in a generally horizontal direction for supporting at least one of the seat component and the back component, and also including a back stop mechanism selectively engageable to limit movement of the one component toward the reclined position.

24. The seating unit defined in claim 23, wherein the compliant arms are resilient and flexible in a first direction, but stiff and structural for carrying a load in a second direction perpendicular to the first direction.

25. The seating unit defined in claim 24, wherein the compliant arms include at least one first arm supporting the back component and at least one second arm supporting the seat component.

26. The seating unit defined in claim 23, wherein at least one of the seat component and the back component include a frame defining a center opening and a plurality of independently-flexible wires extending across the opening for supporting a seated user; and a sheet covering the wires.

27. The seating unit defined in claim 26, wherein the wires are located on both the seat and back components.

28. The seating unit defined in claim 26, including a cushion under the sheet.

29. A seating unit comprising:

a seat;

a control mechanism having a plurality of compliant support arms, said support arms being relatively stiff in a generally vertical direction for supporting weight and relatively flexible in a generally horizontal direction for allowing movement of the weight; and a back operably supported by at least one of said plurality of compliant support arms such that said back is allowed to move as said compliant support arms flex, thus providing a compliant back support system for said seating unit, wherein the compliant support arms include first and second support arms that engage the back and the seat, respectively.

30. The seating unit defined in claim 29, wherein the compliant support arms include leaf-spring-simulating compliant members.

31. A seating unit comprising:

A seat;

a control mechanism having a plurality of compliant support arms, said support arms being relatively stiff in a generally vertical direction for supporting weight and relatively flexible in a generally horizontal direction for allowing movement of the weight; and a back operably supported by at least one of said plurality of compliant support arms such that said back is allowed to move as said compliant support arms flex, thus providing a compliant back support system for said seating unit; and including a base operably supporting the seat for forward movement upon recline of the back.

32. The seating unit defined in claim 29, including a base supporting the support arms, and wherein the control mechanism includes a link pivoted to the base and also pivoted to one of the seat and back.

33. A seating unit, comprising:

a seat;

a control mechanism having at least one compliant support arm, a movable link and a stop device for selectively preventing said link from moving; and a back attached to said at least one compliant support arm and said movable link, said at least one compliant support arm allowing said back to move as said at least one compliant support arm flexes to provide a compliant back support system for said seating unit even when said link is prevented from moving.

34. The seating unit defined in claim 33, wherein the at least one compliant support arm includes first and second support arms that engage the back and the seat, respectively.

35. The seating unit defined in claim 33, wherein the at least one compliant support arm includes a leaf-spring-like compliant member.

36. The seating unit defined in claim 33, including a base operably supporting the seat for forward movement upon recline of the back.

* * * * *